US006944893B1

(12) United States Patent
Mattson, Jr. et al.

(10) Patent No.: US 6,944,893 B1
(45) Date of Patent: Sep. 20, 2005

(54) COMBINATION SANITATION SUCTION DEVICE AND HIGH FLOW ANTIMICROBIAL DISPENSER

(75) Inventors: Roy W. Mattson, Jr., 1732 Spencer St., Longmont, CO (US) 80501; Paulette C. Ogden, 1732 Spencer St., Longmont, CO (US) 80501; Philip I. Ogden, Longmont, CO (US)

(73) Assignees: Roy W. Mattson, Jr., Longmont, CO (US); Paulette C. Ogden, Longmont, CO (US)

( * ) Notice: Subject to any disclaimer, the term of this patent is extended or adjusted under 35 U.S.C. 154(b) by 0 days.

(21) Appl. No.: 10/624,432

(22) Filed: Jul. 22, 2003

(51) Int. Cl.[7] ..... A47K 3/00

(52) U.S. Cl. ..... 4/541.1; 4/504; 4/509; 210/169

(58) Field of Search ..... 4/490, 504, 507, 4/509, 541.1, 541.3; 210/169, 416.2, 749, 764; 137/268; 422/274, 275, 261–264, 281

(56) References Cited

U.S. PATENT DOCUMENTS

| | | | |
|---|---|---|---|
| 2,329,987 | A | 9/1943 | Goodloe |
| 3,263,811 | A | 8/1966 | Baker et al. |
| 3,426,901 | A | 2/1969 | Sherper |
| 3,615,244 | A | 10/1971 | Long et al. |
| 4,233,694 | A | 11/1980 | Janosko et al. |
| 4,309,992 | A | 1/1982 | Dodak et al. |
| 4,340,039 | A | 7/1982 | Hibbard et al. |
| 4,349,434 | A | 9/1982 | Jaworski |
| 4,359,790 | A | 11/1982 | Chalberg |
| 4,426,286 | A | 1/1984 | Puckett et al. |
| 4,504,387 | A | 3/1985 | LeMire et al. |
| 4,533,476 | A | 8/1985 | Watkins |
| 4,552,658 | A | 11/1985 | Adcock et al. |
| 4,584,106 | A | 4/1986 | Held |
| 4,637,873 | A | 1/1987 | DeSousa et al. |
| 4,676,894 | A | 6/1987 | Diamond et al. |
| 4,780,197 | A | 10/1988 | Schuman |
| 4,818,389 | A | 4/1989 | Tobias et al. |
| 4,857,112 | A | 8/1989 | Franninge |
| 4,880,547 | A | 11/1989 | Etani |
| 4,933,178 | A | 6/1990 | Capelli |
| 4,971,687 | A | 11/1990 | Anderson |
| 4,979,245 | A | 12/1990 | Gandini |
| 5,167,041 | A | 12/1992 | Burkitt, III |

(Continued)

FOREIGN PATENT DOCUMENTS

| | | |
|---|---|---|
| DE | 199 61049 A1 | 6/2001 |
| JP | 4-214150 | 8/1992 |
| JP | 7-80218 | 3/1995 |
| JP | 09-201300 | 8/1997 |
| JP | 10-192847 | 7/1998 |
| JP | 11-267414 | 10/1999 |

OTHER PUBLICATIONS

U.S. Appl. No. 10/841,925, filed May 7, 2004, Mattson et al.
Lasco Bathware, Inc., Acrylic Builder's Choice Whirlpools, Alydar I & II, Information Page (2 pages).
American Standard Bathroom Fixtures and Faucets, Product Details, Internet Web Page at www.americanstandard–us.com, Apr. 14, 2004, 2 pages.
http://www.poolandspa.com/gage377.htm, Poll Equipment Safety Tips—Detailed, Apr. 27., 2003, 8 pages.

(Continued)

*Primary Examiner*—Gregory L. Huson
*Assistant Examiner*—Peter deVore

(57) ABSTRACT

A device and method to inhibit bacteria in a whirlpool bathtub and its closed looped plumbing system between each whirlpool bathtub drain down as well as during each whirlpool bathtub use. In addition to combining a high flow antimicrobial chamber with a suction device, the present invention incorporates safety features.

69 Claims, 34 Drawing Sheets

U.S. PATENT DOCUMENTS 5,204,004 A 4/1993 Johnston et al.
5,236,581 A 8/1993 Perry
5,277,802 A 1/1994 Goodwin
5,328,602 A 7/1994 Brooks
5,347,664 A 9/1994 Hamza et al.
5,383,239 A 1/1995 Mathis et al.
5,392,472 A 2/1995 Maxfield
5,405,644 A 4/1995 Ohsumi et al.
5,441,529 A 8/1995 Dorsch
5,441,711 A 8/1995 Drewery
5,656,159 A 8/1997 Spencer et al.
5,762,797 A 6/1998 Patrick et al.
5,779,913 A 7/1998 Denkewicz, Jr. et al.
5,785,845 A 7/1998 Colaiano
5,799,339 A 9/1998 Perry et al.
5,810,043 A 9/1998 Grenier
5,810,999 A 9/1998 Bachand et al.
5,857,594 A 1/1999 Ozturk
5,862,545 A 1/1999 Mathis et al.
5,868,933 A 2/1999 Patrick et al.
5,888,386 A 3/1999 Enright et al.
5,919,554 A 7/1999 Watterson, III et al.
5,928,510 A 7/1999 Meredith
5,932,093 A 8/1999 Chulick
5,935,518 A 8/1999 Richard et al.
5,980,761 A 11/1999 Boissie et al.
6,019,893 A 2/2000 Denkewicz, Jr. et al.
6,030,632 A 2/2000 Sawan et al.
6,038,712 A 3/2000 Chalberg et al.
6,065,161 A 5/2000 Matcina et al.
6,066,253 A 5/2000 Idland et al.
6,138,703 A 10/2000 Ferguson et al.
6,162,401 A 12/2000 Callaghan
6,165,358 A 12/2000 Denkewicz, Jr. et al.
6,170,095 B1 1/2001 Zars
6,171,496 B1 1/2001 Patil
6,182,681 B1 2/2001 Robertson et al.
6,199,224 B1 3/2001 Versland
6,214,217 B1 4/2001 Sliger, Jr.
6,238,575 B1 5/2001 Patil
6,269,493 B2 8/2001 Sorensen
6,279,177 B1 8/2001 Gloodt
6,282,370 B1 8/2001 Cline et al.
6,283,308 B1 9/2001 Patil et al.
6,287,466 B1 9/2001 Yassin
6,289,530 B1 9/2001 Miller et al.
6,298,871 B1 10/2001 Pickens et al.
6,317,903 B1 11/2001 Brunelle et al.
6,328,900 B1 12/2001 King
6,331,432 B1 12/2001 Bautista et al.
6,340,431 B2 1/2002 Khan
6,342,841 B1 1/2002 Stingl
6,357,060 B2 3/2002 Gloodt
6,358,425 B1 3/2002 King
6,390,340 B1 5/2002 Lynch, Sr.
6,391,167 B1 5/2002 Grannersberger
6,395,167 B1 5/2002 Mattson, Jr. et al.
6,405,387 B1 6/2002 Barnes
6,409,864 B1 6/2002 Choi
6,419,839 B1 7/2002 Cox et al.
6,419,840 B1 7/2002 Meincke
6,444,129 B1 9/2002 Collins
6,497,822 B2 12/2002 Blanchette et al.
6,511,605 B2 1/2003 Connelly, Jr.
6,517,727 B2 2/2003 Pickens et al.
6,523,192 B1 2/2003 Gloodt
6,540,916 B2 4/2003 Patil
6,544,415 B2 4/2003 King
6,562,242 B2 5/2003 King et al.
6,760,931 B1 * 7/2004 Mattson et al. ..... 4/541.1
2001/0003217 A1 6/2001 Sorensen
2001/0013373 A1 8/2001 Wright
2001/0027573 A1 10/2001 Gloodt
2003/0029789 A1 2/2003 Patil
2003/0113378 A1 6/2003 Laridon et al.
2003/0150796 A1 8/2003 Heinig, Jr.
2003/0178374 A1 9/2003 Arata
2003/0213059 A1 11/2003 Mattson, Jr. et al.

OTHER PUBLICATIONS

Letter from Triodyne Safety Systems (Ron Schroader), L.L.C. to Florida Building Code Commission, dated Feb. 21, 2002, 1 page.

Sta–Rite Pool/Spa Group, U–3 Skimmer, 39501–0028 (Rev. May 31, 2002), 4 pages.

http://www.ci.tucson.az.us/dsd/Ordinances_Codes/Pool_and_Spa_Code.pdt, Tucson Arizona Ordinances, Spa/{Pool Code, 95 pages.

US Consumer Product Safety Commission, Washington DC 20207, Guidelines for Entrapment Hazards, Making Pools and Spas Safer, Pub. No. 363, 009801, 35 pages.

The Alexa TM, Portable Whirlpools Spa Owners Manual, Model D600000. 20 pages. 1993 Jacuzzi Whirlpool Bath, D612000 A May 5, 1995.

http://www.tsunamispas.com/spa_maintence.htm Maintenance, the Care and Feeding of your spa . . . , Apr. 27, 2003, 2 pages.

Jacuzzi Leisure Products Inc., Above Ground Pool Skimmer (Jan. 22, 1998) 22–9117–51. Operation/Installation Instructions Model AGS–12 Automatic Skimmer, 4 pages.

Jacuzzi Leisure Products Inc, Above Ground Pool Skim Filter 22–9117–60 Operation/Installation Instructions Model AGSF6–25 Automatic Skim Filter, 4 pages.

Jacuzzi Leisure Products, Inc. Above Ground Pool Skimmer (Jan. 22, 1998) 22–9117–50 Operation/Installation Instructions Model AGS–6 Automatic Skimmer, 4 pages.

Bermuda Gunite Skimmer, Installation, Operation & Service Manual, 51–6256 REV D Dec. 1, 1993, 4 pages.

PacFab, Inc. Admiral S–15 Automatic Skimmer Owner's Manual, Ref. 99800000, Rev. Mar. 27, 1998, 4 pages.

http://www.tdh.state.tx.us/beh/gs/inspool8.doc, commercial Swimming Pool/Spa Inspection, 5 pages.

http://www.bajaspa.com/plant.html, Plant Tour, Apr. 27, 2003, 1 page.

http://www.calderaspas.com/Guide/index.html, CalderSpas, Apr. 27, 2003, 5 pages.

http://www.coastspas.com/ownersman2.htm, Customer Service—Owner's Manual, Apr. 25, 2003, 3 pages.

http://www.ediscountwholesalers.com/spas/q_xspa_detail.html,. uantum X–SpaDilion, Apr. 27, 2003, 3 pages.

The Spa Specialist Inc. Designing Safe Wooden Hot Tub Suction Fittings, 2 pages.

http://www.httg.com/fileters_skim.htm., Hot Tubs To Go! Waterway Skim Ffilter, Apr. 27, 2003. 3 pages.

ASME/ANSE A112.19.8M–1987, Manual, Suction Fittings for Use in Swimming Pools . . . 11 pages.

ASME A112.19.7m–1995 (Revision of ASME/ANSI A112.7M–1987), Whirlpool Bathtub Appliances, 14 pages.

http://www.sanijet.info/faq.htm, Frequently Asked Questions, Jun. 23, 2003, 15 pages.

Hauser Labs, Letter to Mattson Industries, dated Octover 11, 2001, Project No. 43081–1, 5 pages.

http://www.kidsource.com/cpsc/pools.spa.html, CPSC Issues Warning for Pools, Spas, and Hot Tubs, Jun. 3, 1996, Release #96–139, 2 pages.
http://www.cpsc.gov/cpspub/pubs/5067.html, Consumer Product Safety Commision, Document #5067, 1 page.
http://www.lifesaving.com/issues/articles/17pool_spa _entrapment.html, Pool & Spa Entrapment, by Gerald M. Dworkin, May 21, 1998, 4 pages.
Lasco Bathware, Inc., Installation Instructions. and Operating and Maintenance Guide, 5 pages.
Sta–Rite Industries, Sta–Rite Pool/Spa Group, U–3 Skimmer, Installation, Operation & Parts, 39501–0028 (Rev. May 31, 2002), 4 pages.
New Mexico State University, Cooperative Extension Service, College of Agriculture and Home Economics, Sizing Plastic Pipelines for Water on the Range, Guide B–810, Charles M. Hohn, 2 pages.
NAFa Position Statement on Bio–Terrorism, Using ASHRAI Standard 52.2 in Preparedness ofr bio–terrorism, 4 pages.
Centers for Disease Control and Prevention, Morbidity and Mortality Weekly Report, Legionnaires Disease Associated with a Whirlpool Spa Display—Virginia, Sep.–Oct., 1996.
http://www.wcp.net/archive/aug00ontap.htm, Microbial Infections Associated with Whirlpool Baths and Spa, Kelly A. rynolds, Ph.D., Jun. 23, 2003, 6 pages.
http://www.kidsource.com/cpsc/pools.spa..html, CPSC Issues Warning for Pools, Spas, and Hot Tubs, Jun. 3, 1996, Release #96–139, 2 pages.
http://www.kidsource.com/CPSC/pool_tips.html, Backyard Pool: Always Supervise Children, Safety commision Warns, DPSC Document #5097, Sep. 20, 2002, 3 pages.
http://www.safetyalerts.com/rcls/cpsc/pr/97/97059.html, CPSC and Sta–Rite Industries Announce Pool Fittings Recall, Sep. 20, 2000, 2 pages.
http://www.cpsc.gov/cpscub/prerel/prhtm182/82023.html, News from CPSC, U.S.> Consumer Product Safety Commission, Release #82–023, Sep. 20, 2002, 2 pages.
htttp://www.ul.com/eph/insights/ephiv3n3/suction.html, EPHinsights, Everything you wanted to know about UL Listed suction fittings, Sep. 11, 2002, 3 pages.
http://www.poolandspa.com.gage377.htm, Poll Equipmnet Safty Tips—Detailed, Apr. 27., 2003, 8 pages.
Letter from Trlodyne Safety Systems (Ron Schroader), L.L.C. to Florida Building Code Commission, dated Feb. 21, 2002, 1 page.
Sta–Rite Pool/Spa Group, U–3 Skimmer, 39501–0028 (Rev. May 31, 2002), 4 pages.
http://www.ci.tuscon.az.us/dsd/Ordinances_Codes/Pool_ and _Spa_Code.pdt, Tuscon Arizona Ordinances, Spa/{Pool Code, 95 pages.
US Consumer Product Safety Commission, Washington DC 20227, Guidelines for Entrapment Hazards, Making Pools and Spas Safer, Pub. No. 363, 009801, 35 pages.
Pentair Pool Products, FAS–100 Front Access Skimmer Owner's Manual, P/N 99590000, Rev. B. Feb. 27, 2002, 4 pages.
http://www.vac–alert.com/it_happened_so_fast.htm, Incident report, Apr. 27, 2003, 2 pages.
http://www.chemex.com.au/cirulat.htm, Circulation, 1 page.
http://www.kiocymru.co.uk/hints1.htm, Hints & Tips. 2 pages.
http://www.poolproducts.com/lomart_features.html, Lomart Pool Features, 3 pages.
http://www.holidaypools.com/layout1b.cfm?item=997, Holiday Pool & Spa Supply, Hayward Dyna–Skim Spa and Aboveground Pool Skimmer, 2 pages.
Selover Protest Paulette Ogden.
Aqua Glass Indulgence Collection Installation and Operating Instructions 64 & 66 Series p. 3.
Sections 4.3 Suction Return Strainer Cover.
Mirolin Acrylic Whirlpools Installation and Operation Instructions p. 7 Fi 6.7.
Lasco Bathware Acrylic Buildings Choice Whirlpools Alydar I & II Union Standard Features.
Manual of Date of Examinining Proceedings 2165 The Best Mode Requirement.
61 Custom Bath Whirlpool with Heater Kohler p. 2 K–1194 HB, K–1198–HB.
Kay Weber Protest on Selover U.S. Appl. No. 10/459,665.

* cited by examiner

COMBINATION SANITATION SUCTION DEVICE AND HIGH FLOW ANTIMICROBIAL DISPENSER

FIELD OF THE INVENTION

The present invention relates to combining a high flow antimicrobial chamber with a suction device in a closed loop home or hotel whirlpool bath, hydrotherapeutic baths, and other bathing receptacles. The present invention also relates to various anti-suction safety features. Further, the present invention relates to inhibiting bacteria growth in a whirlpool bathtub during use, and more specifically, to limiting bacteria growth in the closed looped plumbing system of a whirlpool bathtub after draining and/or between uses.

BACKGROUND OF THE INVENTION

Whirlpool-type baths have been employed to treat discomfort resulting from strained muscles, joint ailments and the like. More recently, such baths have been used increasingly as means of relaxing from the daily stresses of modem life. A therapeutic effect is derived from bubbling water and swirling jet streams that create an invigorating hydro massage of the user's body.

To create the desired whirlpool motion and hydro massage effect, a motorized water pump draws water through a suction fitting in a receptacle, such as a bathtub. The user first fills the bathtub. Then the user activates the closed loop whirlpool system. The closed looped plumbing system is considered to be all parts of a whirlpool bathtub that cannot be opened for cleaning. Thus, the jets, pump, piping system, air controls, sanitation suction device and the like and all components that cannot be opened for cleaning form the inline closed looped plumbing system of a whirlpool bath. The water travels through a piping system and back out jet fittings. Jet fittings are typically employed to inject water at a high velocity into a bathtub. Usually the jet fittings are adapted to aspirate air so that the water discharged into the receptacle is aerated to achieve the desired bubbling effect. (See e.g., U.S. Pat. No. 4,340,039 to Hibbard et al., incorporated herein by reference, and U.S. Pat. No. 6,395,167 to Mattson, Jr. et al. ("Mattson") which is incorporated herein by reference.)

Generally, whirlpool baths are designed like a normal bathtub to be drained after each use. However, debris in the form of dead skin, soap, hair and other foreign material circulates throughout the closed loop plumbing system. This debris does not completely drain and over time, it accumulates in the closed loop plumbing system. Such debris has been reported by scientists to cause a human health risk.

Because some liability issues have been raised in regards to the effects of bacteria growth in a whirlpool bathtub and particularly bacteria growth between whirlpool bathtub uses, whirlpool bathtub manufacturers are now recommending expensive and time consuming periodic flushing requirements for their whirlpool bathtubs. For instance, Installation Instructions and Operations and Maintenance Guide LAB-WP-IP-11/02-20M-WP, published by Lasco Bathware, Inc., 8101 E. Kaiser Blvd., Anaheim, Calif. 92808, instructs a user on how to install, operate, and maintain a jetted bath properly and safely. Page 19 of Lasco's Guide under the heading "Circulating System" states:

> ". . . [W]e recommend that you purge it [whirlpool] at least twice a month, or more depending upon use. . . . Fill the bath with hot water . . . . Add to the hot water, 4(6) tablespoons of low foaming detergent such as liquid Cascade or Calgonite and 24(48) oz. of liquid household bleach . . . . Turn air induction completely off. Run the bath for 5 to 10 minutes. Drain the bath completely and refill with cold water only. Run the whirlpool for 5–10 minutes. Drain the bath completely and refill with cold water only. Run the whirlpool for 5 to 10 minutes, then drain bath completely."

The present invention is the only device known in the art that may lower the recommended purge frequency for whirlpool bathtub systems. Furthermore, it may possibly even eliminate periodic flushing requirements.

On its website at www.sanijet.info/faq.htm, Sanijet Corporation, 1462 S. Beltline Road, Coppell, Tex. 75019, publishes information regarding whirlpool bath systems that consumers have a right to know. Sanijet cites Rita Moyes, Ph.D., Director of the Microbiology Laboratory, Texas A&M University, who tested over 40 whirlpool bath water samples from homes and hotels across the country, as having determined that all of the samples tested positive for at least one type of (and frequently more) pathogenic bacteria or fungus.

> "Since December 1998, I have been conducting tests on the microbial content of whirlpool bath water from piped whirlpool baths in homes and hotels across the nation. These tests were conducted on aseptically collected samples sent to me in sterile containers, which were then subjected to standardized laboratory tests to assess relative bacterial numbers. All piped whirlpool bathtubs present identical dangers of microbial propagation because the biofilms, which constitute the bacterial environment, collect and remain on the interior of the piping. All tub samples tested contained microorganisms including enteric organisms, fungi, *Pseudomonas* sp., *Legionella* sp., and *Staphylococcus aureus*. The enteric bacteria cause 30–35% of all septicemias (blood infections), >70% of urinary tract infections, and many intestinal infections. *Pseudomonas aeruginosa* has been implicated in infections of the respiratory tract, burn wounds, urinary tract, ear, and eye. It can also cause bacteremia, endocarditis, and gastroenteritis. All *Pseudomonas*sp. can cause opportunistic infections in immunocompromised patients. *Legionella* is the causative agent of Legionnaires' disease (with a 20% mortality rate) and Pontiac fever. *Staphylococcus aureus* causes a number of cutaneous infections including impetigo, folliculitis, furuncles, carbuncles, and wound infections. *S. Aureus* also release a toxin, which is responsible for scalded skin syndrome, toxic shock syndrome, and food poisoning. *S. aureus* is also an etiological agent for bacteremia, endocarditis, pneumonia, empyema (pus in the plural cavity), osteomyelitis, and septic arthritis. This was just a preliminary study and I tested for only a few types of organisms but it should be obvious that the presence of these microorganisms illustrate the potential health risk the bather exposes themselves to upon each entry into the tub."
>
> "Any piped system will propagate harmfull microbes which can and do cause sickness and death in humans."
>
> "Due to the presence of pathogenic and potentially pathogenic organisms, education of the public on the hazards of piped whirlpool bathtubs use should become a priority."

Rita Moyes, Ph.D., as cited in *Sanijet Frequently Asked Questions, Question No.* 6 *regarding evidence that shows*

*piped whirlpool circulation systems promote the growth of infectious microorganisms* (visited Jun. 23, 2003) <http://www.sanijet.cinfo/faq.htm>.

Sanijet cites Dr. Jon R. Geiger, Ph.D., Group Leader, Microbiology, Olin Research Center Cheshire, Connecticut, as stating:

> "I suspect that [air induction systems] may be a reservoir for all kinds of organisms. . . . organics provide food and shelter for microorganisms, including possible pathogens."

Jon R. Geiger, Ph.D., as cited in *Sanijet Frequently Asked Questions, Question No.* 12 *regarding the identification of the Legionella organism in piped whirlpool baths* (visited Jun. 23, 2003) <http://www.sanijet.cinfo/faq.htm>.

Sanijet cites William J. Costerton, Ph.D., microbiologist, Director of the Center for Biofilm Engineering (CBE), Montana State University, as stating:

> "The CBE is the premier research institution for the study of the slimy surface aggregations of bacteria called biofilms. I coined the tern 'biofilm' . . . in an article in Scientific American (Feb. 1978), and have since published more than 400 research papers on this topic."

William J. Costerton, Ph.D., as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>. Further, Dr. Costerton comments on a controlled study of a Jacuzzi piped whirlpool bath by a CBE research engineer:

> "The data summarized in this report show, with scientific certainty, that biofilms are formed on the surfaces of the pipes that feed the jets, and that these biofilms contain very large numbers (hundreds of thousands of cells per square centimeter) of heterotrophic bacteria, including many cells of *Pseudomonas aeruginosa.* This test reconfirms the widely known fact that biofilm forms in piped systems of this nature and it will form similarly in any whirlpool tub that humans use for bathing which utilize a piped circulating system. Irrespective of how well the system drains, water adheres to the interior pipe walls and this is the initial mechanism by which the bacteria are able to attach to the surfaces and thereafter begin the process of forming biofilm. Because small particles are always entrained in bubbles, the whirlpool jets produce an aerosol that contains bacteria from these biofilms, and direct observations of this test system have shown that the aerosol contains sessile bacteria in matrix-enclosed biofilm fragments. It is therefore a scientific certainty that any person using this whirlpool bath, with the jets in operation, would be exposed to airborne biofilm fragments containing pathogenic bacteria. While it cannot be predicted with certainty which bathers will develop overt pulmonary disease, it can be stated with scientific certainty that all bathers will have been exposed to the potentially hazardous aspiration of biofilm fragments as a result of using this whirlpool bath."
>
> "The chance of infection during any given bath cannot be predicted with mathematical precision because contact with, or duration of, the bacteria is a random event depending on many variables. However, it is scientifically certain that all bathers are exposed to an environment conducive to infection and—if they are bathing in the typical nude fashion and having no device filtering the air they breathe—which, of course, is the usual procedures, they are taking no precaution against infection in an environment where they are surrounded by microscopic disease causing organisms and, unbeknownst to them, they should be taking precautions."
>
> "Our experience in the cleaning of biofilm colonized pipes, for the re-use of these systems in laboratory experiments, indicates that a 24-hour exposure to bleach (at a sustained hypochlorite concentration of more than 2%) is necessary to kill bacteria in biofilms and to remove the biofilm matrix from these surfaces. If the matrix material is not removed, the regrowth of the biofilms is very rapid (less than 2 days), while perfectly clean surfaces will re-foul in +/−4 days. Because these effective measures would be beyond the resources of even the most fastidious spa owners, there is essentially no way to keep units designed in this way free from biofilms that constitute a real risk to human health."

Id.

It is well-known in the art that biofilms are produced by microorganisms and consist of a sticky rigid structure of polysaccharides and other organic contaminants. This slime layer is anchored firmly to a surface and provides a protective environment in which microorganisms grow. Biofilms generally form on any surface that is exposed to non-sterile water or other liquids and is consequently found in many environmental, industrial and medical systems.

Sanijet cites Michael Nicar, Ph.D., Epidemiologist, board certified in clinical chemistry and pulmonary function testing, and credentialed in the field of human disease testing and research, as stating > "The relative risk for transmission of Legionella via whirlpools, is significant (The Lancet 347:494, 1996), even for people standing next to the whirlpools (they did not even have to get in to the water). The drain and fill whirlpools make aerosols just like the hot tub models. Thus, the transmission of disease is the same between the drain and fill and the constant filled hot tub models."
>
> "Physicians need to know that [whirlpool bathtubs] are a source of exposure to *Legionella* bacteria. Otherwise, an erroneous diagnosis and incorrect choice of therapy may result. . . . Delay of appropriate therapy can result in prolonged hospitalization, complications, and death. . . . "

Michael Nicar, Ph.D., as cited in *Sanijet Frequently Asked Questions, Question No.* 13 *regarding assessments a consumer can make about the health risk of using a piped whirlpool bath* (visited Jun. 23, 2003) <http://www.sanijet.cinfo/faq.htm>.

Sanijet cites Dr. Christine Pasko-Kolva, Ph.D., Environmental Group Leader Perkin Elmer, Foster City, Calif., as stating:

> "I think it is very important to point out that the CDC has used that test [PCR] in other outbreaks in Colorado of a hot tub where the disinfectant level was at the appropriate concentration, yet there was still an outbreak. These protozoans [with *Legionella* engulfed in them] can insist, and once they insist they can be resistant to concentrations up to 50 ppm of free chlorine . . . after exposure to 50 ppm . . . amoeba cysts were able to exit and release the *Legionella.* So disinfection alone is not going to solve the problem. We do know that the infectious dose [of *Legionella*] is considerably low because it's an intracellular infection . . .

Christine Pasko-Kolva, Ph.D., as cited in *Sanijet Frequently Asked Questions, Question No.* 12 *regarding the identification of the Legionella organism in piped whirlpool baths* (visited Jun. 23, 2003) <http://www.sanijet.cinfo/faq.htm>.

Sanijet cites E. Tredget, MD et al., "Epidemiology of Infections with *Pseudomonas aeruginosa* in Burn Patients: The Role of Hydrotherapy", Clinical Infectious Diseases 1992, as stating:

> "Outbreak of pseudomonas infection, including multiple deaths, in burn treatment unit was attributed to hydrotherapy tubs (piped whirlpool baths) despite rigorous disinfectant procedures after each use, leading to the discontinuance of hydrotherapy."
>
> "*P. Aeruginosa* is a opportunistic gram-negative pathogen that thrives in an aquatic environment and has been identified as the cause of numerous outbreaks of skin infection transmitted to unburned patients and health care workers by medical equipment used for hydrotherapy. Because the organism was recovered from hydrotherapy equipment, this form of treatment was stopped and the strain of *P. aeruginosa* associated with the epidemic was eradicated . . . This outbreak occurred despite weekly surveillance cultures of this equipment and the use of standardized protocols for its disinfections between uses."

E. Tredget, MD et al., as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>.

In addition, Sanijet cites Canadian Infection Control Guidelines for Long-Term Care Facilities, which emphasize the necessity of having complete component and system disinfection:

> "Single-use recirculating hydrotherapy equipment, such as bath tubs, century tubs, hubbard tanks and whirlpools, must be drained after each resident use. *Pseudomonades, legionellae* and other bacteria thrive in the warm, moist, dark environment of the internal plumbing of these units. Given the opportunity, they may form a semi-permanent biofilm, which can provide a never-ending reservoir of bacteria within the system. It is necessary to disinfect all components of the unit, including the basin, the internal plumbing and the lift chair with a disinfectant-detergent . . . Prior to the first use of the day, it is necessary to disinfect the entire system . . . as organisms may have survived the disinfection process of the previous day and multiplied." (emphasis added.)

Canadian Infection Control Guidelines for Long-Term Care Facilities, Rev. 1993 (pp. 8–9) as cited in *Sanijet Frequently Asked Questions, Question No.* 6 *regarding evidence that shows piped whirlpool circulation systems promote the growth of infectious microorganisms* (visited Jun. 23, 2003) <http://www.sanijet.cinfo/faq.htm>.

Therefore, a sanitation system designed for whirlpool baths is desirable. The present invention addresses these concerns and inhibits harmful bacteria growth between bathtub uses. Specifically, the present invention provides for a sanitation system, which not only inhibits bacteria growth during whirlpool bathtub activation, but also more importantly, inhibits bacteria growth between whirlpool bathtub activation cycles. The present invention teaches the inhibiting of bacteria in a whirlpool bathtub's closed looped plumbing system both during and/or between whirlpool bathtub usages.

The limiting of bacteria between whirlpool bathtub uses is highly desirable because bacteria that form Legionaries disease or other bacteria can infect a user in a matter of seconds if such bacteria are present in a whirlpool bathtub system prior to activation. Therefore, if a whirlpool bathtub were sanitized and left to sit, and a fast transmitting bacterium grew in the whirlpool bath system between uses, it would infect the user immediately upon the next activation of the whirlpool bathtub. For some time, whirlpool bath manufacturers have tried to devise a way to incorporate an economical sanitation system on a closed loop whirlpool bath. There are many inventions that claim to kill bacteria in a whirlpool bathtub's closed looped system or in bath water using devices that inject hot water, steam and ozone (ozone generators). There is no sanitation system for whirlpool bathtubs that inhibits bacteria and its growth in a whirlpool bathtub system after drain down and between usages. Other sanitation devices such as an ozone generator might sanitize the system, but the user might still be infected before the ozone generator or other sanitation devices had time to start working.

There are many important engineering aspects that have to be considered in developing a sanitation suction device specially made for a whirlpool bathtub. The system has to kill induced bacteria during whirlpool bathtub operation and it has to inhibit bacteria growth between whirlpool bathtub activation. The present invention has to conform to plumbing standards for hair entrapment and structural tests. It also has to be effective with very high water flow rate (gallons per minute, pressure), and it cannot restrict the whirlpool bathtub's jet performance. Due to the extremely high flow rates, it also has to be engineered for safe use.

It was determined that an antimicrobial chamber had to be easy to replace from inside the tub and economical, both to manufacture and for ongoing replacement of antimicrobial additives. It was also important to engineer the system to provide about the same concentration of antimicrobial additives for each bath cycle under high water flow. In other words, bath cycle 3 should emit that same amount or concentration of antimicrobial additives as bath cycle 90. Additionally, it was important to engineer a system whereby it insures that every bath load had the proper amount of antimicrobial additives to inhibit bacteria growth. In other words, the whirlpool bathtub would not run without the sanitation suction device operating. If the whirlpool bathtub were able to be run without the sanitation suction device operating for any period of time, there could be a nominal to excessive amount of bacteria built up in the whirlpool bathtub closed looped plumbing system between usages. This bacterial build up could be in sufficient amounts that unsafe levels of antimicrobial additives are needed to sanitize the system. Too high a level of antimicrobial additives can pose yet another heath risk to the bather, such that the bather may not sanitize the system. The antimicrobial chamber houses a variety of antimicrobial additives, however, the disclosed embodiment of the present invention utilizes either a solid slow dissolving bromine stick, bromine tablet, granular bromine, slow dissolving chlorine stick, chlorine tablet or granular chlorine.

A few years ago, whirlpool bathtubs typically utilized pumps that pumped over 40 gallons per minute (gpm) of water. Whirlpool bathtubs today typically utilize pumps that pump about 70 to 200 gpm. This creates a tremendous amount of suction force through a sanitation suction device. In the disclosed embodiment of the present invention, the antimicrobial chamber was engineered to be small so as not to restrict or decrease water flow or jet performance. However, it needed to be large enough to supply sufficient antimicrobial additives to last over a period of cycles, e.g. 30–60–90, and it had to be designed to not only limit bacteria growth in the bath water in the tub during use, but also to inhibit bacteria growth in the closed looped plumbing system between usages. The antimicrobial chamber of the present invention fits into the inlet orifice. Therefore, the inlet orifice is sized to compensate for the restriction caused by the antimicrobial chamber and the antimicrobial chamber's attachment member. This reduces restriction to the inlet orifice and allows for higher pressure out of the whirlpool bathtub jets. An alternative embodiment has the antimicrobial chamber positioned away from the inlet orifice so there is no need to increase the diameter of the inlet orifice. This alternate embodiment also does not restrict pressure flow out of the jets.

The disclosed embodiment utilizes a direct flow antimicrobial chamber. High pressure water flow (about 70 gpm or higher) surrounds and passes by the antimicrobial chamber and directly impacts the antimicrobial additives in the chamber. As the water flow erodes the antimicrobial additive in the chamber, a spring or another mechanism located behind the antimicrobial chamber pushes the antimicrobial additive material forward, keeping the same amount of antimicrobial additives exposed to the water. The antimicrobial chamber of the current invention has openings that water passes through to contact the antimicrobial additive in the chamber. The opening size can be adjusted through the use of tape over the slit openings, or by other means to cover or close them. This cover makes each opening smaller for smaller capacity whirlpool bathtubs or those fitted with smaller horsepower pumps (lower gallons per minute water flow results in less water flow over the antimicrobial chamber and less release of antimicrobial additives). The adjustable openings therefore, can be adjusted to deliver a predetermined and metered dose of antimicrobial additives for any combination of whirlpool bathtub capacity or pump size/flow rates by merely adjusting the openings. As water contacts the antimicrobial additives, some of the additives leave the antimicrobial chamber and are directly injected into the suction line of the whirlpool bathtub and the whirlpool bathtub pump. Using bromine as the antimicrobial additive, it is preferable that the antimicrobial chamber is calibrated to deliver enough bromine to produce about ½ to 6 parts per million (ppm) of bromine into the bath water during a single bath cycle. This concentration range of antimicrobial additives leaves a residual of antimicrobial additives in the whirlpool bathtub closed loop plumbing system after whirlpool bath drain down. This range of antimicrobial additives also inhibits bacteria growth in the whirlpool bathtub system between usages. Furthermore, this concentration range of antimicrobial additives provides a non-offensive odor desirable to the bather. It is preferable that the chemical chamber is calibrated not to deliver a chemical dosage that produces over 6 ppm of bromine, chlorine or another suitable chemical in the bath water during a given bath cycle under one hour in duration.

The combination of the high flow rate, the antimicrobial chamber, the amount of antimicrobial additives released under high water flow, the residual concentration of antimicrobial additives left in the plumbing system, and the direct injection of antimicrobial additives into the suction line and the pump, is key to the current invention's ability to inhibit bacteria, not only during bathtub operation, but additionally between whirlpool use after drain down.

It is found that the pump is the largest collection area and breeding ground for bacteria. Specifically, standing water in a closed system is a primary breeding ground for bacteria. Therefore, the combination of injecting antimicrobial additives under high water flow rates to the pump and then subsequently into the rest of the closed looped plumbing system and the preferred concentration of antimicrobial additives inhibits bacteria during and/or between whirlpool bath uses. Also, this combination of high water flow and direct injection at the whirlpool bathtub suction line allows sufficient amounts of antimicrobial additives to stay in the closed looped plumbing (as residual) after the whirlpool bathtub is drained. The residual antimicrobial additives remain essentially until the water in the closed looped plumbing system evaporates. Because of where the antimicrobial additives are injected under high water flow, the present invention allows for sufficient amounts of antimicrobial additives to also stay in the closed loop plumbing of the whirlpool bathtub between usage, until water evaporation occurs, and possibly even thereafter.

Another important consideration in developing a sanitation suction device for whirlpool bathtubs is ensuring the ease of replacing the antimicrobial chamber or the chemicals in the antimicrobial chamber. The sanitation suction device is designed so the replaceable antimicrobial chamber may be replaced from inside the bath. However, placing the antimicrobial chamber in the suction fitting presents a different range of concerns. For example, placing an antimicrobial chamber in the suction fitting may cause pressure drop at the whirlpool bathtub jet output The present invention as designed, provides for a combination replaceable antimicrobial chamber, faceplate screen filter, housing and elbow that restricts water pressure on the output side of the jets less than 30%. To help reduce restriction to the output of the jets, the inlet orifice diameter is increased to compensate for the restriction caused by the antimicrobial chamber and the antimicrobial chamber's attachment member. The inlet orifice diameter is preferably at least 1 inch in diameter. An alternative embodiment has the antimicrobial chamber positioned away from the inlet orifice so there is no restriction to the inlet orifice. Additionally, the outlet orifice is at least 1½ inch in diameter.

Another problem that exists in creating a sanitation suction device specifically for a whirlpool bathtub is compliance with the plumbing standards. Whirlpool baths must meet stringent drain down standard requirements set up by the American Society of Mechanical Engineers (ASME). The standard code that governs whirlpool baths is entitled "Whirlpool Bath Appliances" (ASME A 112.19.7M 1995). Section 5 of this standard, incorporated herein by reference, covers water retention and provides: "whirlpool bath appliances shall be of such design as to prevent retention of water in excess of 44 ml. (1½ fl oz) for each jet and suction filter." Therefore, a sanitation suction device for a whirlpool bathtub must allow for the whirlpool bath to meet the drain down requirements set forth by the plumbing standards.

The average whirlpool bath has a six-jet system and has one suction fitting. In order to meet code, a six-jet/one suction system configuration may only retain 10½ ounces of water in the complete whirlpool bath system after draining. Most quality whirlpool baths, however, retain less than 4 ounces of water in the whirlpool bath system after draining. Therefore, the sanitation suction device part of the system cannot retain over 6½ ounces of water, because the total water retention would then exceed 10½ ounces. The housing of the current invention has been made with a draft slant to evacuate water into the tub from the sanitation suction device after whirlpool bathtub drain down. In other words, the sanitation suction device is designed to retain minimal water. The antimicrobial chamber to be placed therein has been designed to retain only a trace amount of water. Therefore, the present invention sanitation suction device, along with the antimicrobial chamber, retains less than 10½ ounces of water after the whirlpool bathtub is drained, and can retain as little as about ½ ounce of water. A whirlpool bath having more than six jets, e.g. a 15-jet system, is allowed is retain more water. However, systems having more jets must still meet an appropriate plumbing standard. In a 15-jet/one suction system configuration, the complete system cannot retain over 24 ounces of water.

In addition to meeting drain down requirements, the sanitation suction device must also pass the standards for load and structural tests. The ASME load and structural standard for suctions is titled Suction Fittings For Use in Swimming Pools, Spas; Hot Tubs, and Whirlpool Bathtub Appliances (ASME/IAMPO reaffirm 1996), incorporated herein by reference. As the title implies, suction fittings must comply with ASME safety standards. Spa and pool skimmers, however, are made for a different application. Spa and pool skimmers are not suction fittings and thus, do not need to meet ASME standards for suction fittings. Because they are designed for low water flow rates, usually under 15 gpm, spa and pool skimmers and such, would need extensive modification and would need to incorporate full drain down housings and a load and impact resistant faceplate screen filter faceplate that resists hair entrapment. Spas and pools usually have water in them for extended periods of time, usually 30–90 days before water replacement, further differentiating them from whirlpool bathtubs, which should be drained down after each use.

It is well known that spas and pools are chemically treated with antimicrobial additives such as chlorine and bromine. It is also widely known that there have been numerous outbreaks of Legionnaires disease from chemically treated spas even though the recommended amount of antimicrobial additives had been utilized in them. Further, it has been reported that swimmers and/or bathers have still contracted diseases from bacteria in otherwise properly chemically treated spas and pools.

However, skimmers may be thought of as relevant prior art for obviousness. This thought is perpetuated by the use of "suction fitting" language with respect to low flow spa and pool skimmers. For example, the U-3 skimmer manual 39501-0028 (revised 5/31/02), published by Sta-Rite Industries, Inc., Pool/Spa Group, 293 Wright Street, Delavan, Wis. 53115, shows a typical skimmer for a pool or spa. Page 2 of the Sta-Rite manual under the heading "Operations" and the subheading "Hazardous Suction", states:

> "NOTICE: The equalizer is an emergency bypass intended to prevent damage to the pump when pool water level is low or skimmer basket is blocked. Do not allow flow through equalizer for extended periods of time."

An equalizer is a below-the-waterline suction fitting, and this is where the high volume of water flows through, not through the skimmer. All spas must have at least one suction fitting located under the waterline for safe operation. The skimmer, like all skimmers therefore, must have an equalizer for emergency bypass reasons. The present invention is not a skimmer, nor does it require an equalizer for emergency bypass reasons.

The present invention inhibits harmful bacteria growth in a whirlpool bathtub having high water flow even between usages, unlike that of a spa or pool skimmer that slowly filters water containing bacteria over an extended period of time. Therefore, it should not be considered obvious from one skilled in the art, to take a spa skimmer or pool skimmer that may have an antimicrobial dispenser incorporated within and use it under the whirlpool bathtub waterline as a sanitation suction device that must conform to load and structural tests set forth by ASME. In addition, it should not be considered obvious to just take any antimicrobial dispenser used in a spa or pool skimmer and incorporate it into a high flow suction fitting, because people are reportedly sickened by bacteria while using spas and pools even though such antimicrobial dispensing inventions are installed just outside the suction fitting. See the above citations, which reference Legionella organisms in piped whirlpool baths. Reemphasizing what Dr. Christine Pasko-Kolva, Ph.D. was cited to say:

> "I think it is very important to point out that the CDC has used that test [PCR] in other outbreaks in Colorado of a hot tub where the disinfectant level was at the appropriate concentration, yet there was still an outbreak . . . ."

Hauser Laboratories, 4750 Nautilus Court South, Boulder, Colo. 80301, conducted bacteria tests on behalf of Mattson Industries to evaluate the present invention operating in a whirlpool bath to determine whether the present invention decreases bacterial growth. Two identical whirlpool baths (one containing an early prototype of the present invention having a filter media wrapped around the antimicrobial chamber) were set up in a secure area and filled with tap water and circulated. Typical whirlpool "contaminants" such as baby oil, hair, and shampoo were added to the two baths and circulated. Both baths were drained after samples were taken from each. After a period of days, the baths were filled again and circulated. Samples were taken from each and the baths were drained. Hauser Laboratories documented the test procedure and results in an Oct. 11, 2001 report to Mattson Industries, which is internally referenced as Project No. 43081-1 and incorporated by reference herein. The Hauser test results indicated that no bacteria grew in the test whirlpool bath having the current invention. The test whirlpool bathtub without the current invention contained thousands of bacteria colonies.

There is no known art that teaches or fairly suggests that an antimicrobial dispensing device for spas or pools or whirlpool bathtubs can be engineered to operate with extremely high water flow rates exceeding about 70 and up to 200 gpm except for the present invention. There is no known art for an antimicrobial chamber/dispenser for pool, spa or whirlpool bathtub use that has test results showing the limiting of bacteria during and between whirlpool bath use, except for the present invention.

The present invention kills bacteria in a whirlpool bath during whirlpool bathtub operation and between whirlpool bath operations.

The combination of the high flow rate, the antimicrobial chamber, the amount of antimicrobial additives released, the residual concentration of antimicrobial additives left in the plumbing system, and the direct injection of antimicrobial additives into the suction line and the pump, is key to the current invention's ability to inhibit bacteria, not only during bathtub operation, but additionally between whirlpool use after drain down.

ASME standards also require that standard suction fittings must be designed so that a tool is needed to remove the suction fitting faceplate. Most suction fitting faceplates are held in place by a screw, and a screwdriver is needed to remove the screw. Safety dictates that a tool be used; so a bather would be less likely to remove the faceplate and try running a whirlpool bathtub without the faceplate attached. However, it is desirable for the current invention's faceplate screen filter to be removed periodically to facilitate replacement of the antimicrobial chamber and/or antimicrobial additives. Thus, the current invention has an easily removed half turn screw and a slot in the screw head whereby a standard coin fits into the slot for easy screw removal. This satisfies the ASME standard for a tool to remove the faceplate. While this technically satisfies the current ASME standard it does not fulfill the spirit of the standard to prevent body entrapment and broken bones. Other inherent safety features of the present invention help to achieve this aim. Because of the pressure associated with high water flows of about 70 to about 200 gpm, the water force passing through a standard suction fitting, or the present invention, creates a tremendous and dangerous suction force. This suction force may be large enough to break a finger and/or entrap a body part such as a person's thigh in the exposed housing if the faceplate were missing while the whirlpool bathtub were run.

The current invention provides many safety features to prevent body entrapment and broken bones. The current invention has a safety cavitation port located on the wall of the housing. If the current invention is run without the faceplate attached and a bather were to put any body part near the exposed sanitation device's housing opening, ambient air is drawn into the current invention's housing and directly into the pump of the whirlpool bathtub. This happens nearly instantaneously and the pump cavitates (draws more air than water), and the suction force is inhibited before the bather is harmed.

The current invention also provides a safety flapper. When the replaceable antimicrobial chamber is in place, the safety flapper is in an open mode. If the replaceable antimicrobial chamber is removed, the safety flapper descends into a closed mode, and covers the inlet orifice of the sanitation suction device elbow, or the point where the antimicrobial chamber is inserted into the sanitation device elbow. The safety flapper blocks the water to the pump thereby stopping the tremendous sucking action. Therefore, with the current invention, there is no way to run the whirlpool bathtub and potentially suck hair or body parts against or into the inlet orifice of the elbow of the current invention's housing. There is no known art that teaches or fairly suggests the use of a safety flapper as a safety water suction cut off for a suction fitting or a skimmer. While the present invention provides a safety flapper to block the inlet orifice, other mechanisms could be used.

The current invention also has a safety screen located behind the safety flapper to prevent a child from getting a limb entrapped in the sanitation suction device if the whirlpool bathtub were drained and the faceplate and anti microbial chamber missing. There is no way a bather could get his/her hair entrapped in this safety screen if the whirlpool bathtub were in operation because the safety flapper covers this safety screen if the antimicrobial chamber is absent. As stated above, the safety flapper descends into a closed mode, and covers the inlet orifice of the sanitation suction device elbow if the replaceable antimicrobial chamber is removed.

Another safety concern in whirlpool bathtub and spa use is encountered when a user's hair is twisted and entrapped in the whirlpool bath faceplate. Hair entrapment occurs when a bather's hair becomes entangled in a suction fitting faceplate cover as the water and hair are drawn powerfully through the faceplate. The Consumer Product Safety Commission has issued a safety alert article entitled "Children Drown and More Are Injured From Hair Entrapment In Drain Covers For Spas, Hot Tubs, And Whirlpool Bathtubs" (CPSC Document #5067). The safety alert urges consumers to ask their spa, hot tub, and whirlpool bathtub dealers for drain covers that meet voluntary standard ASME/ANSI A112.19.8M 1987 to help reduce hair entrapment. The present invention meets the voluntary ASME/ANSI standard.

The present invention also provides a faceplate screen filter cover, which is easily removable. The faceplate also has to pass the heavy load, impact and hair entrapment tests set out by ASME/IAMPO. The present invention faceplate deflects less than about ¾ inch when more than about 50 pounds is exerted to a center of the removable faceplate. The disclosed embodiment faceplate has structural fins on its backside. Most current suction fittings have these supports to pass the ASME structural tests as an integral part of the suction's housing. These integral supports located in the housing could prevent adding a removable antimicrobial chamber to these devices. The current invention faceplate has a sufficient number of sized holes to pass the prescribed hair entrapment tests and prevent large debris from entering the whirlpool bathtub's closed loop plumbing system.

The disclosed faceplate is larger than standard faceplates because of the size of the removable antimicrobial chamber. Prior to Mattson, the combination of an antimicrobial dispenser and a suction in a single device was not known in the art. The faceplate has slots to allow a larger volume of water to pass through it. Because of the increased size of the faceplate the slots have been designed and engineered in a radiating pattern. This is very important for the plastic injection molding process that creates the faceplate.

The present faceplate screen design has advantages over a horizontal or vertical design (see U.S. Pat. No. 5,799,339 to Perry). The pressure of the injected plastic from the injection point of the mold (usually the injection point of a mold is located in the center of the mold) bits the small end of the slots instead of the wide end of the slots. The shorter end of the slot can withstand a great deal more pressure over time before failure occurs than if the pressure had been subjected to the wide side of the slots. This allows for much longer mold life and a more pleasing finished product. The radiating pattern of slots gives a straight-line flow to the outer edge of the faceplate screen. FIG. 4 of the Perry '339 patent shows a standard slot opening arrangement that represents the arrangement of slots used by current manufacturers of slotted face faceplates. FIG. 2 of U.S. Pat. No. 6,038,712 to Chalberg et al. shows circular hole openings which represent how other faceplates are made. Slots are preferable over circular holes to increase flow.

The slotted holes on the top, sides and bottom of the faceplate extend outward keeping in line with the radiating design pattern on the face of the faceplate. This makes it an easier part to inject with plastic.

Another safety feature involves the design of the faceplate screen. The center faceplate is an area that typically has a high fluid intake flow. Therefore, the center of the faceplate-is designed to be solid and measures over ¼" in diameter. This solid center section evens out the water flow across the rest of the faceplate so that there are no areas of high flow that would create unwanted areas of high suction force. Support bars (or ribs) are integrally formed on the backside of the faceplate. The support bars are at right angles to each other and extend between opposite sidewalls of the faceplate screen filter. The support bars do not obstruct any of the faceplate screen filter slots formed in the face and sidewalls of faceplate. This configuration advantageously prevents hair from entering a faceplate slot and becoming entangled by wrapping around both sides of a support bar.

In the safety alert CPSC Document #5067, the Consumer Product Safety Commission suggests that consumers shut down the spa until the drain cover is replaced in the event that the consumer discovers the drain cover missing or broken. The present invention allows the water system to shut itself down if the faceplate drain cover is missing or broken by means of a nonelectric cavitation mechanism. The water system is also shut down if a clog occurs.

While the disclosed embodiment has a safe non-electrical cavitation port to prevent a person from becoming entrapped in the exposed housing if the faceplate were missing, an electrical vacuum, contact system, or magnetically actuated system could also be incorporated on the present invention to accomplish the same thing.

It is important that a bather cannot operate the current invention when the antimicrobial additives in the antimicrobial chamber are exhausted. Therefore, the present invention also has an electrical contact at the point the antimicrobial chamber meets the outlet orifice of the housing. There are contacts on the antimicrobial chamber and in the housing in which the antimicrobial chamber is inserted. Wires are run to an electrical timer control box that usually sits atop the pump and motor. The timer is usually set to turn off the whirlpool bathtub after about 10–30 minute run cycle. The current invention has a microprocessor located in the whirlpool bathtub timer box. The microprocessor counts bath cycles and when it reaches 90 cycle counts, for example, or any cycle count set by the manufacturer, the microprocessor will send a signal that will not allow the whirlpool bathtub to operate until the connections or contacts between the anti microbial chamber and the housing are broken. It is planned that a user will break the contact when replacing a spent antimicrobial chamber with a new or refreshed antimicrobial chamber. After the contact is broken, the microprocessor will reset itself for another cycle counting run. There are others ways to count bath cycles; they would still fall within the scope of the present invention, as there is no known art that teaches bath cycle counting in combination with a sanitation suction device. For example, the present invention could also have an electrical contact located on faceplate that meets a contact on the housing flange to serve the same purpose for a combination faceplate and antimicrobial chamber.

U.S. patent application Ser. No. 09/417,156 SORENSEN, EDWIN C., incorporated herein by reference shows a breakaway drain cover for a spa. The present invention could also incorporate a Sorensen type invention to stop water draw suction if the faceplate were removed. Sorensen operates a magnetically actuated switch transmitting an electrical signal. It does not have a safe non-electrical safety cavitation port like the present invention. People are concerned when any electrical signal is transmitted in a water vessel.

SUMMARY OF THE INVENTION

The main aspect of the present invention is to provide a suction fixture and antimicrobial dispensing combination apparatus in a whirlpool bath that inhibits bacteria during whirlpool bathtub use and inhibits bacteria formation in the whirlpool bathtub closed loop plumbing between uses.

Another aspect of the present invention is to allow water in a whirlpool bathtub to pass a chemical chamber at a high velocity/flow rate and impact a chemical housed in the chemical chamber, thereby releasing water having a predetermined concentration of chemicals into the whirlpool's closed loop plumbing system to kill microorganisms in the whirlpool bathtub.

Another aspect of the present invention is to provide a safety faceplate screen filter for the suction intake, which resists hair entrapment, and deflection of less than ¾" when a force of 50 pounds is exerted to the center of the faceplate, whereby the hole openings in the faceplate are over 1,000 microns.

Another aspect of the present invention is to provide a removable and cleanable, or replaceable, filter screen that is located behind the faceplate, whereby the housing filter screen holes are under 1,000 microns in size.

Another aspect of the present invention is to provide a safety flapper or other means to that shuts down suction force in the sanitation suction device if the antimicrobial chamber is absent, or improperly inserted and prevents body entrapment, hair entrapment, and broken bones.

Another aspect of the present invention is to provide a non-electric safety/sanitation cavitation port to cause cavitation, which shuts down or fractionally limits the suction force in the sanitation suction device if the faceplate screen filter is removed and a user partially blocks the sanitation suction device's housing inlet.

Another aspect of the present invention is to provide for a combination suction and removable antimicrobial dispenser chamber, sanitation suction device, that releases approximately equal metered doses of antimicrobial additives over a range of bath cycles and where the antimicrobial dispenser is in axial alignment with the housing.

Another aspect of the present invention is to provide for a combination suction and non-removable antimicrobial dispenser chamber, sanitation suction device, that releases equal metered doses of antimicrobial additives over a range of bath cycles and where the antimicrobial dispenser is in axial alignment with the housing.

Another aspect of the present invention is to provide a removable or non-removable antimicrobial chamber that releases antimicrobial additives into the whirlpool bathtub to kill bacteria during whirlpool bathtub operation and to limit bacteria growth in the whirlpool bath close loop plumbing system for at least five bath loads before the antimicrobial additives housed in the antimicrobial chamber(s) need to be replaced.

Another aspect of the present invention is to provide for a combination suction and removable antimicrobial dispenser, sanitation suction device that allows over about 70 gallons per minute flow rates through the sanitation suction device and resists hair entrapment.

Another aspect of the present invention is to provide for a combination suction and non-removable antimicrobial dispenser, sanitation suction device that allows over about 70 gallons per minute flow rates through the sanitation suction device and resists hair entrapment.

Another aspect of the present invention is to provide an electrical magnetically actuated switch transmitting an electrical signal mechanism to prevent pump operation if the faceplate is removed.

Another aspect of the present invention is to provide a non-electric safety/sanitation cavitation port to cause cavitation, which shuts down whirlpool bath suction force if the antimicrobial chamber is absent or improperly inserted.

Another aspect of the present invention is to provide a minimal water retention sanitation device that retains less than 10½ ounces of water after drain down.

Another aspect of the present invention is to provide a housing, which is readily, retrofitable and/or incorporated into a new whirlpool bath that retains less than 3 ounces of water after whirlpool bathtub drain down.

Another aspect of the present invention is to provide for a sanitation suction device that when installed on a whirlpool bathtub will not increase the vacuum to the suction line leading to the pump of the whirlpool bathtub by more than 25 inches of Hg or reduce the jet performance pressure by more than 30%.

Another aspect of the present invention is to provide a means to prevent whirlpool bath operation when the antimicrobial additives in the antimicrobial chamber have been exhausted using an electronic counter and only restart when the used antimicrobial chamber has been removed and replaced.

Another aspect of the present invention is to provide tub mount indicator lights that notifies the bather when it is time to replace the antimicrobial chamber.

Another aspect of the present invention is to provide an antimicrobial dispenser that is calibrated to deliver about ½ part per million to about 6 parts per million of bromine into the bath water in under a 60-minute timed bath cycle or in a manufacturer-set bath cycle.

Another aspect of the present invention is to provide for a combination suction and non-removable antimicrobial dispenser whereby only the anti- microbial additives need to be replenished and not the entire antimicrobial chamber needs replacing.

Another aspect of the present invention is to provide an alternate embodiment faceplate for a combination suction and antimicrobial device whereby the antimicrobial additives can be replaced from within a tub without removing the faceplate.

Another aspect of the current invention is to provide an alternate embodiment that has a filter media wrapped around the antimicrobial chamber.

Other aspects of this invention will appear from the following description and appended claims, reference being made to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF DRAWINGS

Figure 1:
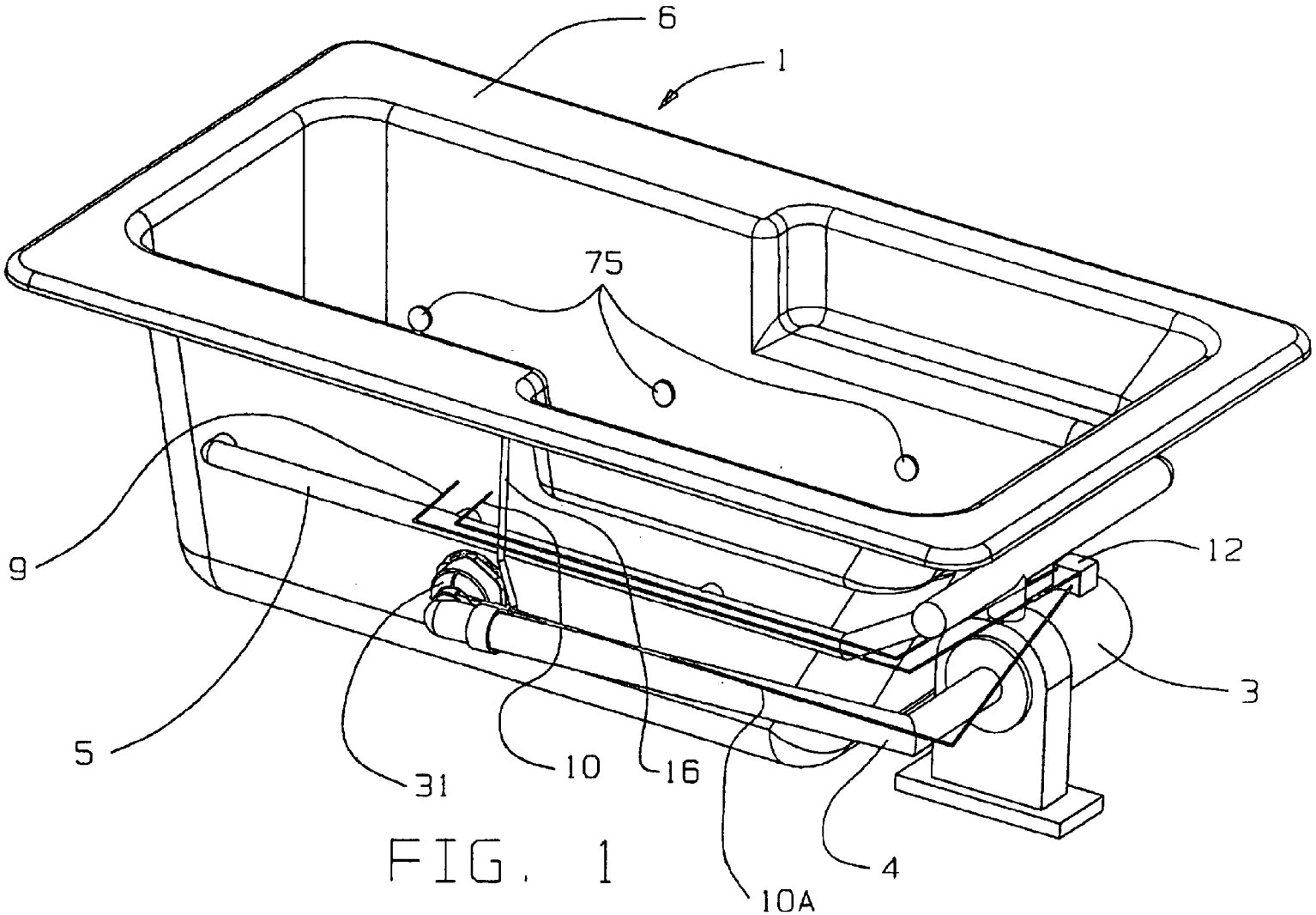
FIG. 1 is a top perspective view of a whirlpool bathtub with sanitation device installed.
Figure 16:
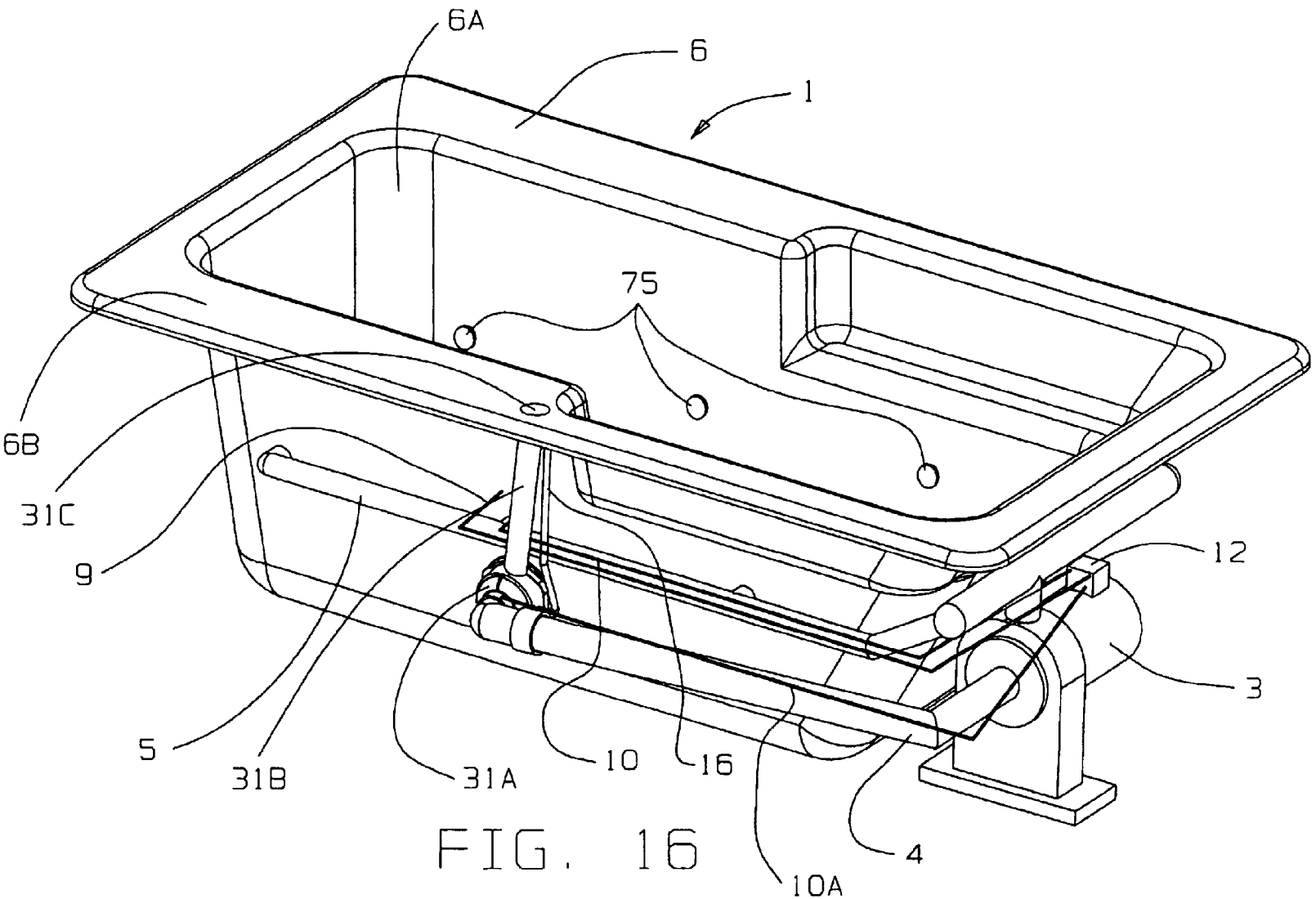
FIG. 16 is a top perspective view of an alternate embodiment sanitation suction device with a top refill antimicrobial shaft.
Figure 17:
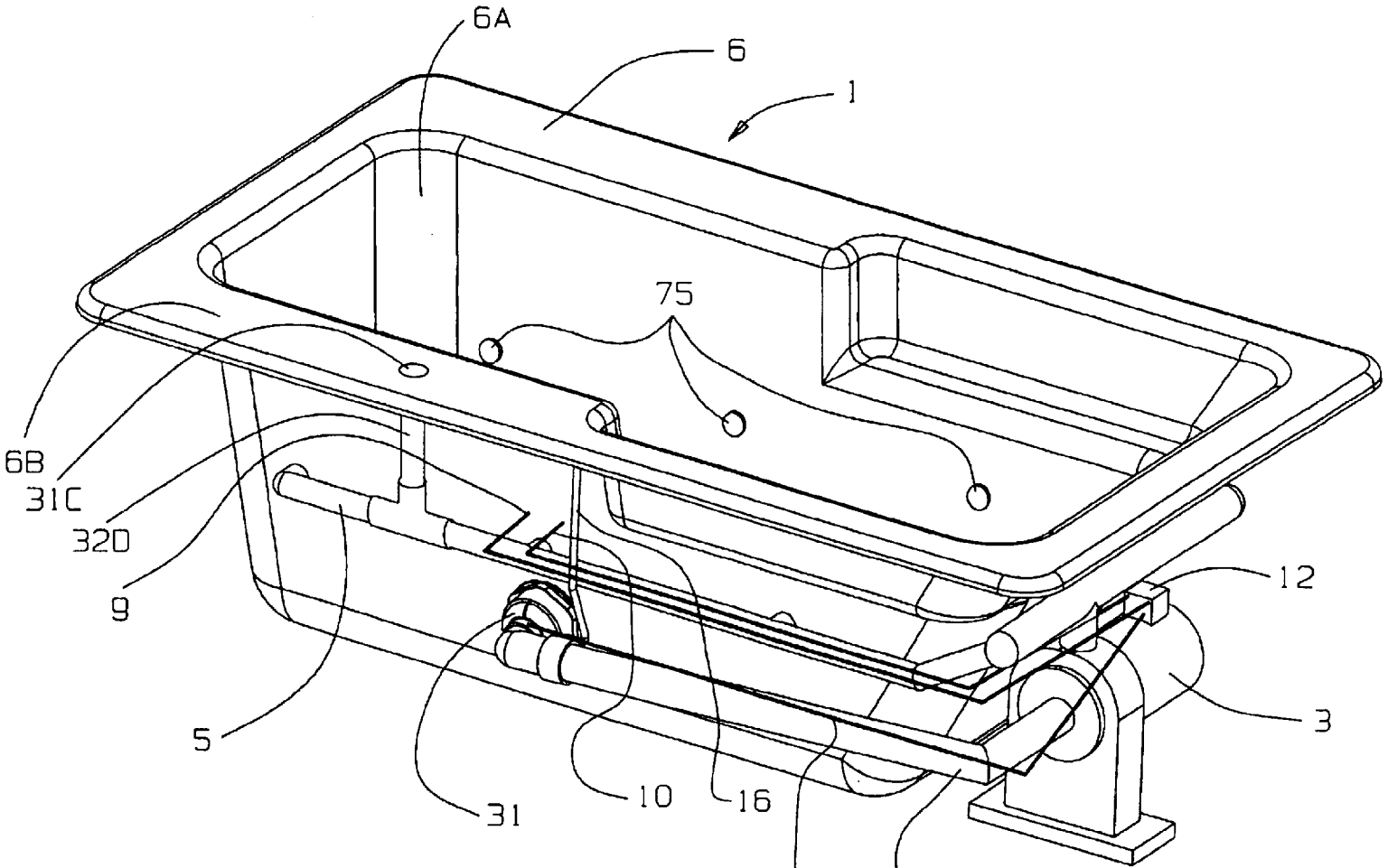
FIG. 17 is a top perspective view of an alternate embodiment antimicrobial dispensing device that can be placed anywhere inline on a whirlpool bathtub.
Figure 25:
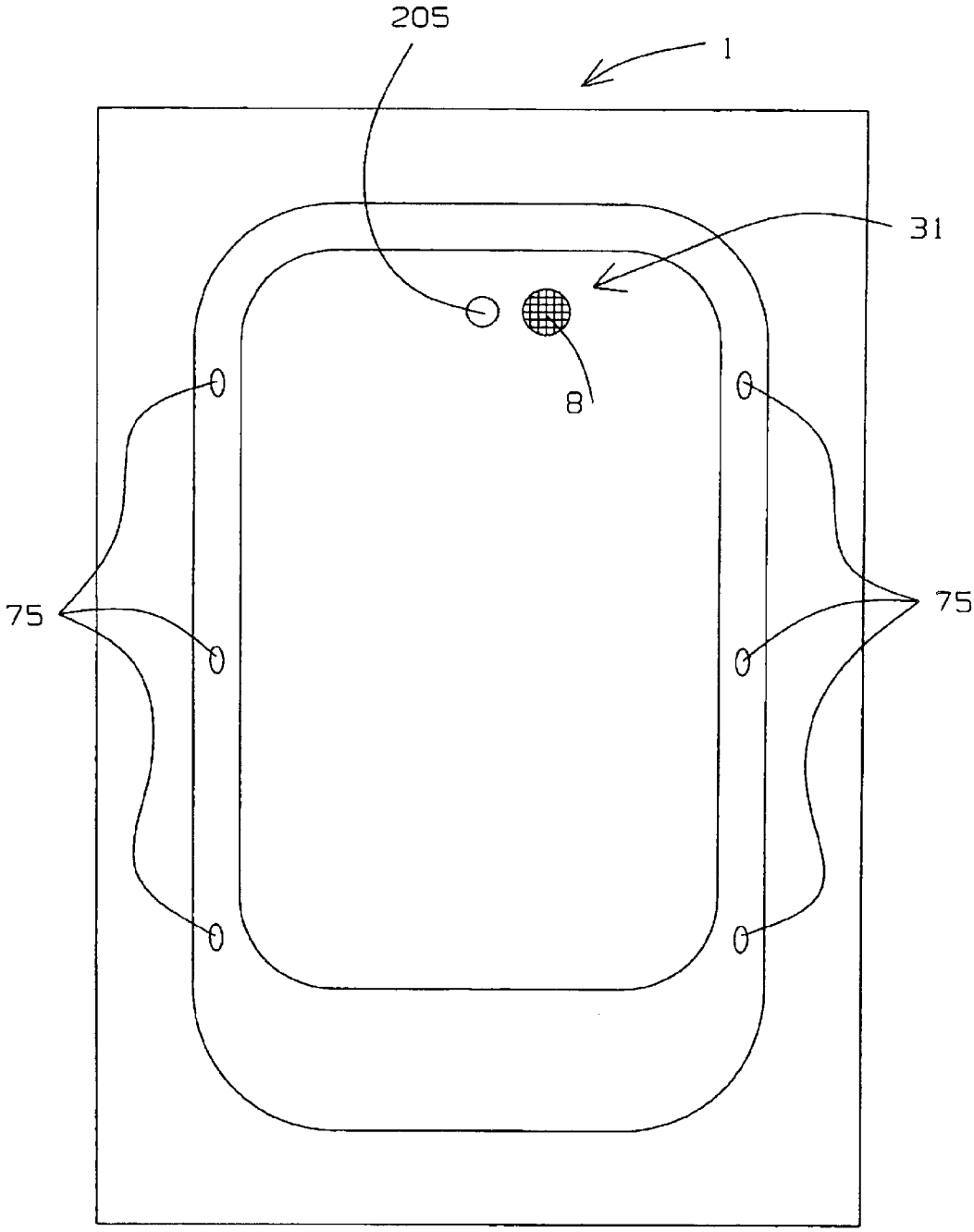
FIG. 25 is an overhead view of the tub showing the present invention installed on the bottom of a whirlpool tub.

Referring first to FIGS. 1, 16, and 17 a whirlpool bath water vessel 1 has a tub 6 with a standard tub wall 6A and a standard tub drain 205 (see FIG. 25). During whirlpool use the pump 3 circulates water via water return line 5, air mixing pipe (not shown) and jets 75. Water is drawn from the filled tub 6 via suction water line 4 which is connected to the antimicrobial assembly chamber 15 (not shown) mounted within the sanitation suction device 31. A system control box 12 activates the pump 3.

A combination safety cavitation and antimicrobial cavitation air line 16 extends from sanitation suction device 31. See FIG. 1. When line 16 detects that housing 10B is partially blocked, pump 3 cavitates Electric wire 10A connects to system control box 12. Wire 10A provides a signal from points 1070, 1071 (see FIG. 8), where antimicrobial assembly chamber 15 contacts inlet orifice 30 of housing 10B. A microprocessor counter (not shown) in system control box 12 detects that the number of bath cycles, which can be preset, has been reached thereby indicating that the antimicrobial system should be replaced and that the electrical contact between points 1070, 1071 should be broken. When the preset limit has been attained, pump 3 receives no power until the contact between points 1070, 1071 is broken, signifying that antimicrobial assembly chamber 15 or antimicrobial additive 17 has been replaced.

Electric wire 10, 9 for green and red indicator lights 51, 52 respectively, (see FIG. 12) also connect to system control box 12 to a microprocessor counter (not shown). Indicator light 52 (red) indicates that antimicrobial additives 17 (not shown) in antimicrobial assembly chamber 15 (not shown) have been exhausted. Conversely, indicator light 51 (green) indicates that antimicrobial assembly chamber 15 contains antimicrobial additives 17 (not shown). Preferably, green light 51 indicates that 90 cycles of water or less has been run past antimicrobial assembly chamber 15. Therefore, a green light assumes antimicrobial assembly chamber 15 has a sufficient amount of antimicrobial additives 17 left in assembly chamber 15 to continue to sanitize the whirlpool bathtub. When 90 cycles has been counted, or any predetermined amount of cycles which can be set by the manufacturer, red light 52 comes on to alert the bather that it is time to change antimicrobial assembly chamber 15 or replace antimicrobial additives 17 in assembly chamber 15. When red light 52 comes on, the whirlpool bathtub will not operate until the user changes antimicrobial assembly chamber 15 or replaces antimicrobial additives 17 in assembly chamber 15.

Figure 12:
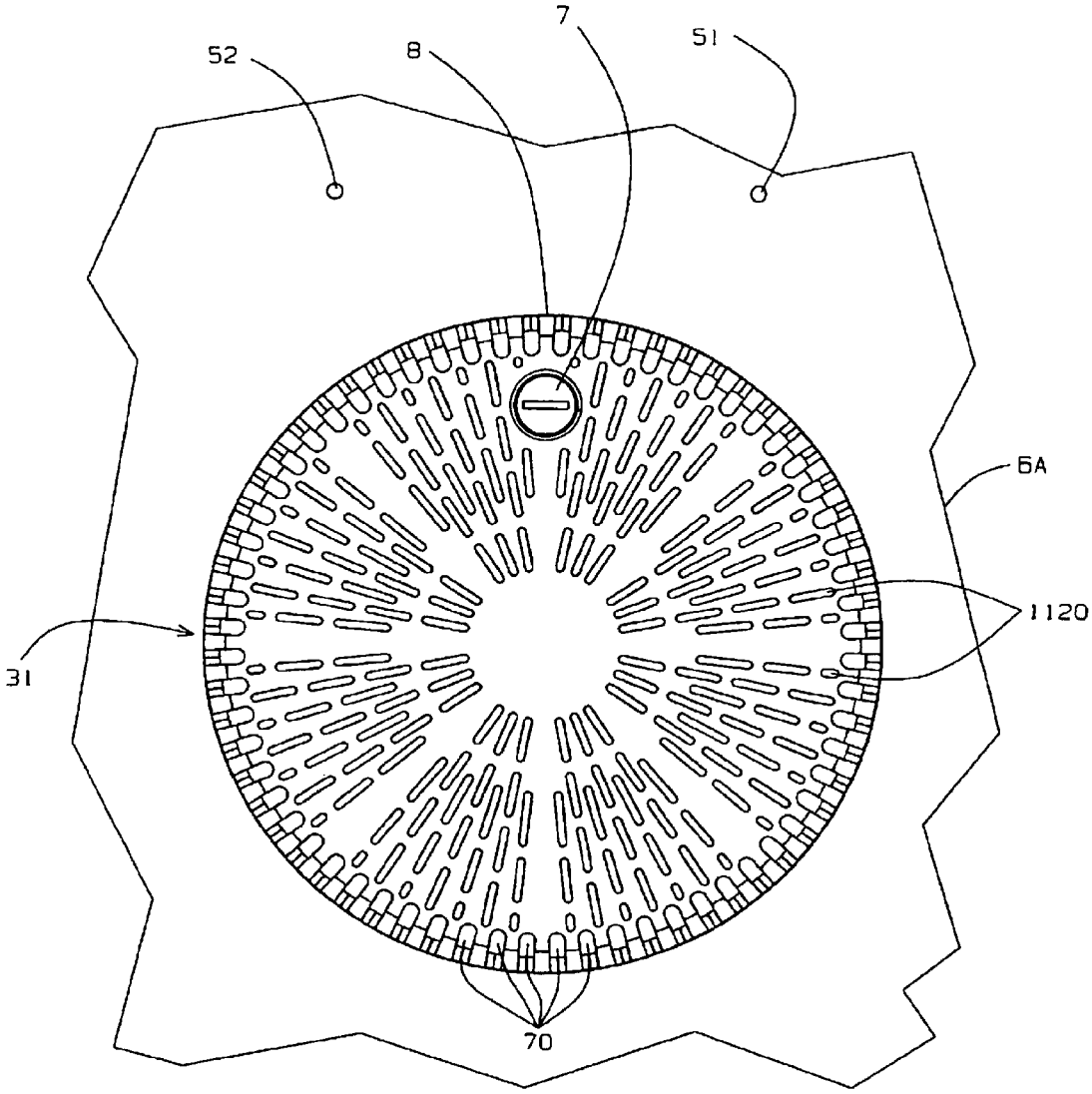
FIG. 12 is a front view of a faceplate filter screen and faceplate filter screen attachment screw installed on a side wall of a whirlpool bath with two antimicrobial replacement indicator lights.

Referring next to FIG. 12, the sanitation suction device 31 is shown as seen by a bather in the tub of FIG. 1. The only visible portion of the sanitation suction device 31 is the faceplate screen 8 attached to the inner tub wall 6A by a half-turn attachment screw 7. The half-turn screw is offered by way of example and not of limitation; any screw or attachment means could be employed. Faceplate screen 8, having hole openings of greater than 1000 microns, acts as a filter. Drain slots 70 on faceplate screen 8 allow water to drain back into the tub after shutdown.

Two indicator lights are shown placed near the inside wall 6A of the whirlpool bathtub near the faceplate screen 8. However, the lights may be placed anywhere on tub 6. Similarly, the faceplate screen attachment screw 7 may be placed anywhere on the faceplate screen to attach the faceplate screen to the inner tub wall 6A.

Figure 2:
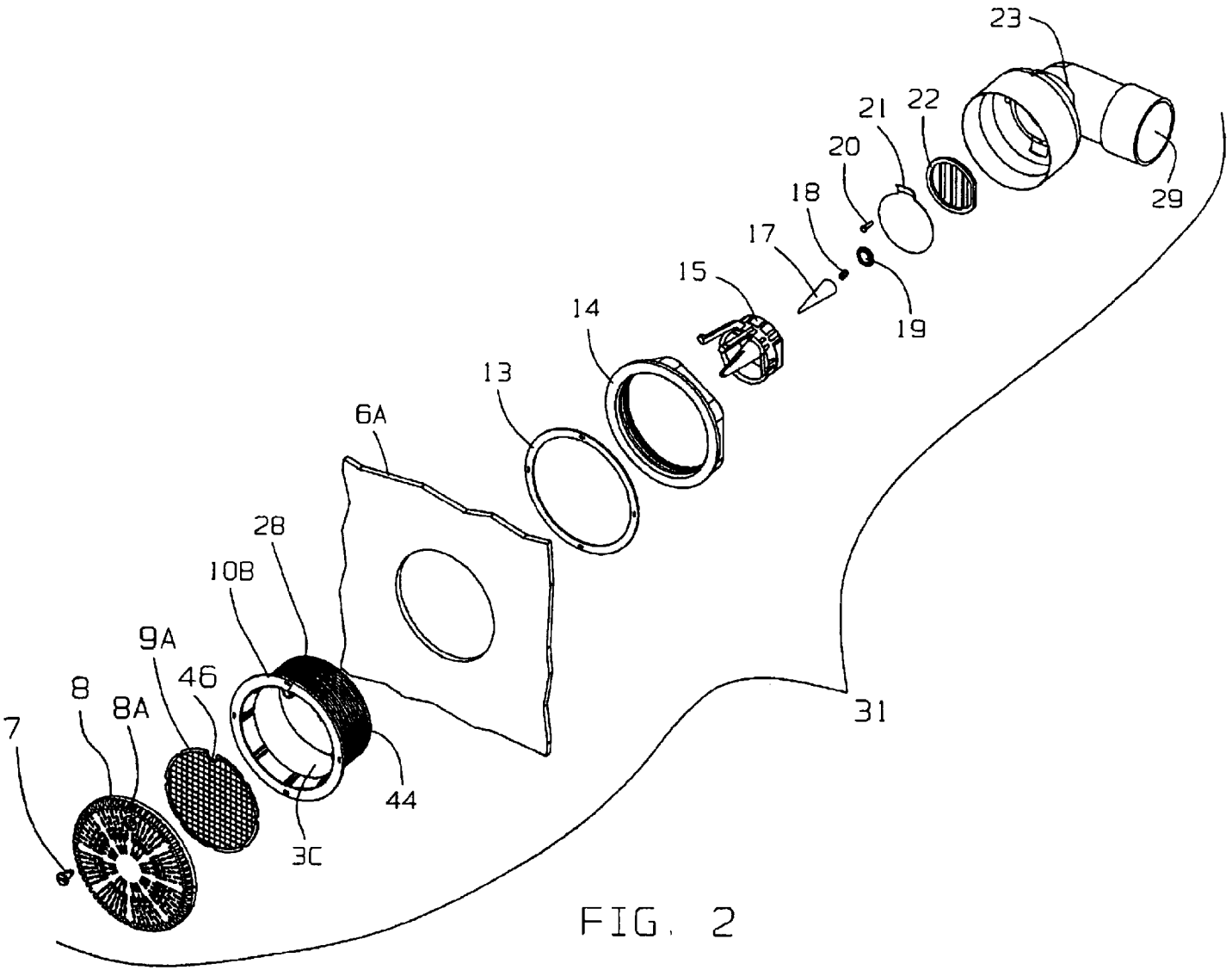
FIG. 2 is an exploded view of a sanitation suction device.
Figure 3:
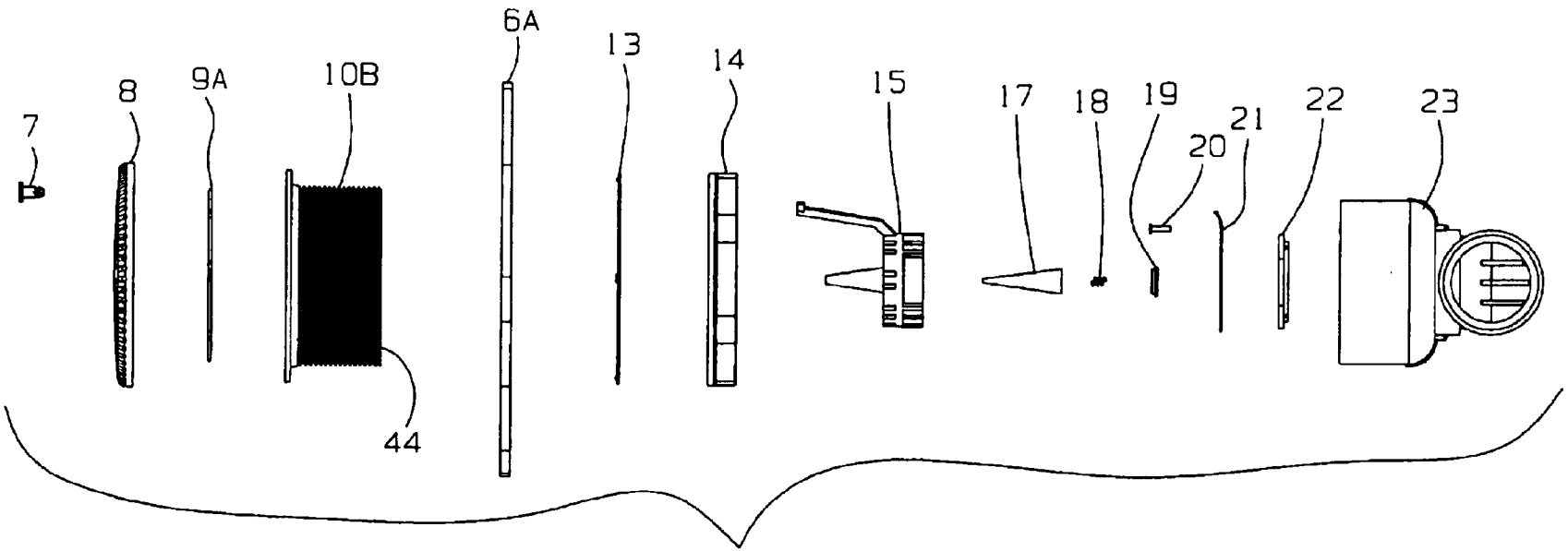
FIG. 3 is a side exploded view of a sanitation suction device.

FIGS. 2, 3 are exploded views of an embodiment of the faceplate screen and housing and the disclosed embodiment of sanitation suction device 31. The faceplate screen 8 is preferably round but could have any shape. Faceplate screen 8 also serves as a filtering mechanism by preventing large debris from entering the closed loop plumbing system of the whirlpool bathtub.

The faceplate screen housing 11B is attached to the inside surface of tub wall 6A by mounting the threaded portion 44 of faceplate screen housing 10B through optional gasket 13. Housing 10B is secured in placed by housing nut 14 on the outer surface (back side) of tub wall 6A, extending through tub wall 6A via a standard size opening cut. Housing nut 14 is secured to elbow 23 preferably by gluing elbow 23 to the inside of housing 10B. Other means of attaching elbow 23 to housing 10B are possible. Removable housing screen 9A, having hole openings of less than 1000 microns, mounts on the faceplate screen housing 10B, whereby recess 46 of housing screen 9A coordinates with housing hole 28 on faceplate screen housing 10B. Housing hole 28 receives attachment screw 7 as screw 7 passes through hole 8A of faceplate screen 8. Faceplate screen 8 is thus mounted inside tub 6. As assembled and installed, sanitation suction device 31 preferably does not protrude beyond the line delineated by the upper lip of whirlpool bath water vessel 1, thereby maximizing installment or placement options of whirlpool bath water vessel 1.

The disclosed embodiment provides for an outlet orifice 29 having a diameter ranging from about at least 1 to about 3 inches. Guideline B-810 of the New Mexico Sizing of Plastic Pipe, herein incorporated by reference, shows that there is little friction loss when using 3" pipe with high water flow rates. Less restriction provides less of a drop in pressure out whirlpool bathtub jets 75. To further aid water flow, and thus further relieve pressure restriction out jets 75, while delivering over 70 to over 200 gpm through sanitation suction device 31 and meeting ASME hair entrapment standards, an alternate embodiment may have an outlet orifice 29 of over 1⅞" in diameter and a housing inlet orifice 30 of over 1⅞" in diameter. The diameter of inlet orifice 30 is sized to compensate for the restriction in water flow caused by the insertion of antimicrobial assembly chamber 15 and its attachment members into inlet orifice 30.

Figure 13:
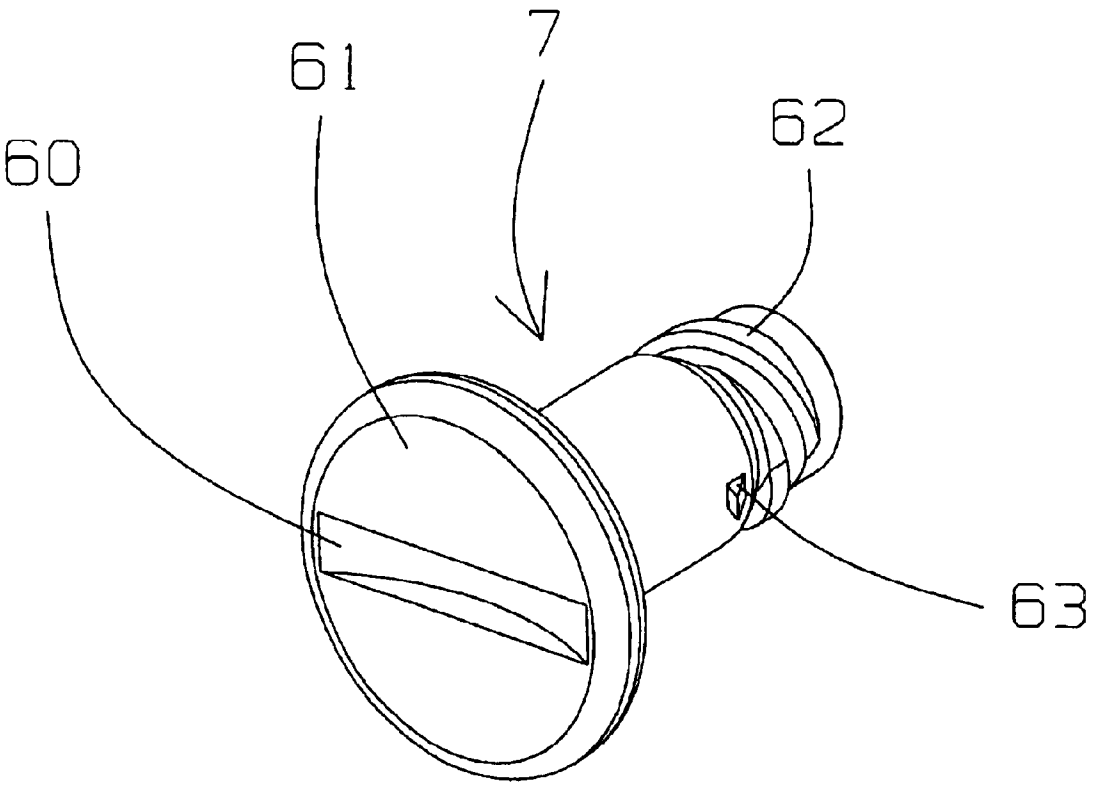
FIG. 13 is a top perspective view of a faceplate screen filter attachment screw.

FIG. 13 illustrates the faceplate screen filter attachment screw 7. Half turn screw threads 62 mate with threads of housing hole 28 on faceplate screen housing 10B. Screw barb 63 secures attachment screw 7 to faceplate screen 8. Screw head 61 is exposed to the user. Slot 60 facilitates the tightening or loosening of screw 7.

Figure 4B:
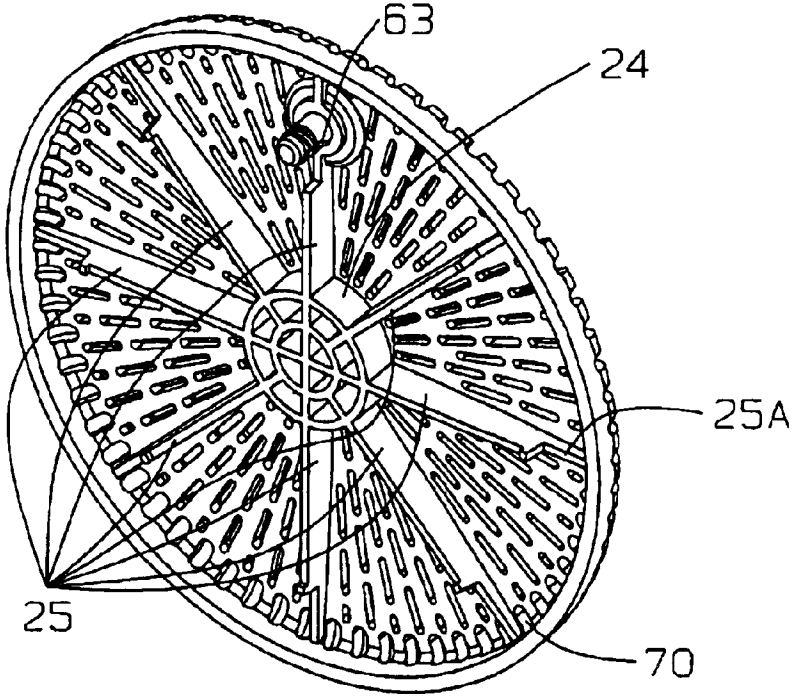
FIG. 4B is a rear perspective view of a faceplate screen filter with attachment screw.
Figure 4A:
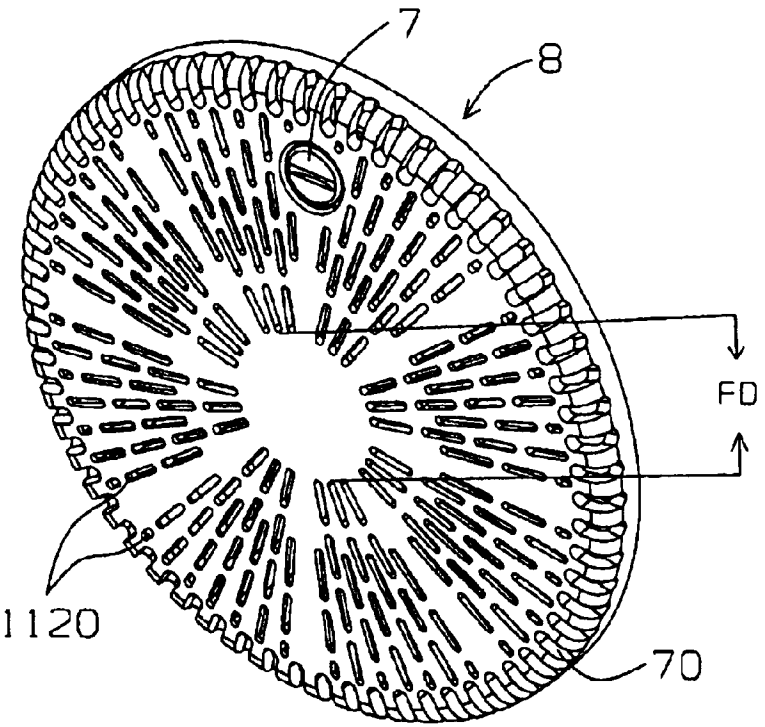
FIG. 4A is a front perspective view of a faceplate screen filter with attachment screw.
Figure 4C:
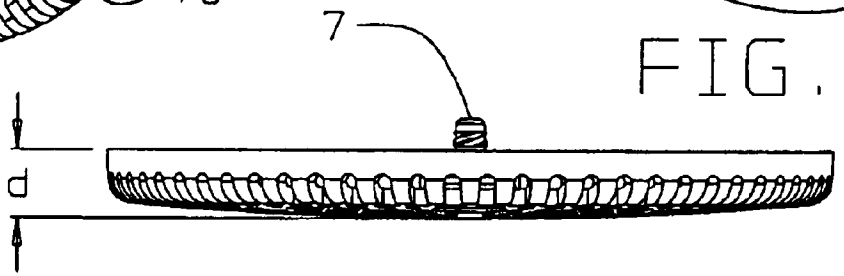
FIG. 4C is a side view of a faceplate screen filter with attachment screw.

FIGS. 4A, 4B, 4C present different views of faceplate screen 8 having half-turn attachment screw 7 inserted through hole 8A (see FIG. 2) of faceplate screen 8. Attachment screw 7 facilitates the removal of the faceplate screen 8.

The faceplate screen slots 1120 are designed and engineered in a radiating pattern to allow easier injection molding of screen 8. Faceplate screen 8 preferably has a faceplate center, FD, of greater than ¼" and a depth, d, of less than ½". Because faceplate screen 8 is designed to protrude less than ½" into tub 6 when attached to housing 10B, providing much less protrusion than most current suctions, more room is provided to the bather in the bathing area of the whirlpool bathtub. Faceplate screen slots 1120 are over 1000 microns in size.

As shown in FIG. 4B, the rear of the faceplate screen 8 has support ribs (also known as support bars) 25 to strengthen the antivortex center support 24 to prevent crushing. Faceplate support ribs 25 are designed in an X pattern, which offers outstanding structural integrity. The circular ribbing design adds tremendous strength to the center impact point, or the antivortex center support 24, of faceplate screen 8. Screw barb 63 secures attachment screw 7 to faceplate screen 8. Drain slots 70 on faceplate screen 8 allow water to drain back into the tub after shutdown.

Figure 10A:
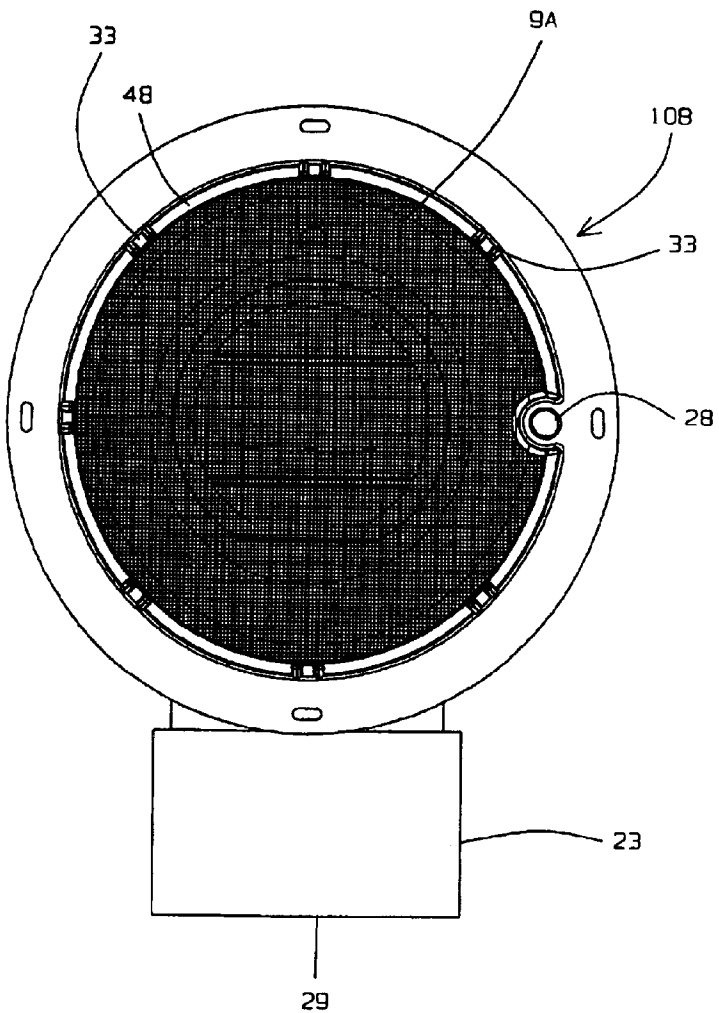
FIG. 10A is a front view of a removable housing filter screen inserted into a housing.
Figure 10:
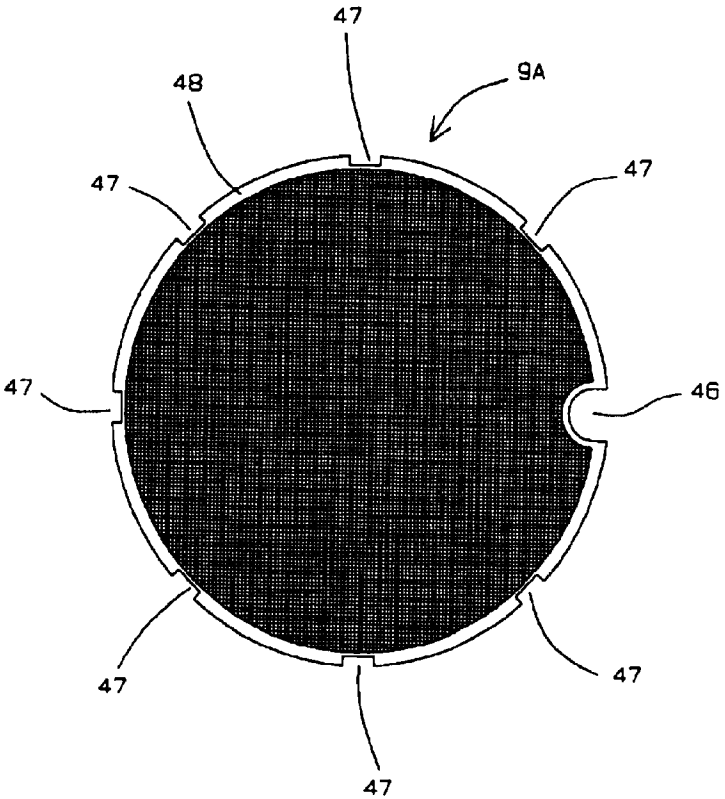
FIG. 10 is a front view of a removable housing filter screen.

Referring next to FIGS. 10, 10A, removable housing screen 9A has hole openings of less than 1000 microns. Removable housing screen 9A is mounted between faceplate screen 8 and housing 10B to screen smaller debris, i.e., hair, that may pass through the larger openings of faceplate screen 8 and to prevent such smaller debris from entering the closed loop plumbing system. Recess 46 coordinates with housing hole 28 on faceplate screen housing 10B which receives attachment screw 7 as it passes through hole 8A (see FIG. 2) of faceplate screen 8. Recess 47 on housing screen collar 48 coordinates with housing receiving slot 33 on faceplate screen housing 10B. Housing receiving slot 33 receives faceplate screen support 25A (sec FIG. 4B) on the rear of faceplate screen 8.

Figure 5A:
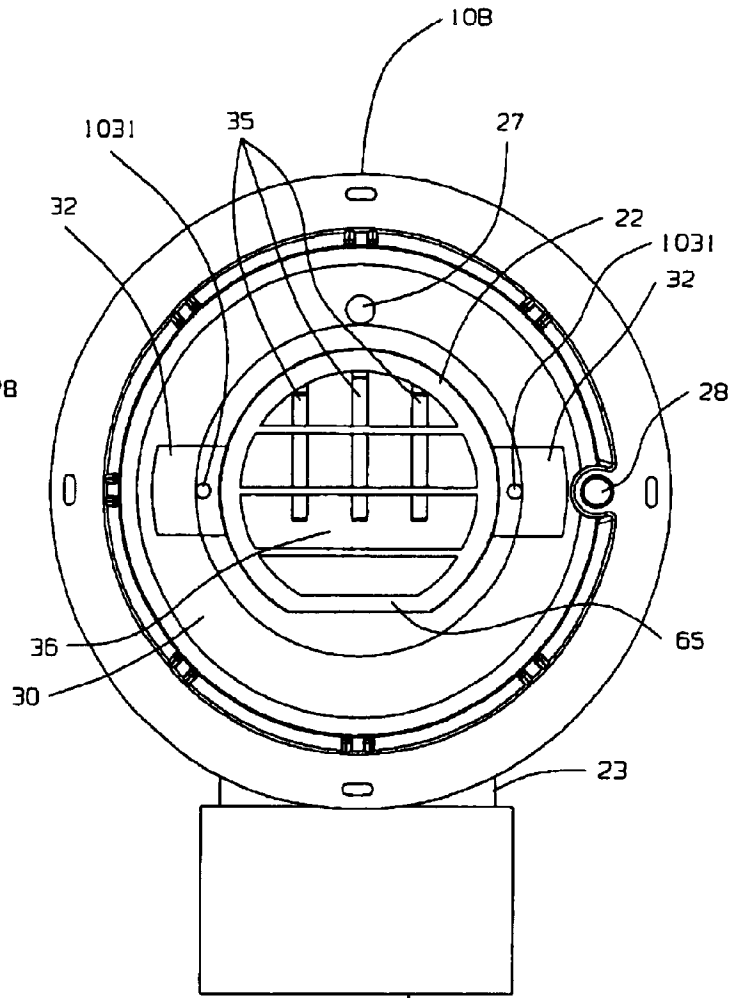
FIG. 5A is a front view of an elbow, housing and safety screen.

FIG. 5A illustrates the disclosed embodiment of the elbow 23, housing 10B, and elbow safety screen 22. Water passes through antimicrobial assembly chamber 15 (not shown) and elbow inlet orifice 36, bypasses antivortex vanes 35 and passes through elbow outlet orifice 29, whereby the filtered water circulates back into the water vessel system. See also FIG. 6. Elbow safety screen 22 resides within elbow inlet orifice 36 between the inlet orifice 36 and antimicrobial assembly chamber 15 (see FIG. 2) and prevents the safety flapper 21 from getting sucked into elbow 23. Safety screen 22 also prevents hair and body entrapment if faceplate screen 8 and replaceable antimicrobial assembly chamber 15 are missing in a drained whirlpool bathtub. Flat recess 65 on the housing of elbow 23 preferably receives flat recess 43 on antimicrobial assembly chamber 15. A flat recess on safety screen 22 facilitates the placement of safety screen 22 against flat recess 65 on the housing of elbow 23. Safety cavitation port hole 27 is located on the wall of housing 10B. If a user runs the system without having faceplate screen 8 attached and places any body part near housing inlet orifice 30, ambient air is drawn into port hole 27 directly into pump 3 of the water vessel system, thereby causing pump 3 to draw more air than water and cavitate. Suction ceases before the user is harmed.

Figure 5B:
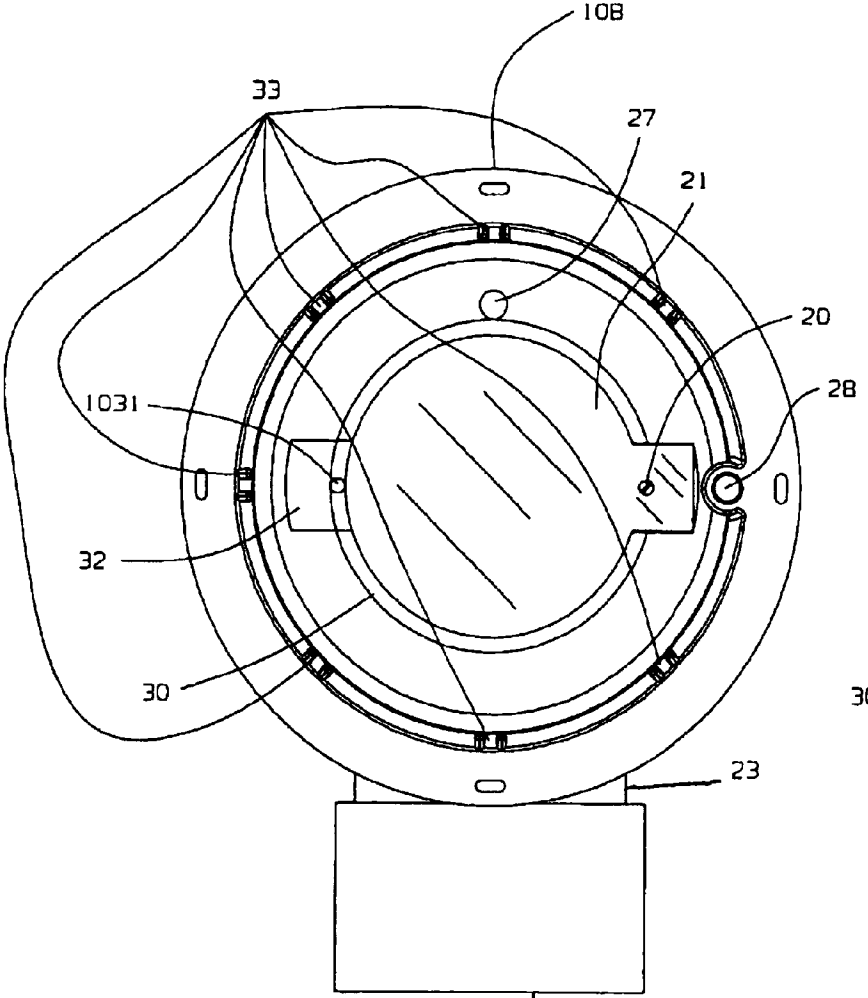
FIG. 5B is a front view of an elbow, housing and safety flapper.

FIG. 5B illustrates the disclosed embodiment of the elbow 23, housing 10B, and safety flapper 21 in the closed mode, thereby enclosing elbow safety screen 22. Safety flapper hole 1031 on elbow 23 receives safety flapper screw 20. Flapper screw 20 secures safety flapper 21 in safety flapper recess 32. See also FIG. 6. Flapper screw 20 screws into safety flapper screw boss 45. See also FIG. 11. Housing receiving slot 33 on faceplate screen housing 10B receives faceplate screen support 25A (see FIG. 4B) on the rear of faceplate screen 8.

Figure 6:
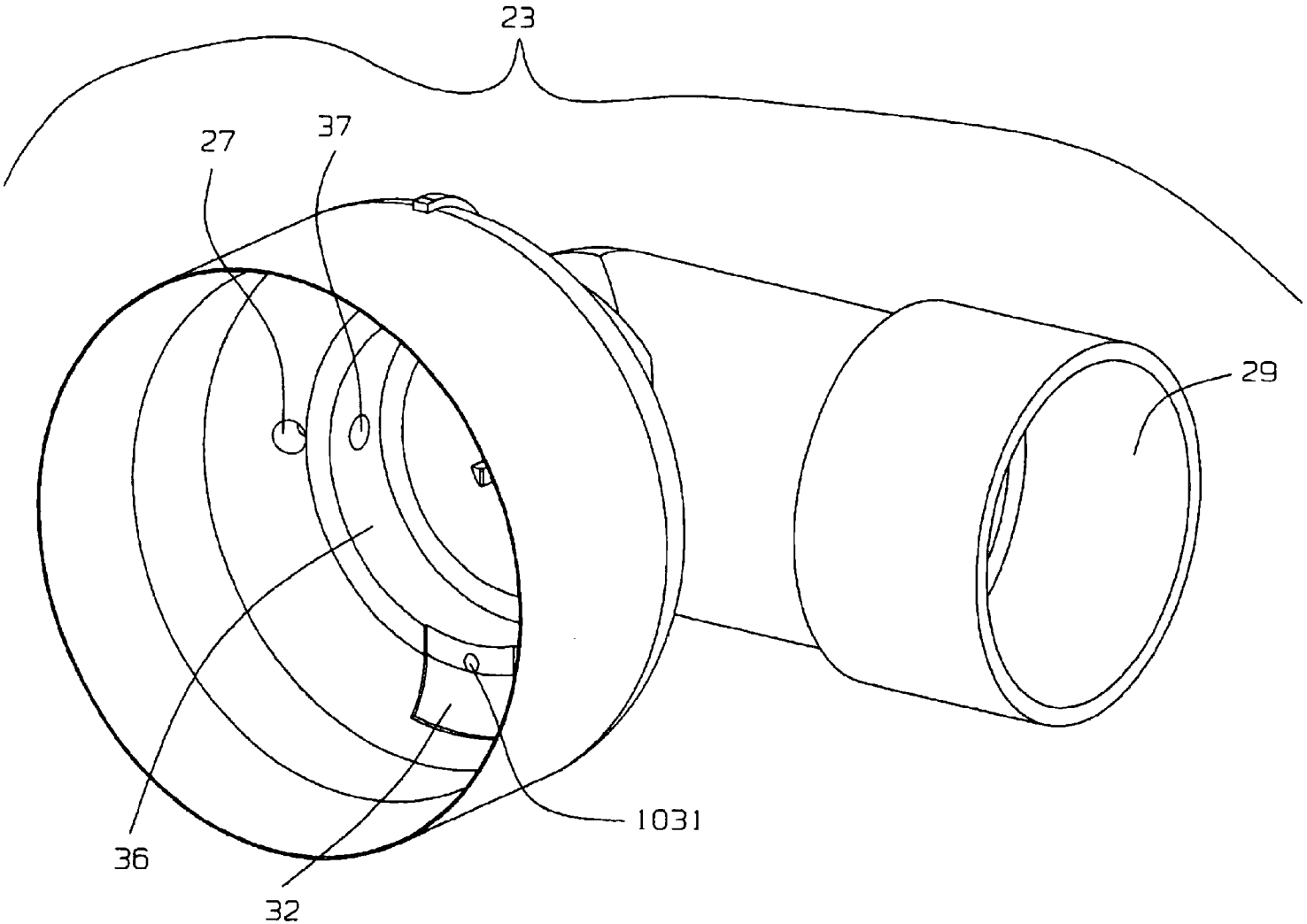
FIG. 6 is a top perspective view of an elbow.

As shown in FIG. 6, antimicrobial chamber cavitation port hole 37 is located behind safety flapper 21 (not shown) in elbow 23 which is attached to the inside of housing 10B (not shown). When antimicrobial assembly chamber 15 is absent or inserted improperly, safety flapper 21 closes and ambient air is pulled into suction line 4 of tub 6 and into pump 3. Without cavitation port hole 37, the seals in pump 3 would bum up at a fast rate when tub 6 were run with flapper 21 in the closed mode. Pump 3 would not only be starved for water, it would also be starved for air. The cavitation feature of the present invention allows air to enter pump 3, thereby allowing for longer run time before damage occurs to pump 3.

Figure 11:
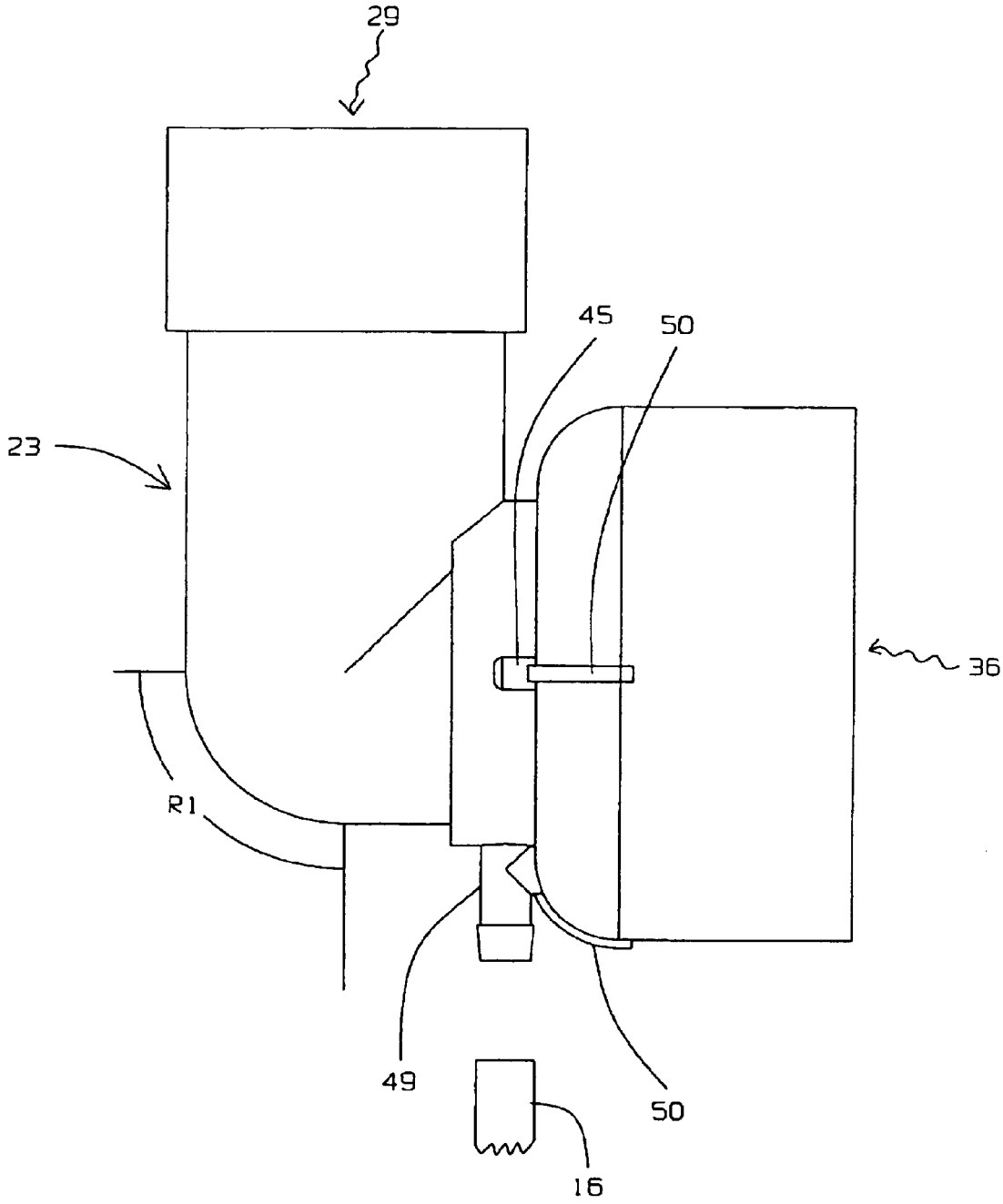
FIG. 11 is a side view of an elbow and housing using a standard 90-degree elbow.

As seen in FIG. 11, combination safety cavitation and antimicrobial cavitation air line 16 is coupled to safety cavitation port hole 27 (not shown) and antimicrobial chamber cavitation port hole 37 (not shown) by means of barbed combination safety cavitation and antimicrobial cavitation air line port 49. Elbow outlet orifice 29 of elbow 23 is connected to suction line 4 of a water circulation system. Elbow 23 of sanitation suction device 31 is readily installed into a standard size opening cut or formed into tub wall 6A (not shown). Elbow housing stop 50 prevents elbow 23 from protruding too far into housing 10B (not shown).

FIG. 11 illustrates elbow 23 of sanitation suction device 31 having a 90-degree radius R1 elbow adjacent to outlet orifice 29. Most elbows for standard suction fittings are not part of the suction fitting. They are usually added to the suction fitting by the whirlpool bathtub manufacturer who usually installs a standard 90-degree radius R1 elbow. However, a 90-degree sweep radius elbow may be employed. A sweep elbow provides for less cavitation than a standard 90-degree elbow and, therefore, offers more pressure out bathtub jets 75 for the same amount of pump horsepower exerted.

Figure 7B:
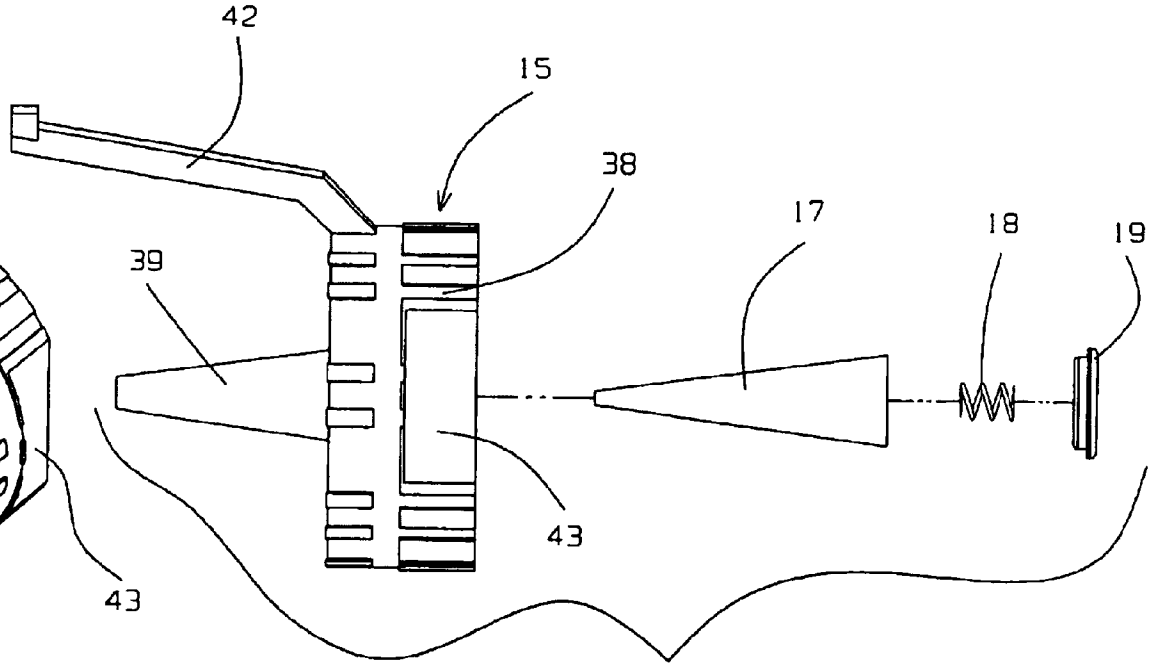
FIG. 7B is a side exploded view of an antimicrobial assembly chamber, antimicrobial additive, spring and antimicrobial chamber cap.
Figure 7A:
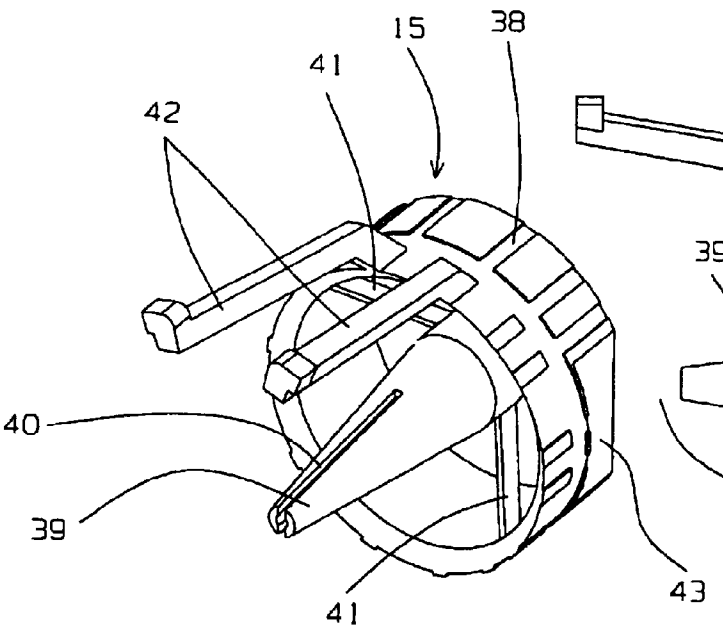
FIG. 7A is a top perspective view of an antimicrobial assembly chamber.

FIGS. 7A, 7B illustrate one embodiment of a replaceable antimicrobial assembly chamber 15. Direct flow antimicrobial chamber 39 is shown centered with respect to antimicrobial chamber collar 38 by means of antimicrobial chamber supports 41. Direct flow antimicrobial chamber 39 receives chemical additive 17, e.g., a bromine stick. The bromine stick is offered by way of example and not of limitation; any suitable chemical in solid or granular form could be employed. A liquid chemical additive with a metering system could also be used. Moreover, any suitable chemical having antimicrobial properties could be utilized. Antimicrobial chamber 39 may be of any shape, although the disclosed embodiment described in this document specifies an antimicrobial chamber which is conically shaped. Antimicrobial chamber spring 18 or other mechanism pushes chemical additive 17 against the inner portion of chamber 39. Antimicrobial chamber spring 18 is kept in place by means of antimicrobial chamber cap 19. Water flows through antimicrobial chamber slits or openings 40 at a high pressure and flow and directly impacts chemical additive 17 in chamber 39, thereby dissolving chemical additive 17 in chamber 39. Water containing antimicrobial additive 17 flows past antimicrobial chamber 39 and through housing 10B and elbow 23. Water containing antimicrobial additive 17 is directly injected into suction line 4 (not shown) of whirlpool bathtub 1 (not shown) and whirlpool bathtub pump 3 (not shown). As chemical additive 17 dissolves within chamber 39, chamber spring 18 pushes any remaining chemical additive 17 against the inner portion of chamber 39 to keep the same amount of chemical additive 17 exposed to the water.

The size of each opening 40 can be adjusted by placing some sort of covering, such as tape or other means, over each opening 40, to close or partially close each opening 40. The tape is offered by way of example and not of limitation; any suitable covering material could be employed. By covering each opening 40, each is made smaller to facilitate usage of the present invention with whirlpool bathtubs having smaller capacities or smaller horsepower pumps. Lower water flow (in gpm) results in less water flow over antimicrobial chamber 39 and a smaller release of antimicrobial additive 17. By merely adjusting openings 40, a predetermined, metered dose of chemical additives 17 can be delivered for any combination of whirlpool bathtub capacity or pump size. Moreover, each opening 40 can be custom sized or shaped to administer a desired dosage of additives without having to employ a means of covering the opening 40.

As stated above, bromine is offered by way of example and not of limitation; any suitable chemical in solid or granular form could be employed. However, using bromine as antimicrobial additive 17, it is preferable that antimicrobial chamber 39 be calibrated to deliver about ½ to 6 parts per million (ppm) bromine or another suitable antimicrobial additive into the bath water. This concentration of antimicrobial additives will leave residual antimicrobial additives in the closed loop plumbing system of the whirlpool bathtub after bath drain down. Such a residual concentration of antimicrobial additives inhibits bacteria growth in the whirlpool bathtub system between usages, while providing a desirable non-offensive odor to the bather. It is preferable, however, that the chemical chamber is calibrated to deliver less than 6 ppm of bromine or another suitable antimicrobial additive during a given bath cycle under one hour in duration.

Figure 8:
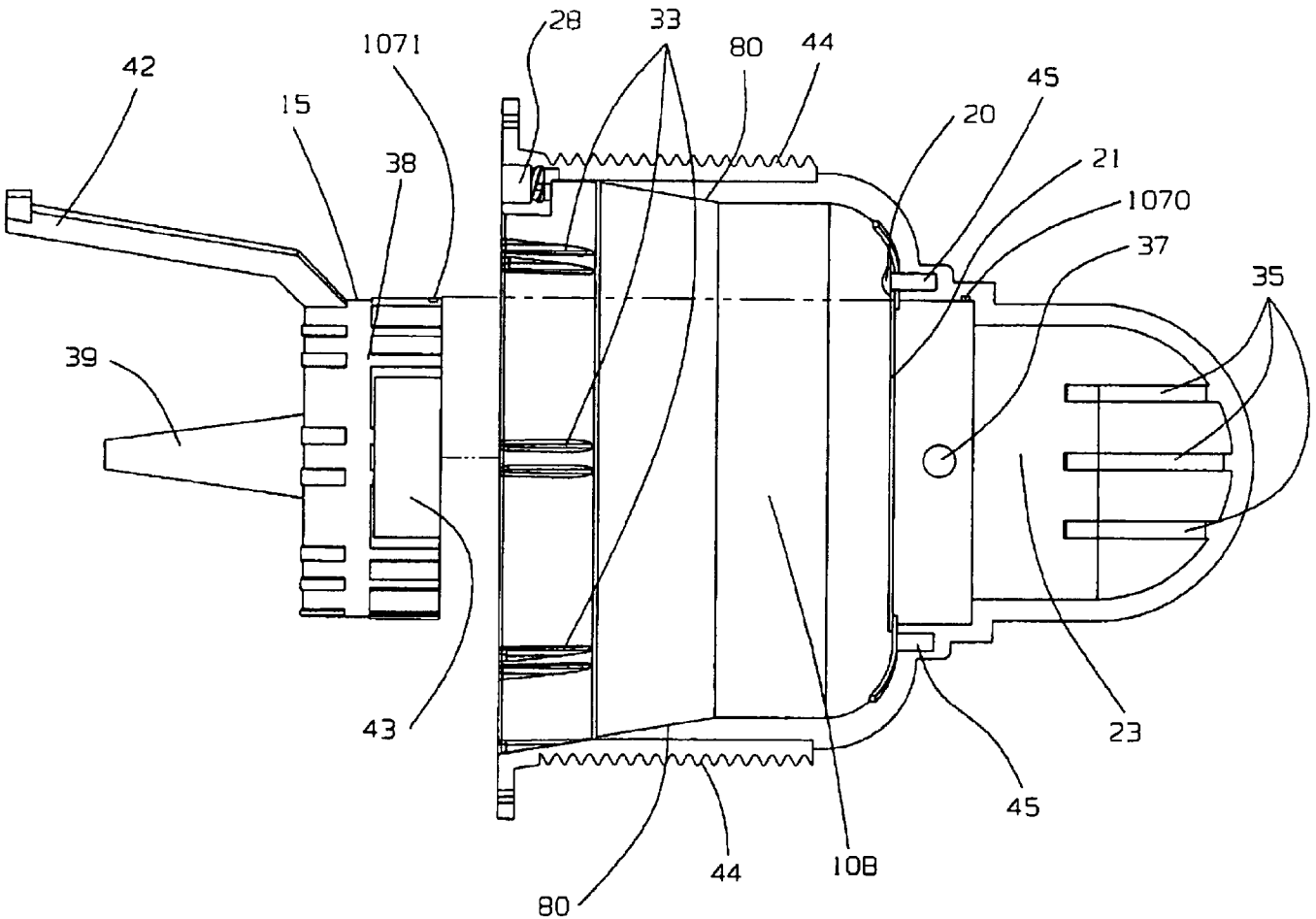
FIG. 8 is a cross sectional view of an elbow and housing, along with a side view of an antimicrobial assembly chamber.

FIG. 8 is a cross sectional view of elbow 23 and housing 10B, which illustrates how antimicrobial assembly chamber 15 fits therein. The housing of elbow 23 is tapered from front to back to allow water to drain back into the tub after shutdown as shown by sloped drainage ledge 80. Safety flapper 21, which is held in place by means of safety flapper screw 20, is in the closed mode. Flapper screw 20 screws into safety flapper screw boss 45. To accommodate the configuration of pump 3 (not shown), elbow 23 may be installed such that the elbow outlet orifice 29 (not shown) may be oriented to the right or the left. Screw boss 45 is located on two portions of elbow 23 so that preferably safety flapper 21 flaps upwardly towards an upper portion of housing 10B when flapper 21 is in the open mode. In other words, regardless of whether the elbow outlet orifice 29 points toward the right or left on the outside of tub 6 (not shown), flap 21 can be attached by means of screw 20 in a screw boss 45 which is appropriately located on the upper half of elbow 23. Safety flapper support arm 42 holds flapper 21 upwardly towards an upper portion of housing 10B when flapper 21 is in the open mode. Flapper support arm 42 is offered by way of example and not a limitation. Any suitable support could be used.

Housing 10B is secured in placed by housing nut 14 (see also FIG. 2) on the outer surface (back side) of the tub wall 6A. Housing nut 14 is secured to housing 10B. To install antimicrobial assembly chamber 15, safety flapper 21 must be lifted from the closed mode, thereby exposing antimicrobial chamber cavitation port hole 37 which is located behind safety flapper 21. Antimicrobial chamber collar 38 is inserted into elbow 23 until contact point 1071 on collar 38 meets up with contact point 1070 on the inlet orifice 36 of elbow 23 and collar 38 covers up port hole 37. Flat recess 43 of collar 38 mates up with flat recess 65 of elbow 23. Elbow safety screen 22 (see FIG. 2) may be placed between inlet orifice 36 and antimicrobial assembly chamber 15.

Figure 9:
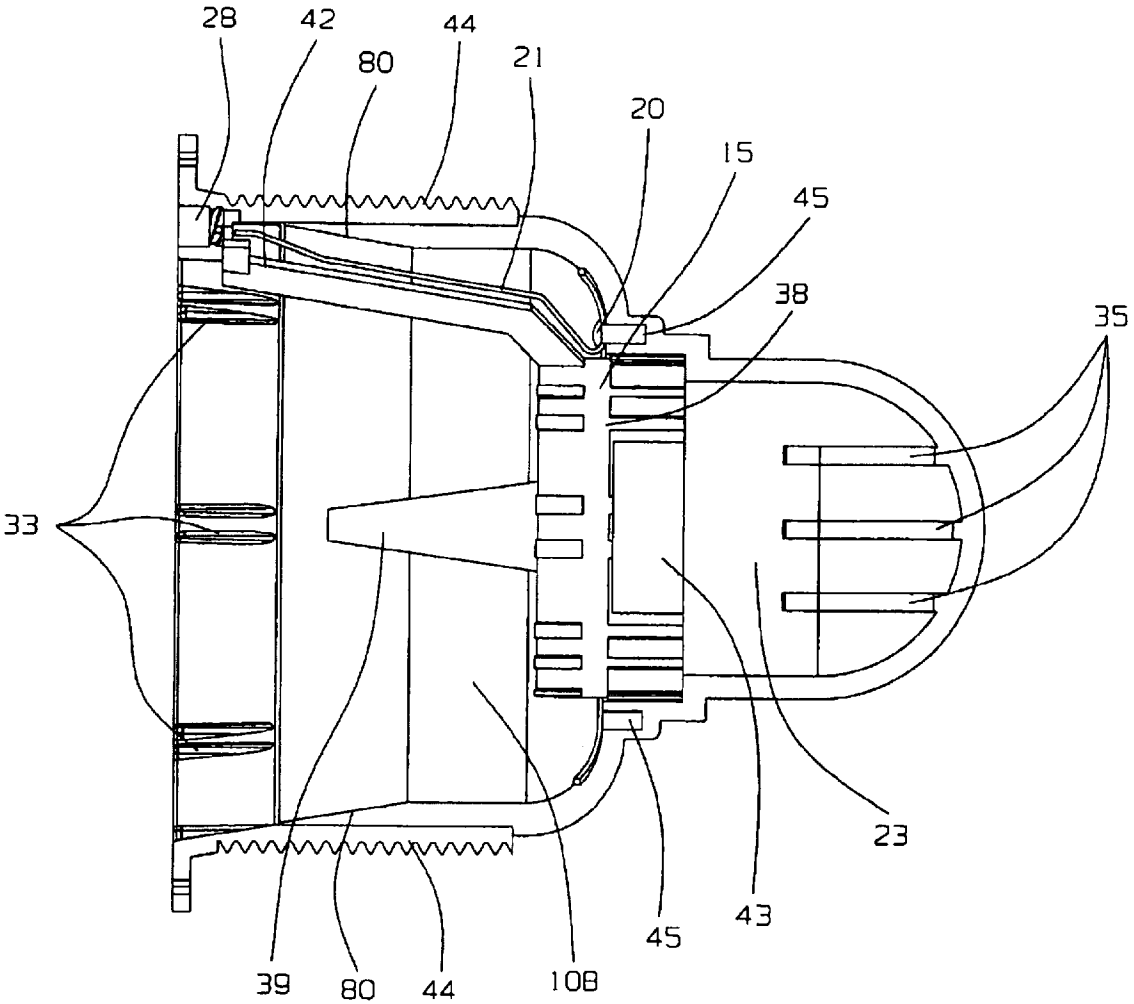
FIG. 9 is a cross sectional view of an elbow with antimicrobial assembly chamber inserted and safety flapper in an open mode to show draft slant of housing.

FIG. 9 is a cross sectional view of elbow 23 and housing 10B, wherein antimicrobial assembly chamber 15 is inserted. Safety flapper 21, which is held in place by means of safety flapper screw 20, is in the open mode. Safety flapper support arm 42 holds flapper 21 upwardly towards an upper portion of housing 10B adjacent to sloped drainage ledge 80 of elbow 23. Antimicrobial chamber collar 38 is shown inserted into housing 10B in contact with inlet orifice 36 of elbow 23. Flat recess 43 of collar 38 is mated up with flat recess 65 (not shown) of elbow 23. Elbow safety screen 22 may be placed between inlet orifice 36 and antimicrobial assembly chamber 15 (see FIG. 2). Direct flow antimicrobial chamber 39 is shown centered with respect to antimicrobial chamber collar 38 in housing 10B and elbow 23. Housing receiving slot 33 on faceplate screen housing 10B receives faceplate screen support 25 (not shown) on the rear of faceplate screen 8 (see FIGS. 2, 5A).

Figure 14:
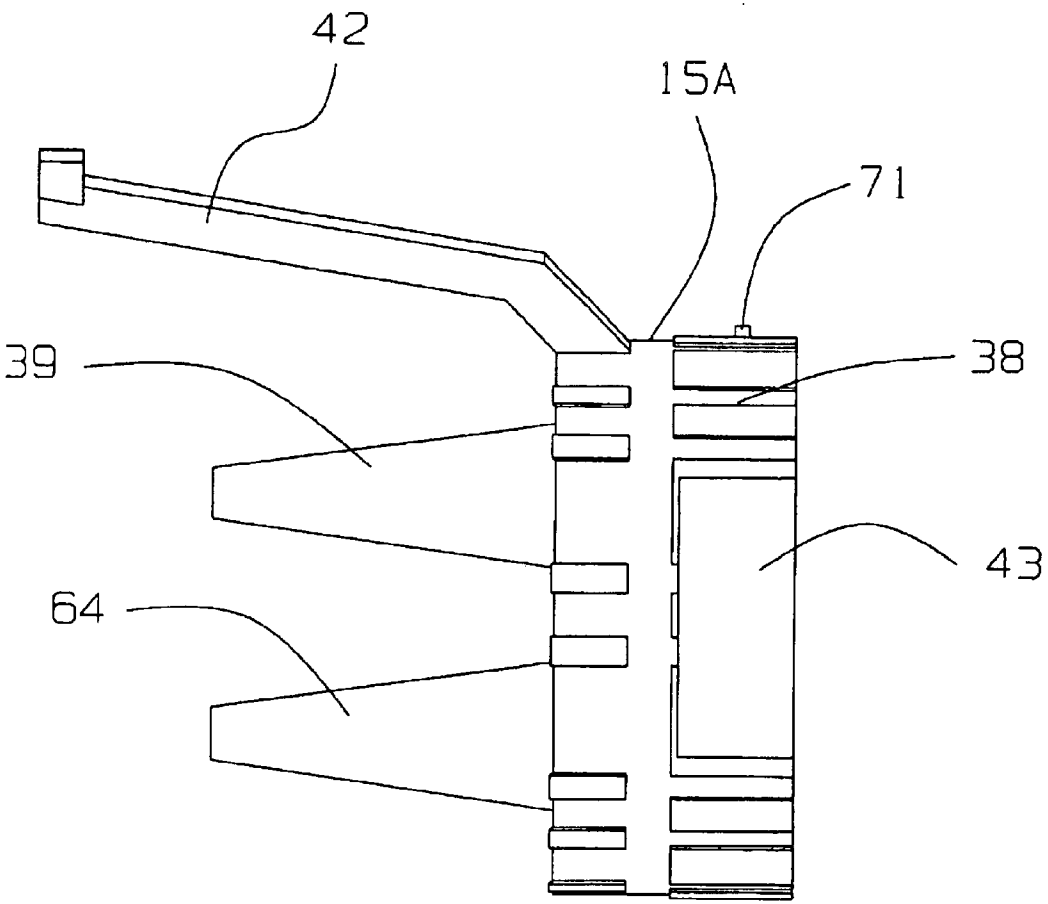
FIG. 14 is a side view of an alternate embodiment of an antimicrobial chamber having a scale chamber.

FIG. 14 is a side view of another embodiment of antimicrobial assembly chamber 15. In addition to direct flow antimicrobial chamber 39, antimicrobial assembly chamber 15A has an anti-scale chamber 64 which houses a scale reducer substance (not shown). Such scale reducers help to prevent scale buildup in the whirlpool bathtub's closed looped plumbing system and inhibits biofilm development in the closed loop system. Additional alternate chambers may be included if desired.

Figure 15:
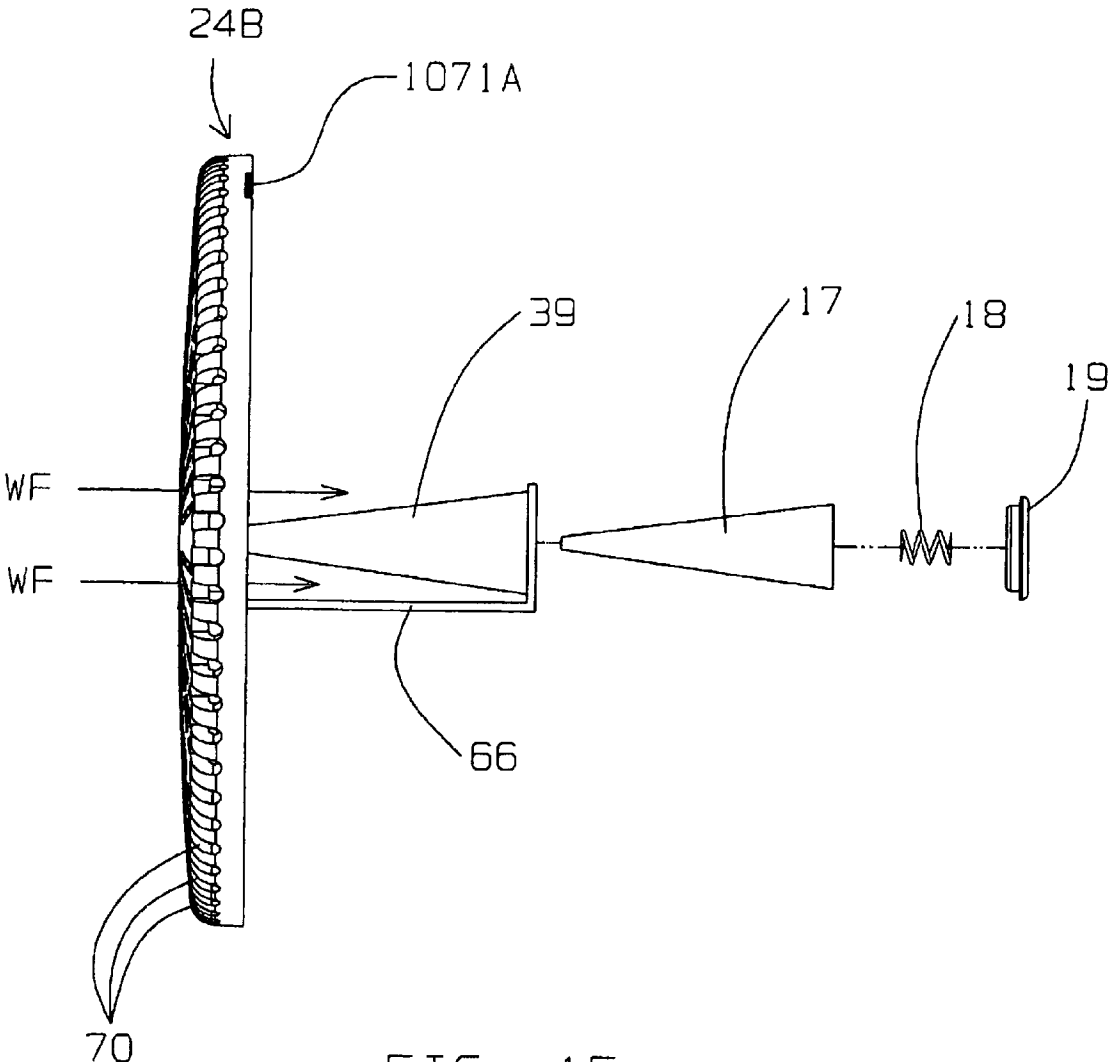
FIG. 15 is a side exploded view of an alternate embodiment faceplate screen filter having a removable antimicrobial chamber.
Figure 20:
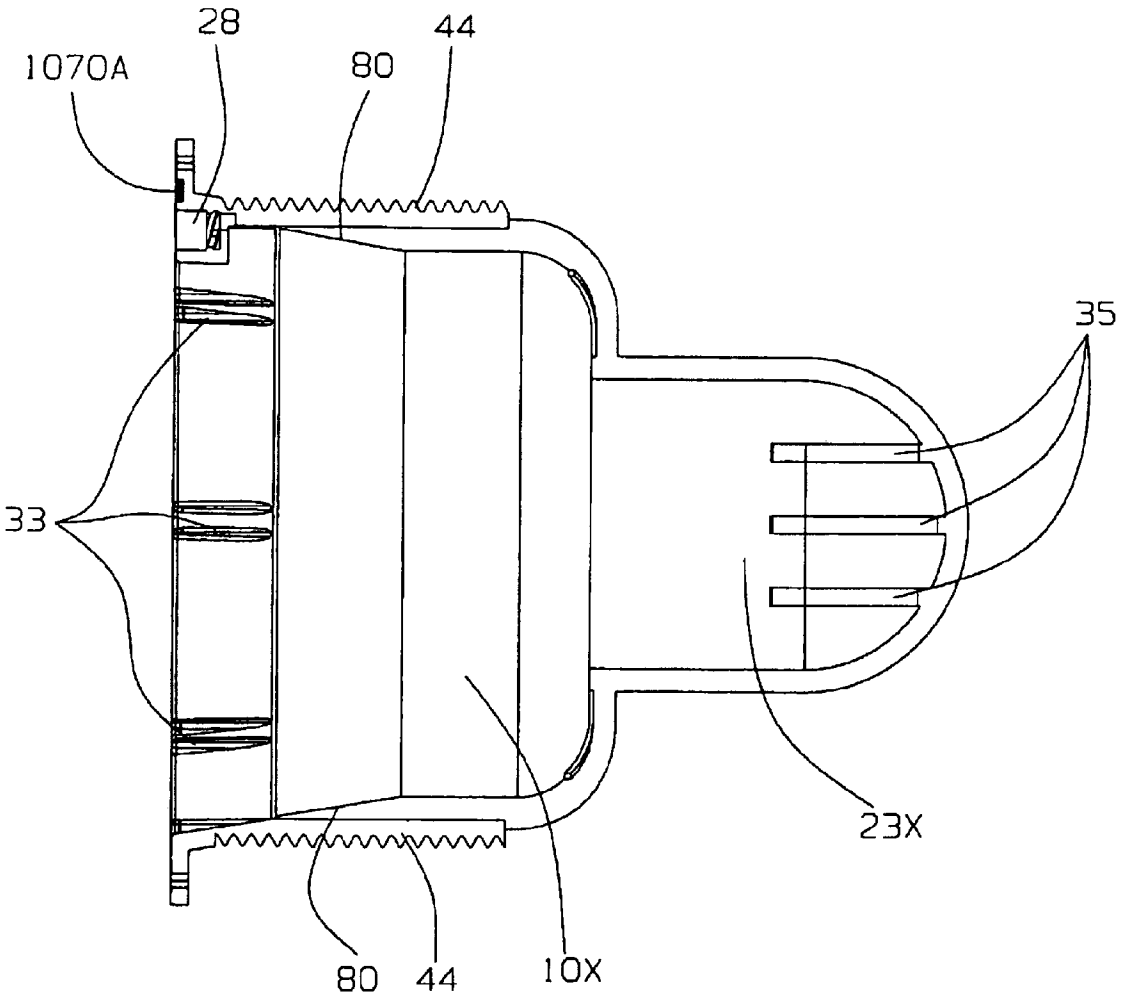
FIG. 20 is a cross sectional view of an alternate housing and elbow embodiment that receives a one-piece faceplate and antimicrobial chamber.

FIGS. 15, 20 illustrate an alternate embodiment of a faceplate screen filter with a removable antimicrobial chamber, thereby forming a combination faceplate screen/antimicrobial chamber. FIG. 15 is a side view of the combination faceplate screen/antimicrobial chamber. FIG. 20 is a cross-sectional view of elbow 23X and housing 10X, wherein faceplate screen 24B having a removable antimicrobial chamber 39 is inserted. Faceplate screen 24B, having hole openings of greater than 1000 microns, acts as a filter. Water flows through faceplate screen 24B in direction WF at a flow rate of over 70 gpm or so. In this embodiment, removable antimicrobial chamber 39 snaps into support bracket 66 which is an integral and non-removable part of faceplate screen 24B. Drain slots 70 on faceplate screen 24B allow water to drain back into the tub after shutdown. Faceplate screen 24B is inserted into housing 10X until contact point 1071A on faceplate screen 24B meets up with contact point 1070A on the housing 10X of elbow 23X. Housing receiving slot 33 on housing 10X receives faceplate screen support 25A (not shown) on the rear of faceplate screen 24B. Housing hole 28 receives attachment screw 7 (not shown) to attach faceplate screen 24B to the inner tub wall 6A.

Figure 18:
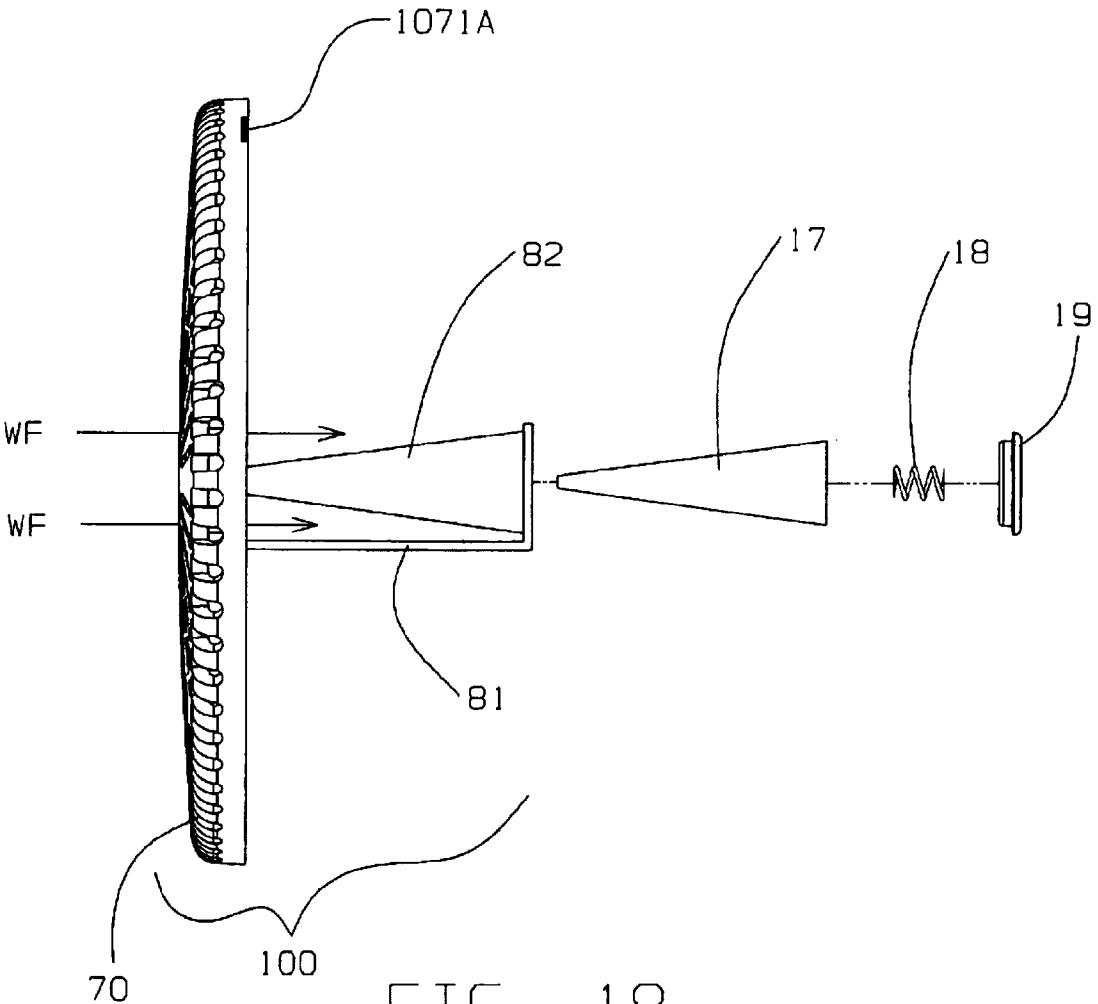
FIG. 18 is a side exploded view of a one-piece faceplate and non-removable antimicrobial dispenser embodiment whereby the faceplate and antimicrobial combination is reusable and only the antimicrobial additives need to be replaced.

FIG. 18 illustrates an alternate embodiment of a faceplate screen filter with a non-removable antimicrobial chamber which may also be used with elbow 23X and housing 10X shown in FIG. 20. In this embodiment, integrated unit 100 is a combination faceplate screen and antimicrobial chamber. Non-removable antimicrobial chamber 82 is supported in place by means of antimicrobial chamber holding support 81. The faceplate screen of integrated unit 100, having hole openings of greater than 1000 microns, acts as a filter. Water flows through faceplate screen of integrated unit 100 in direction WF at a flow rate of over 70 gpm or so. Drain slots 70 on integrated unit 100 allow water to drain back into the tub after shutdown. Integrated unit 100 is inserted into housing 10X until contact point 1071A on integrated unit 100 meets up with contact point 1070A on the housing 10X of elbow 23X. Housing receiving slot 33 on housing 10X receives integrated unit screen support 25X (not shown) on the rear of integrated unit 100. Housing hole 28 receives attachment screw 7 (not shown) to attach integrated unit 100 to the inner tub wall 6A.

Figure 19:
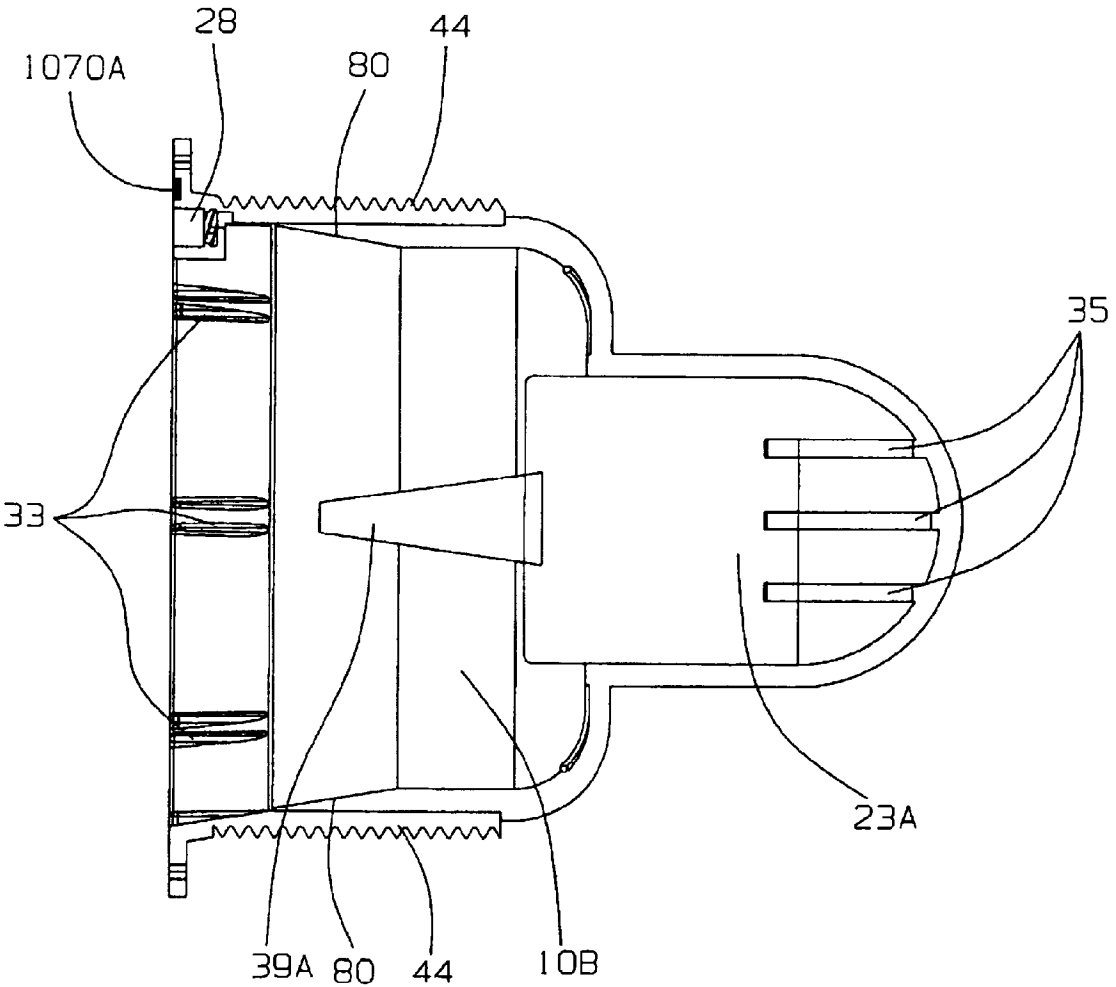
FIG. 19 is a cross sectional view of an alternate embodiment one piece elbow and antimicrobial dispenser whereby only the antimicrobial additives need to be replaced and not the complete antimicrobial dispenser.

FIG. 19 is a cross sectional view of another embodiment showing a one-piece elbow 23A, housing 10B, and antimicrobial chamber 39A design. Whereas FIGS. 15, 18 show combination faceplate screen/antimicrobial chamber units, FIG. 19 illustrates an integrated elbow/antimicrobial chamber. Antimicrobial chamber 39A is non-removable. In this integrated elbow/antimicrobial chamber configuration, only the antimicrobial additives 17 (not shown) need to be replaced and not the complete antimicrobial dispenser.

Figure 21:
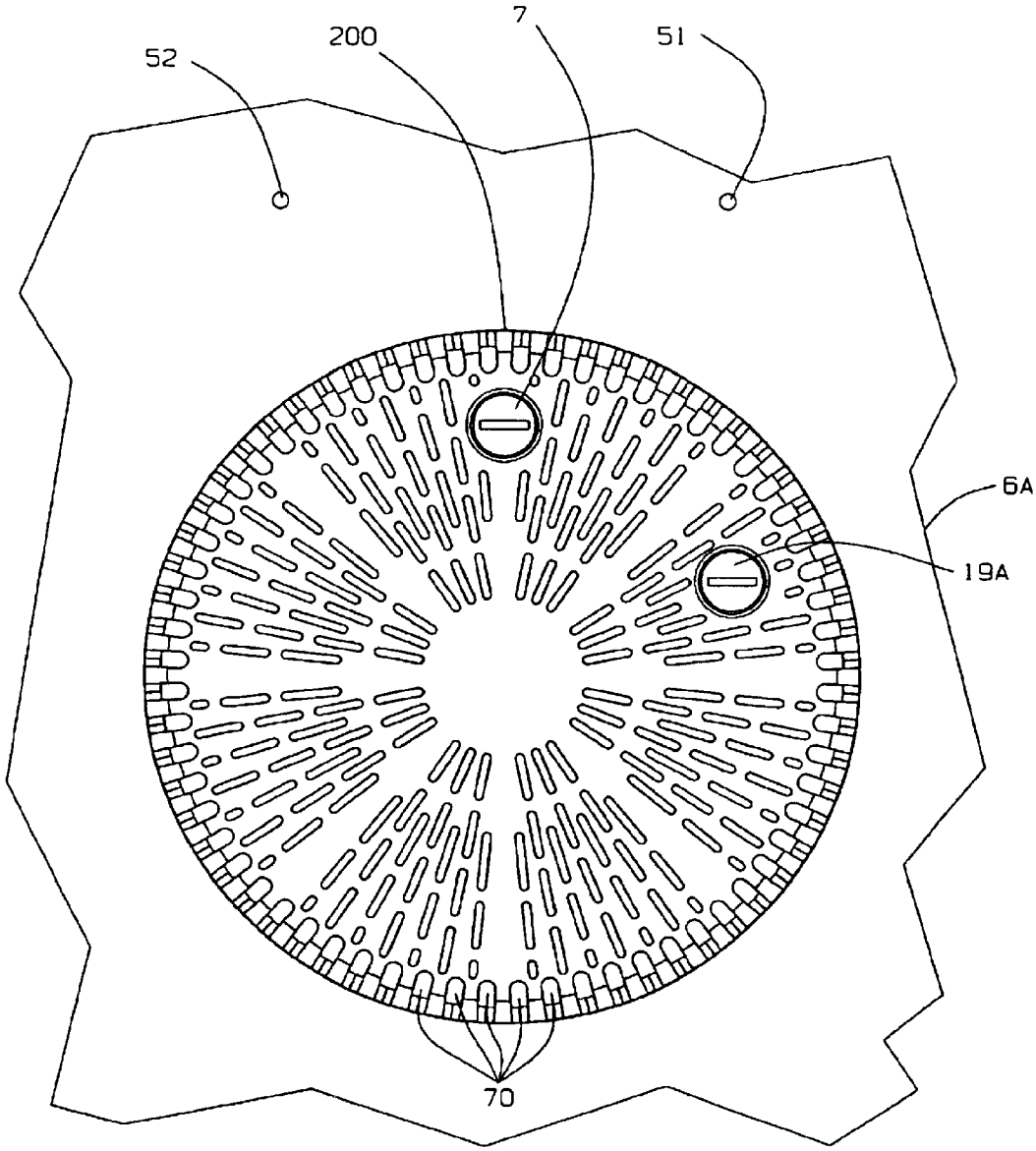
FIG. 21 is a front view of an alternate embodiment faceplate whereby the replaceable antimicrobial additives can be replaced from within the tub without removing the faceplate.
Figure 22:
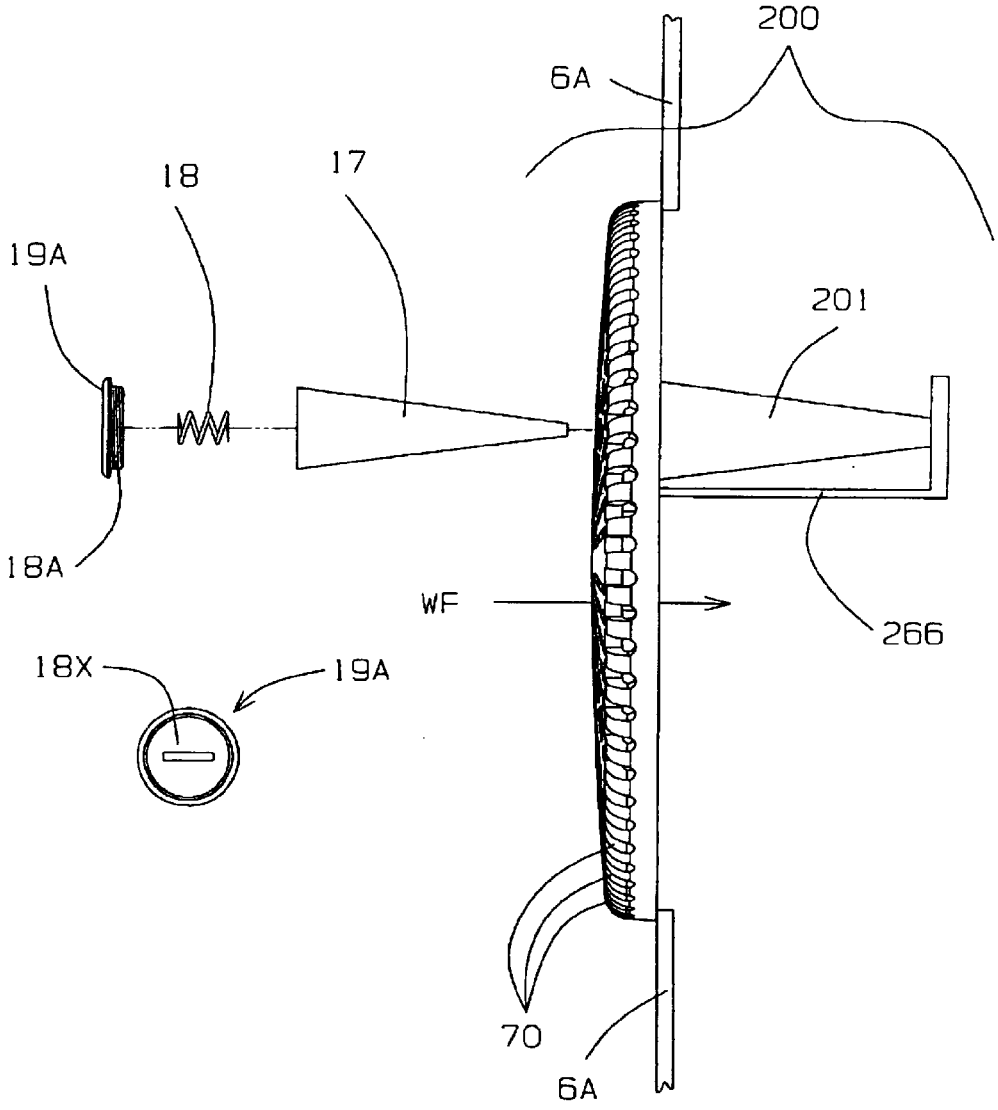
FIG. 22 is a side view of the embodiment of FIG. 21.

FIGS. 21, 22 illustrate an alternate embodiment of a faceplate screen filter with a non-removable antimicrobial chamber 201 whereby the antimicrobial additives can be replenished from within the whirlpool bathtub without having to first remove the faceplate. In this embodiment, integrated unit 200 is shown attached to inner tub wall 6A by a half-turn attachment screw 7. Indicator lights 51, 52 are shown placed near the inside wall 6A of the whirlpool bathtub near faceplate screen 200. Integrated unit 200, having hole openings of greater than 1000 microns, acts as a filter. Drain slots 70 on integrated unit 200 allow water to drain back into the tub after shutdown.

With this embodiment, a user removes antimicrobial chamber cap 19A and antimicrobial chamber spring 18. The user then places antimicrobial additives 17 in non-removable antimicrobial chamber 201 of integrated unit 200 and replaces antimicrobial spring 18 so it can push chemical additive 17 against the inner portion of chamber 201 . Antimicrobial chamber cap 19A screws into antimicrobial chamber 201 by means of threads 18A. The cap could also have a snap fit configuration. Slot 18X-facilitates the tightening or loosening of chamber cap 19A. Antimicrobial chamber 201 can also be removable if desired. In this case, the user need only open up chamber cap 19A, remove a spent antimicrobial chamber 201, insert another antimicrobial chamber 201 containing antimicrobial additives 17, and reinstall chamber cap 19A. With this embodiment, the key is not having to remove the faceplate screen. Here, antimicrobial chamber 201 is shown to be conically shaped and supported by support bracket 266. However, antimicrobial chamber 201 can be of any configuration and a support bracket need not be used.

Figure 32:
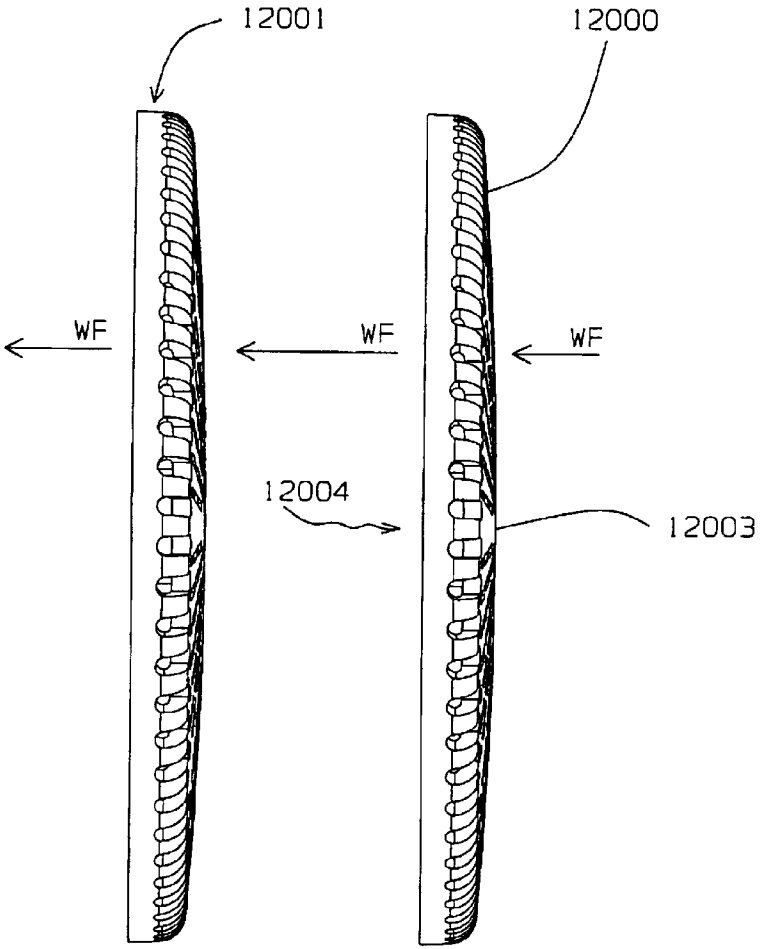
FIG. 32 is a side view of an alternate embodiment faceplate screen that covers a standard faceplate-screen.

FIG. 32 shows an alternate embodiment faceplate screen that covers a standard faceplate screen. Here, sanitation faceplate screen 12000, having antimicrobial additives (not shown) placed at a back portion 12004 of sanitation faceplate screen 12000, fits over standard faceplate 12001. Water flows in direction WF, passes through hole openings in a front portion 12003 of sanitation faceplate screen 12000,and directly contacts antimicrobial additives (not shown) at back portion 12004. Water containing antimicrobial additives flows through faceplate 12001 in direction WF and into suction line 4 (not shown) of the whirlpool bathtub and the whirlpool bathtub pump. As shown, sanitation faceplate screen 12000 is similar in design to standard faceplate screen; sanitation faceplate screen 12000 snaps on over standard faceplate 12001. However, a similarly designed sanitation faceplate screen is offered by way of example and not of limitation as sanitation faceplate screen may be in various sizes and shapes. Further, sanitation faceplate screen 12000 may be attached to standard faceplate 12001 by any suitable attachments means. As one example, sanitation faceplate screen 12000 could be screwed on over standard faceplate 12001.

FIGS. 16, 17 present alternate embodiments of the present invention. In FIG. 16, combination safety cavitation and antimicrobial cavitation air line 16 extends from sanitation suction device 31A. In this embodiment, sanitation suction device 31A has a shaft 31B which extends to the top of tub 6 at tub deck 6B so antimicrobial additives may be replaced by filling shaft 31B from fill cap 31C at tub deck 6B. The top fill configuration is offered by way of example and not of limitation, as shaft 31B may be installed such that antimicrobial additive replacement takes place at a side mount. In such a case, fill cap 31C would be mounted on a side wall of tub 6. By replacing antimicrobial additives via a fill shaft, liquid chemical additive with a metering system could also be used.

In FIG. 17, combination safety cavitation and antimicrobial cavitation air line 16 extends from sanitation suction device 31. In this embodiment, inline antimicrobial sanitation device 32D is shown installed on water return line 5. However, inline sanitation device 32D may be placed anywhere in the whirlpool bathtub closed loop plumbing. Inline antimicrobial sanitation device 32D extends to the top of tub 6 at tub deck 6B so antimicrobial additives may be replaced by filling inline device 32D from fill cap 31C at tub deck 6B so that antimicrobial additives may be released into the piping of the whirlpool bathtub system. Again, the top fill configuration is offered by way of example and not of limitation, as inline device 32D may be installed such that antimicrobial additive replacement takes place at a side mount.

Figures 23A, 23B:
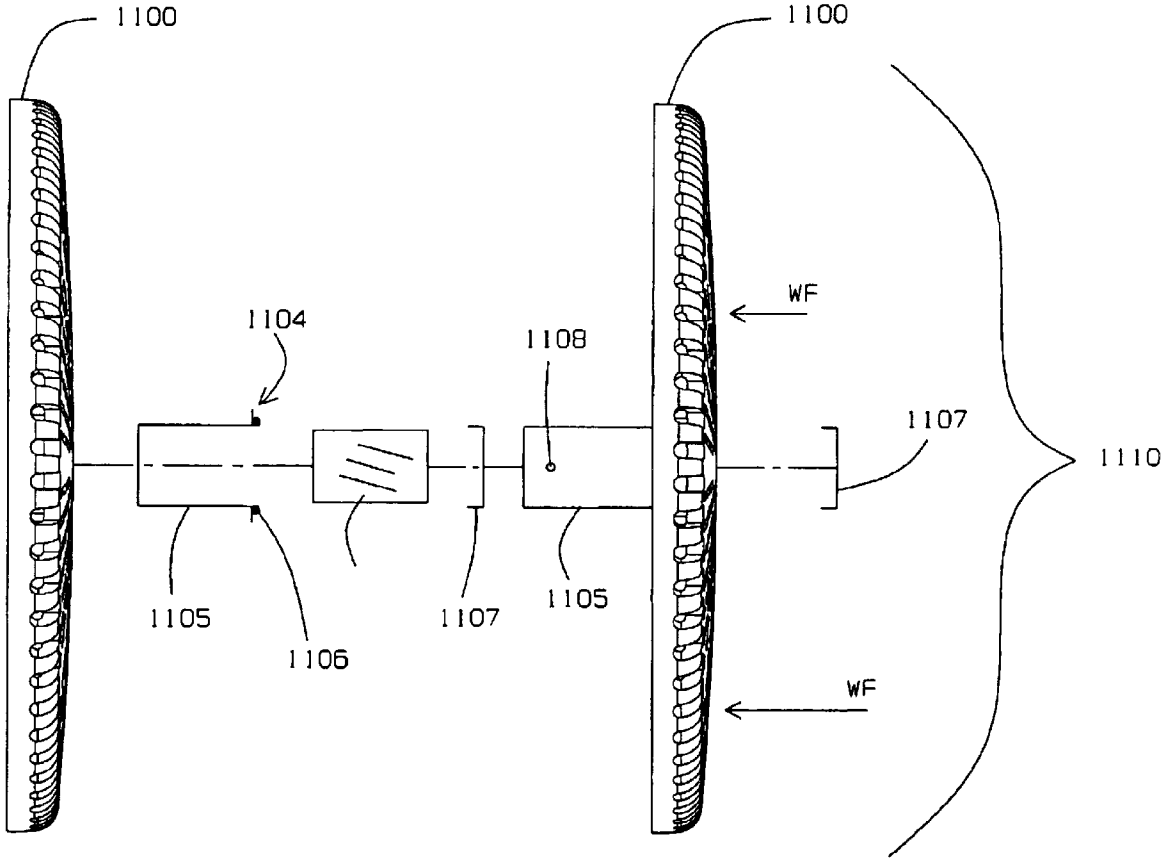
FIGS. 23A, 23B are side views of an alternate embodiment faceplate screen that provides a cost-effective retrofit for an existing suction fitting installed on a whirlpool bathtub.
Figure 24:
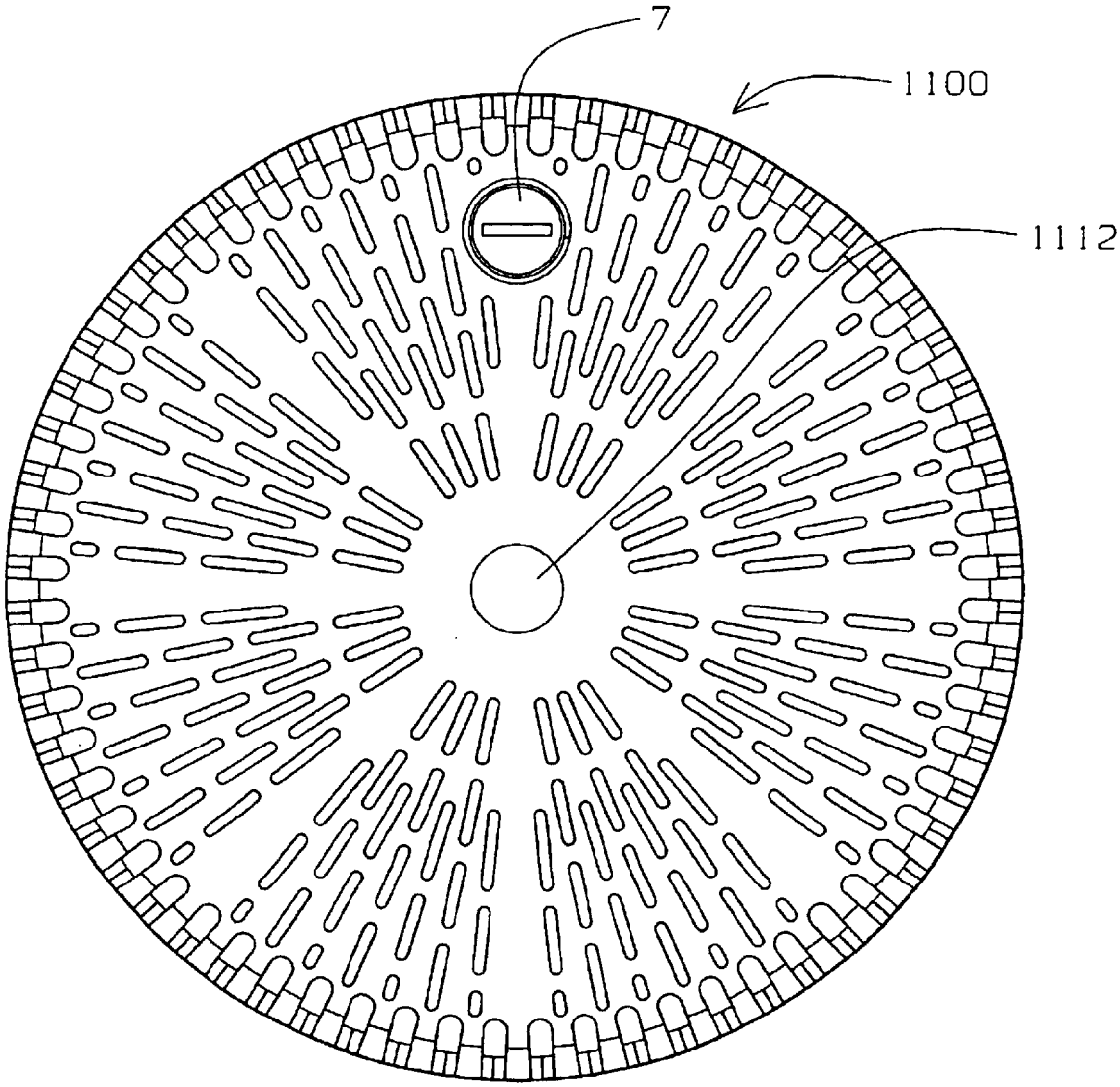
FIG. 24 is a front view of the embodiment shown in FIGS. 23A, 23B.

FIGS. 23A, 23B, 24 illustrate an alternate embodiment of the present invention that provides a cost-effective retrofit for an existing suction fitting installed on a whirlpool bathtub. First, a trade professional, usually a plumber, cuts an opening 1112 into faceplate screen 1100. Here, opening 1112 is shown in the faceplate screen center. However, opening 1112 may be placed anywhere on faceplate screen 1100. Then the trade professional places glue or any attachment means (not shown) behind retrofit antimicrobial chamber 11 05 at preferably an edge 1104, behind flange 1106. After inserting retrofit antimicrobial chamber 1105 into opening 1112 of faceplate screen 1100, whereby the glue or other attachment means secures at least edge 1104, behind flange 1106 to faceplate screen 1100, antimicrobial additive 17 is placed into retrofit chamber 1105. To complete the retrofit, the trade professional places retrofit antimicrobial chamber cover 1107 over retrofit antimicrobial chamber 1105 to form a combination faceplate screen and antimicrobial dispenser 1110.

When the whirlpool bathtub is activated with combination faceplate screen and antimicrobial dispenser 1110, water flow WF passes antimicrobial chamber 1105 which houses antimicrobial additives 17 and antimicrobial release opening 1108 on antimicrobial chamber 1105. Retrofit antimicrobial chamber 1105 could have multiple antimicrobial release openings 1108 that could be in various sizes, shapes, and positions on retrofit chamber 1105. Further, antimicrobial cover 1107 can be a snap on or screw on type of cover. As water passes by or comes into direct contact with antimicrobial additive 17, some of antimicrobial additive 17 is released into the plumbing of the whirlpool bathtub.

Although this embodiment is shown using the faceplate screen configuration of faceplate screen 1100, the present invention may be used to retrofit any standard faceplate for a suction fitting. Further, retrofit chamber 1105 can be of any shape.

Just as the various combinations of faceplate/antimicrobial chamber or elbow/antimicrobial chamber configurations are offered by way of example and not of limitation, the location of the configurations may also vary. The number of chambers may also vary. Although the figures typically show the present invention mounted into tub wall 6A, any suitable tub mounting could be employed. FIG. 25 is an overhead view of the tub showing the present invention installed on the bottom of a whirlpool tub wherein only the faceplate screen 8 is visible.

Figure 26:
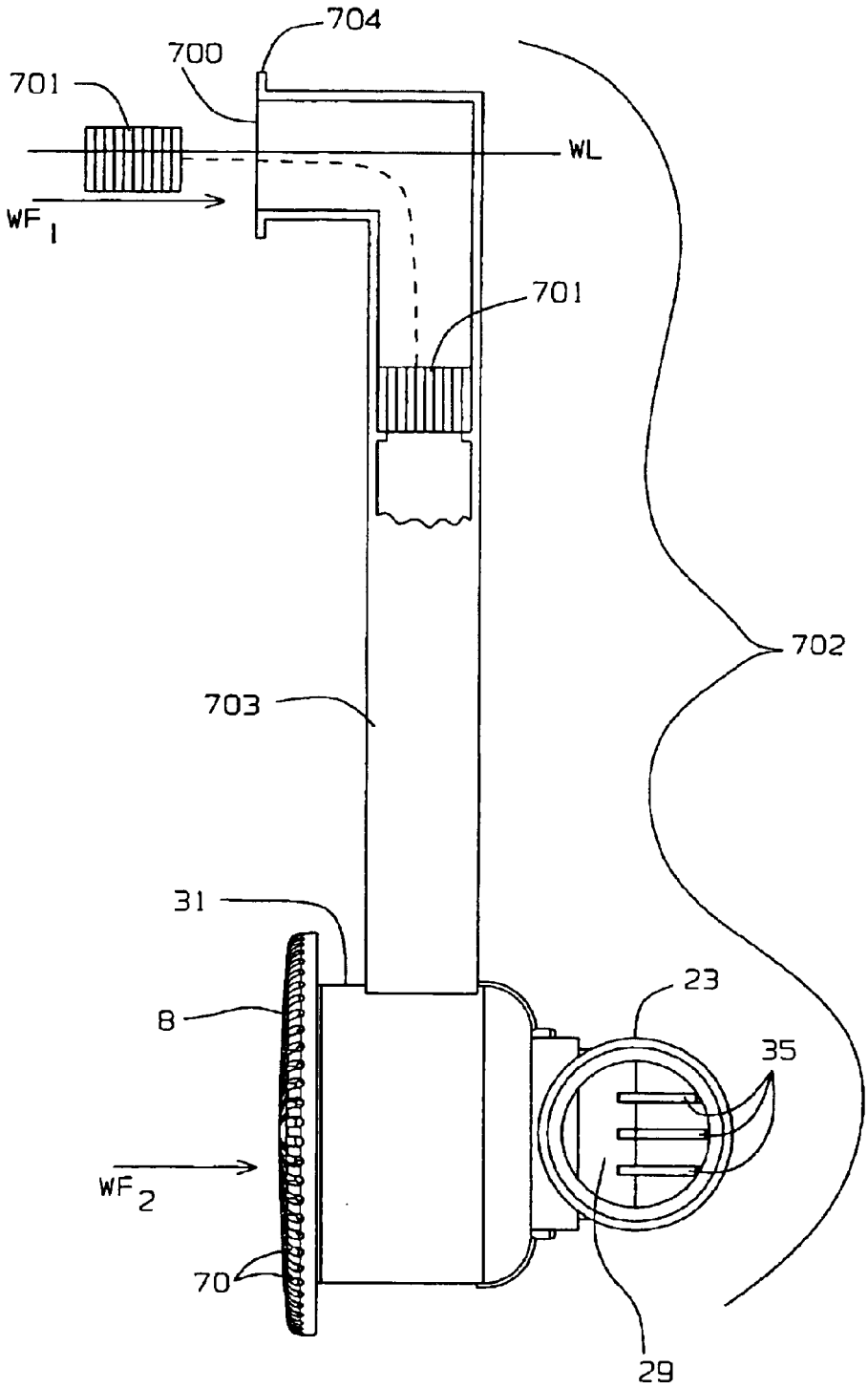
FIG. 26 is a side view of an alternate embodiment having a combination sanitation suction device in further combination with a standard pool skimmer.
Figure 27:
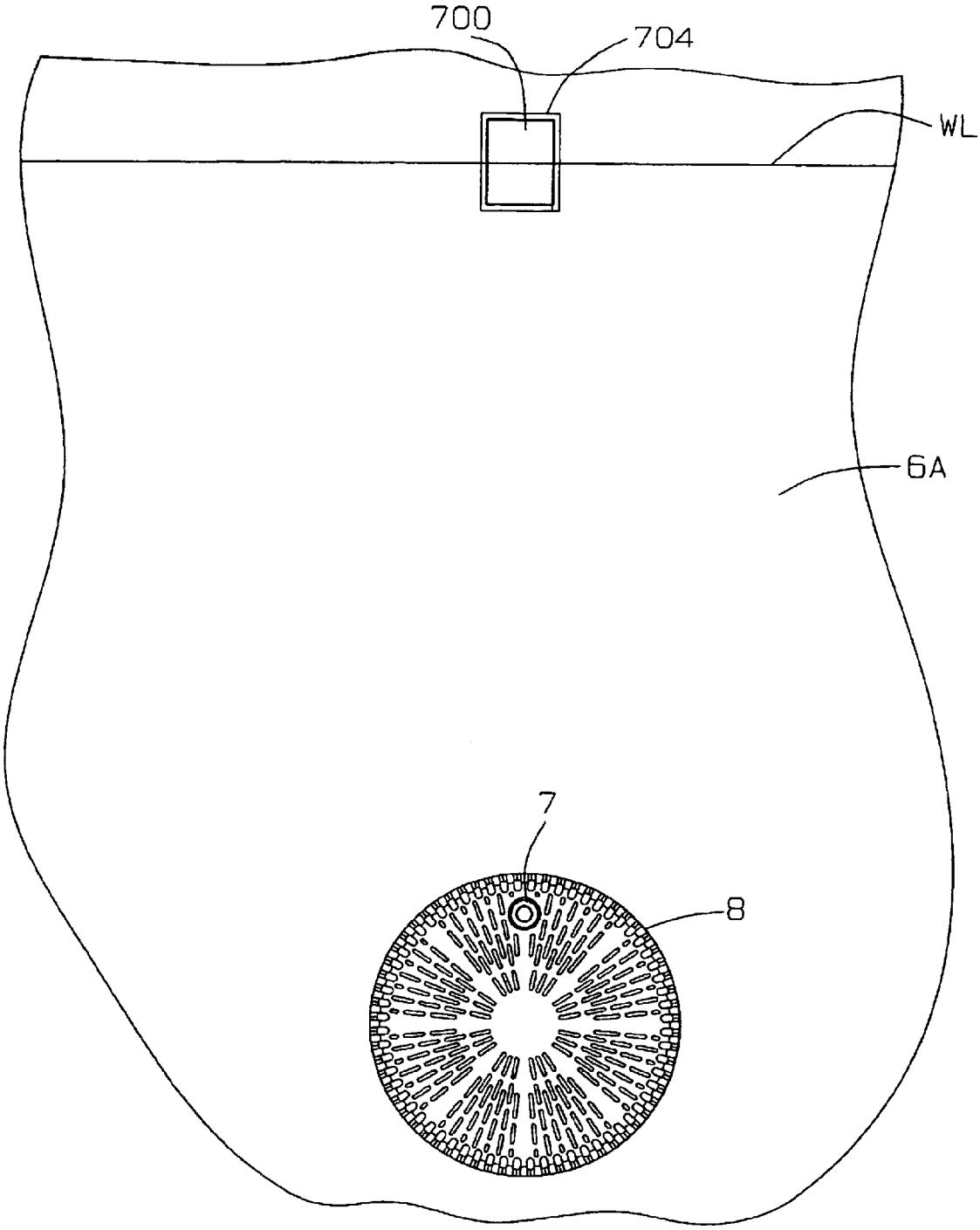
FIG. 27 is a front view of the embodiment shown in FIG. 26.

FIGS. 26, 27 show a combination sanitation suction device 31 for high velocity flows in further combination with a standard pool skimmer for low velocity flows, thereby forming combination unit 702. The upper skimmer section of combination unit 702 is presented as a cross-section. Low velocity water at the surface of the tub, or water line WL, flows into skimmer input orifice 700 in direction $WF_1$, and through stem 703. This low velocity water flows into combination sanitation suction device 31, whereby it combines with high velocity water flowing in direction $WF_2$ through faceplate screen 8. The combined water then flows past antimicrobial assembly chamber 15 (not shown) that houses antimicrobial additives 17, past antivortex vanes 35 thereby reducing water vortexing, and into the whirlpool's closed loop plumbing system through output orifice 29 of elbow 23. Debris is skimmed off the water surface WL of tub 6 and collected on optional filter 701. The filter is offered by way of example and not of limitation; any debris-trapping means could be employed. Furthermore, the debris-trapping means could be replaceable. As water contacts antimicrobial additives 17 in antimicrobial assembly chamber 15 (not shown), some of the additives leave the antimicrobial chamber and are directly injected into the suction line of the whirlpool bathtub and the whirlpool bathtub pump.

In FIG. 27, combination unit 702 is shown as seen by a bather. The only visible portions of the combination unit 702 are faceplate screen 8 which is attached to the inner tub wall 6A by a half-turn attachment screw 7 below water line WL, and tub attachment flange 704 of skimmer input orifice 700 at water line WL.

Figure 28:
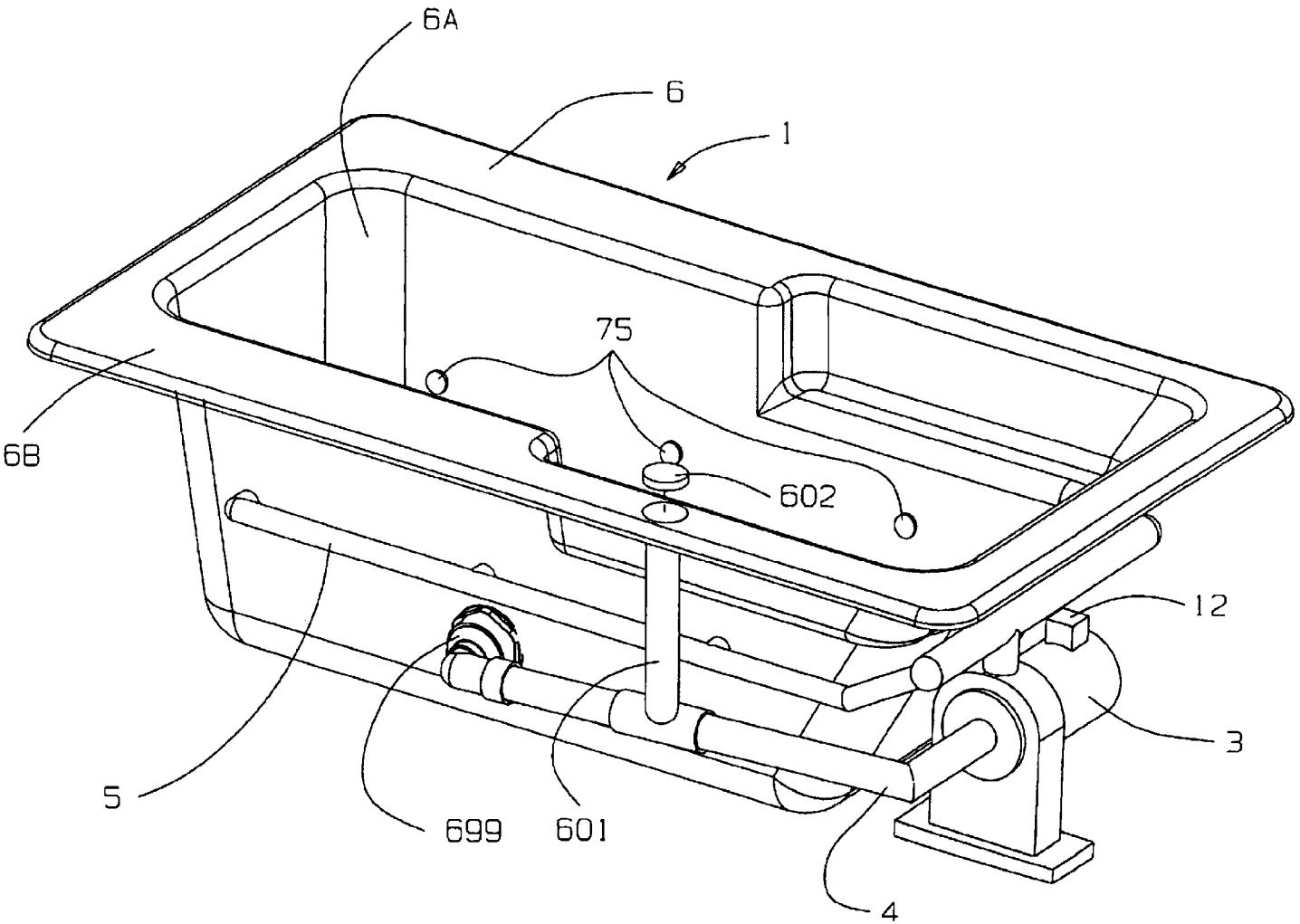
FIG. 28 is a top perspective view of an alternate embodiment antimicrobial dispensing device having a deck mount that can be placed on the output side of a standard suction fitting.
Figure 29:
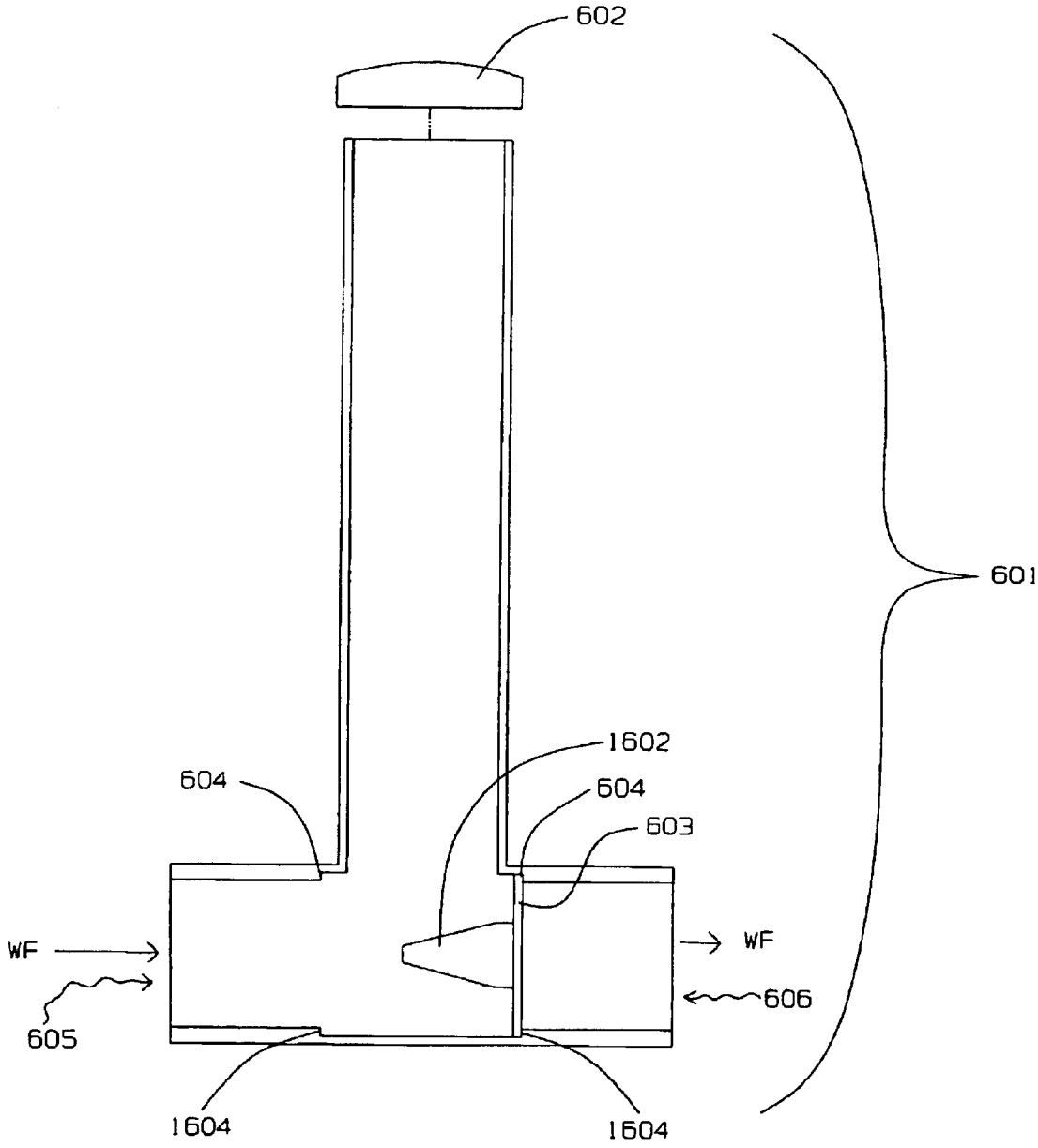
FIG. 29 is a side view of the antimicrobial dispensing device of FIG. 28.
Figure 30:
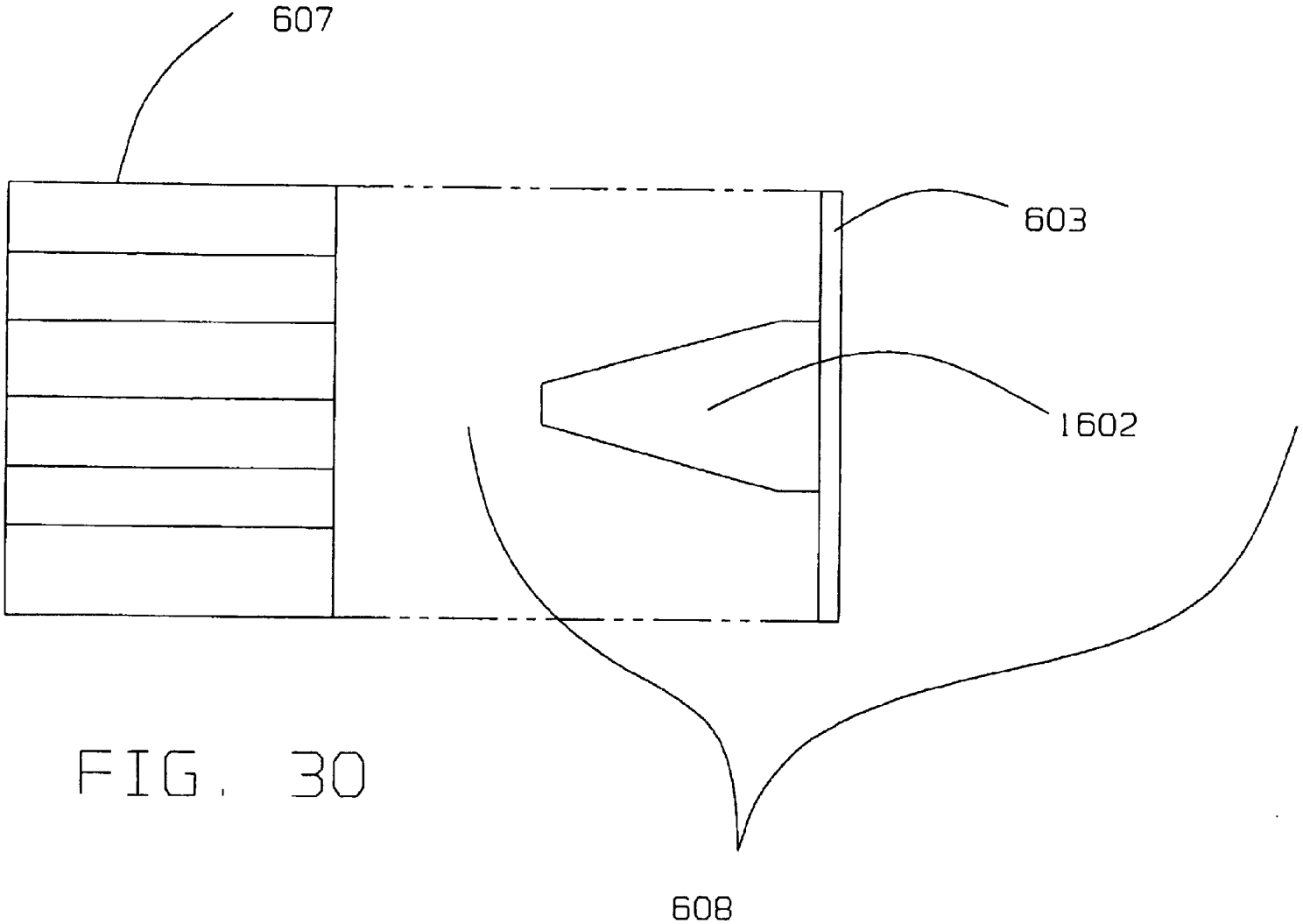
FIG. 30 is a side view of the antimicrobial chamber assembly of the device of FIGS. 28, 29.

FIGS. 28, 29, and 30 show a deck-mounted antimicrobial dispensing device 601 that can be placed on suction line 4 on the output side of a standard suction fitting 699. Water flows into standard suction fitting 699, into suction line 4, through device 601 that houses antimicrobial assembly chamber 608 having collar 603 and antimicrobial additives (not shown), and through output orifice 606 as it enters the whirlpool's closed loop plumbing system. Antimicrobial assembly chamber 608 is removable and is installed in device 601 by inserting chamber 608 into output orifice 606 until collar 603 seats output orifice receiving brackets 604, 1604. Receiving brackets 604, 1604 prevent antimicrobial assembly chamber 608 from getting sucked into suction line 4. Receiving brackets 604, 1604 are located on two portions of device 601 to facilitate installation. In other words, depending on the configuration or location of pump 3 (at the back or front of tub), device 601 can be installed so that antimicrobial assembly chamber 608 is in output orifice 606, or on the output side. Cap 602 is shown on tub deck 6B covering deck-mounted antimicrobial dispensing device 601.

Referring to FIG. 29, high velocity water enters device 601 via input orifice 605 in direction WF. As water contacts antimicrobial additives (not shown) in antimicrobial chamber 1602, some of the additives leave antimicrobial chamber 1602 and are directly injected into suction line 4 of the whirlpool bathtub and the whirlpool bathtub pump. Optional filter media 607 may be placed over antimicrobial assembly chamber 608 as shown in FIG. 30, for example. FIG. 30 is referred to as an example, as a filter or other debris-trapping means can be placed over any of the alternate embodiment antimicrobial assembly chambers of the present invention. As stated above, such debris -trapping means could be replaceable. Thus, pump 3 (see FIG. 28) may be a reversible pump with a reversible impeller that backflows water through optional filter media 607 acting to dislodge debris from filter 607. Other types of self-cleaning mechanisms could also be employed.

Figure 31:
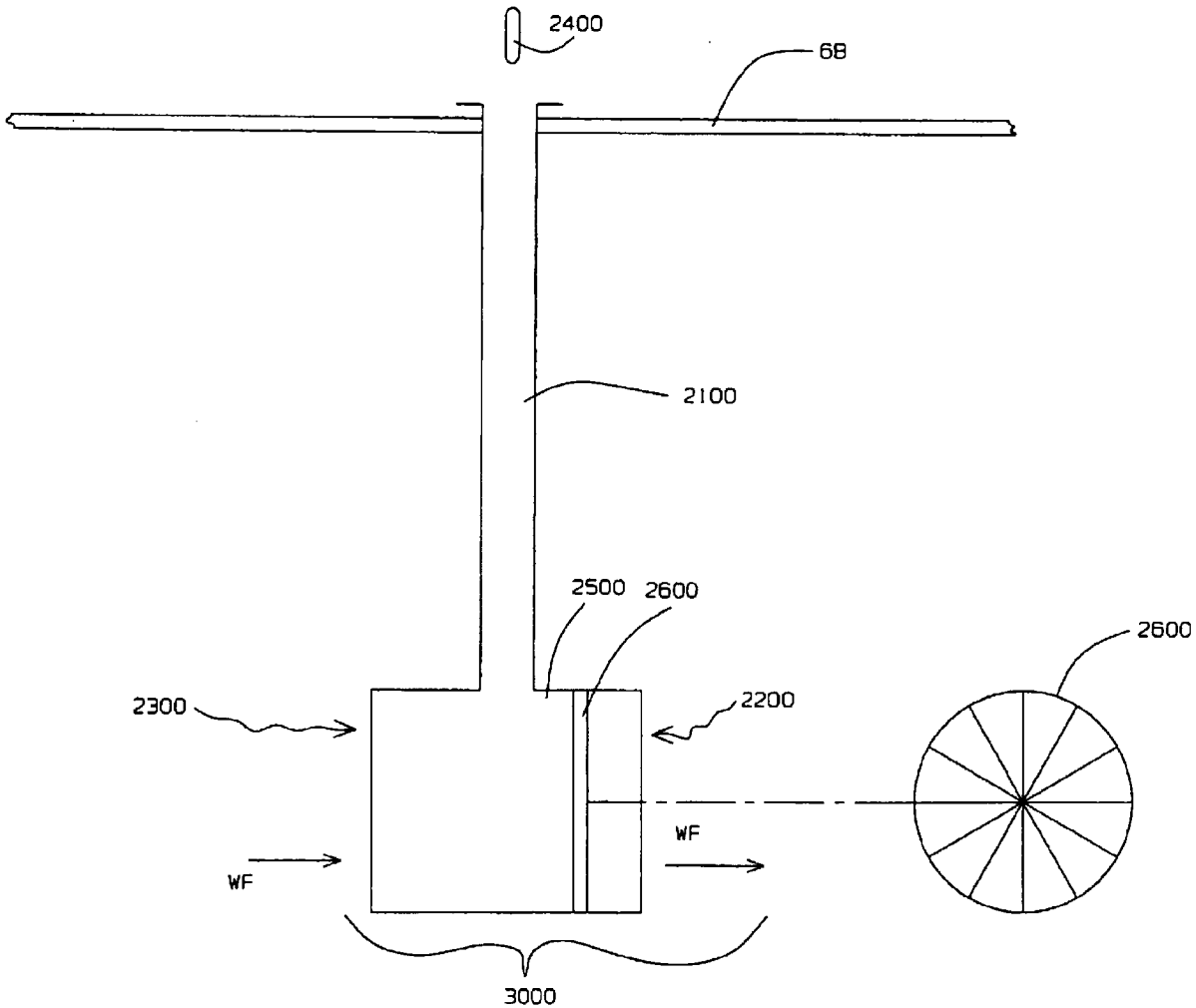
FIG. 31 shows an alternate embodiment antimicrobial dispensing device whereby antimicrobial additives are added on a per-use basis.

Referring next to FIG. 31, a user drops chemical 2400 into receiving chamber 2100 mounted in tub deck 6B as desired. The under deck mount is offered by way of example and not of limitation, as receiving chamber 2100 may be installed at a side mount. Chemical 2400 enters inline holding area 2500. Screen 2600 prevents chemical 2400 from getting sucked into output orifice 2200, suction line 4 (not shown), and into pump 3 (not shown). The screen is offered by way of example and not of limitation; any blocking or screening means could be employed. Without screen 2600 or an appropriate blocking or screening means, the high velocity water from tub 6 would force all of chemical 2400 from inline holding area 2500 into the closed looped plumbing system.

High velocity water enters antimicrobial dispensing device 3000 via input orifice 2300 in direction WF. As water contacts chemical 2400 in inline holding area 2500, some of chemical 2400 leaves inline holding area 2500 and is directly injected into suction line 4 of the whirlpool bathtub and pump 3 (not shown) via output orifice 2200. Input orifice 2300 and output orifice 2200, both having diameters over about 1 inch, are designed for high flow rates over 70 gpm or so.

The present invention teaches the use of an antimicrobial assembly chamber in combination with a suction device in a whirlpool bathtub system. To further help inhibit bacteria in a whirlpool bathtub, at least one component of the whirlpool bathtub could have antimicrobial additives impregnated into the component. Thus, for optimal protection, it is preferable that all whirlpool bathtub components that come in contact with water, and potentially exposed to microorganism growth, be impregnated with antimicrobial additives.

Figure 33:
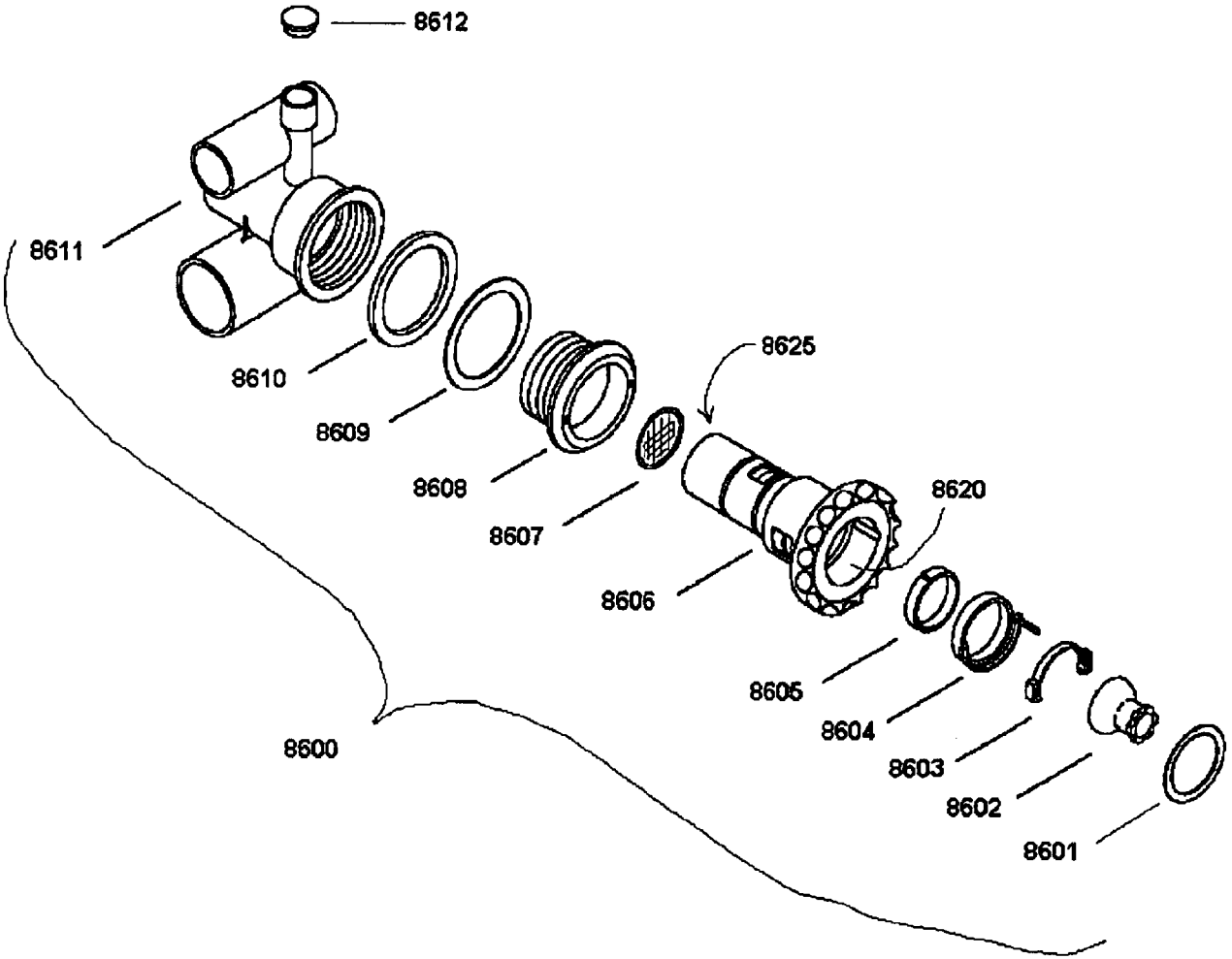
FIG. 33 is an exploded view of a screen mechanism for a whirlpool bathtub output jet.

As stated above, pump 3 circulates water via water return line 5 and jets 75 during whirlpool use. See. FIG. 1. During use, water is drawn from filled tub 6 via suction water line 4, passing antimicrobial assembly chamber 15 (not shown) mounted within sanitation suction device 31. There are times, however, when the whirlpool tub may have water in it but the closed loop piping system is inactive. Referring next to FIG. 33, jet assembly mechanism 8600 comprises jet ring 8601, jet eyeball 8602, swivel brackets, 8603, 8604, assembly ring 1805, which are housed within orifice 8620 of jet assembly 8606. Jet housing nut 8608 and gaskets 8609, 8610 secure jet assembly 8606 to jet body 8611 having air cap 8612. Screen mechanism 8607 prevents large debris (not shown) from flowing back into jets 75 of tub 6 while tub 6 holds water in it during tub inactivation.

Without screen mechanism 8607, it is possible for debris to enter jet assembly 8600 and the whirlpool bathtub closed looped piping system, thereby creating an environment where microorganisms may grow. Thus, screen mechanism 8607 aids in inhibiting bacteria growth by preventing debris from entering the closed loop plumbing system via jet assembly 8606.. Screen mechanism may be installed flush against orifice 8625 of jet assembly 8606. However, it could also be housed within orifice 8625. Preferably, screen mechanism 8067 has holes of less than 4000 microns in size.

Figure 34:
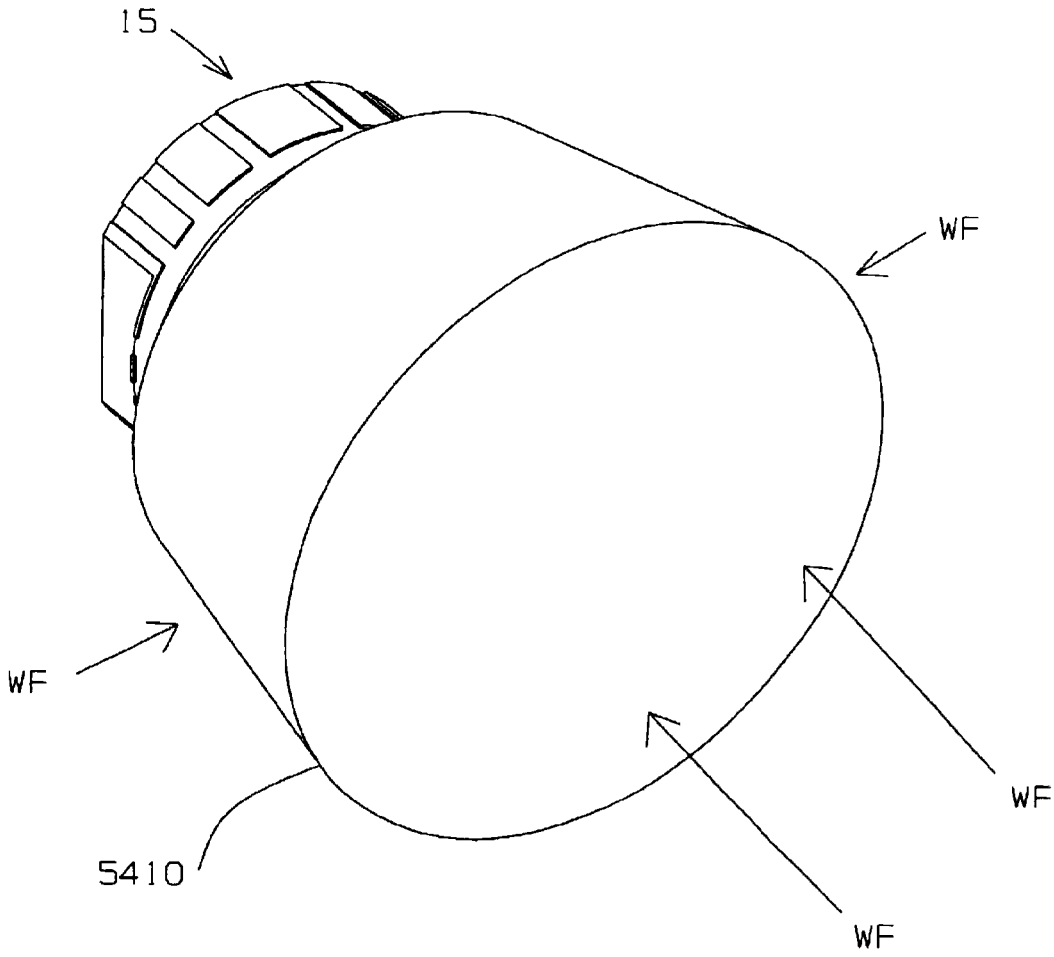
FIG. 34 is a perspective view of an antimicrobial chamber having a filter mounted thereon to screen debris.

Screen mechanism 8607 could used in combination with an antimicrobial assembly chamber 15 having a filter 5410 that wraps around chamber 15 (see FIG. 34). Water enters filter 5410 in direction WF. As stated above with regard to optional filter media 607, any debris-trapping means can be employed. In addition, such debris -trapping means could be replaceable. Filter 5410 functions as a screening mechanism for debris that passes through screen mechanism 8607 or otherwise enters suction device (not shown). Such a combination could serve as an input and output filter for the closed loop plumbing, further providing a system to inhibit debris from entering the closed loop plumbing bacteria in a whirlpool bathtub from jets 75 or suction device 31.

Although the present invention has been described with reference to various embodiments, numerous modifications and variations can be made and still the result will come within the scope of the invention. No limitation with respect to the specific embodiments disclosed herein is intended or should be inferred.

We claim:

1. In combination with a whirlpool bath, said whirlpool bath having a tub, the tub having an inside surface, a closed loop piping system, a water pump, output jets and a suction device, the improvement comprising:

a housing assembly having a mounting surface for providing a flush mount to the inside surface of the tub, below a fill line of the tub;

said housing assembly having an input orifice and an output orifice, and a shape to enable drainage;

said input orifice having a vertically oriented porous pop off faceplate screen;

a chemical chamber in said housing assembly;

said chemical chamber having a chemical that releases and mixes with water having a high velocity water flow, whereby said water is directly induced into a suction line of the whirlpool bathtub leading to the water pump; and wherein said chemical inhibits growth of microorganisms in the whirlpool bathtub during whirlpool bathtub use and/or between whirlpool bathtub usages.

2. The apparatus of claim 1, wherein the chemical chamber is removable to facilitate replacement of said microorganism-inhibiting chemical therein.

3. The apparatus of claim 1, wherein the housing assembly further comprises a non-electric cavitation port to shut down a suction force of the pump if the faceplate screen is removed.

4. The apparatus of claim 1, wherein the housing assembly further comprises a non-electric cavitation port to shut down a suction force of the pump if said input orifice is blocked.

5. The apparatus of claim 1, wherein the porous pop off faceplate screen does not deflect more than about ¾ inch if a point load of about 50 pounds is applied to a center of said faceplate.

6. The apparatus of claim 1, wherein the porous pop-off faceplate screen has hole openings of over 1000 microns in size.

7. The apparatus of claim 5, wherein the faceplate screen resists hair entrapment.

8. The apparatus of claim 1 further comprising a safety means which blocks the inlet orifice when said safety means is in a closed mode, thereby shutting down a suction force of the pump.

9. The apparatus of claim 8, wherein said safety means enables a shutdown of a suction water force if said chemical chamber is absent or inserted improperly.

10. The apparatus of claim 1, wherein said microorganism-inhibiting chemical is metered.

11. The apparatus of claim 10, wherein said microorganism-inhibiting chemical is in said suction line at a concentration of about 0.25 to about 6.0 parts per million as determined by an opening in said chemical chamber, wherein said opening is sized for various water flows and various tub water capacities.

12. The apparatus of claim 1 further comprising a microprocessor to count at least one bath cycle in a cycle counting run, wherein the bath cycle is initiated at a powering up of said pump.

13. The apparatus of claim 12, wherein said microprocessor ceases pump operation upon reaching a predetermined number of bath cycles in the cycle counting run and until said microprocessor is internally reset to begin another cycle counting run.

14. The apparatus of claim 12, wherein said microprocessor is reset when the chemical in said chemical chamber is replaced.

15. The apparatus of claim 2 further comprising a microprocessor to count at least one bath cycle in a cycle counting run, wherein the bath cycle is initiated at a powering up of said pump.

16. The apparatus of claim 15, wherein said microprocessor is reset when the removable chemical chamber is replaced.

17. The apparatus of claim 1 further comprising indicator lights to signal that the chemical in said chemical chamber requires replacement.

18. The apparatus of claim 16 further comprising indicator lights to signal that the removable chemical chamber requires replacement.

19. The apparatus of claim 1, wherein said combination device does not increase a vacuum in the suction line to the pump by more than 15 inches Hg.

20. The apparatus of claim 1, wherein said combination device has about a 30% or less water pressure restriction rate to an output side of the output jets.

21. The apparatus of claim 1, wherein said combination device retains less than 10½ ounces of water after whirlpool bathtub drain down.

22. The apparatus of claim 1 further comprising a replaceable filter screen having hole openings less than about 1000 microns in size.

23. The apparatus of claim 1, wherein said housing assembly is retrofitable in a standard tub.

24. The apparatus of claim 1, wherein the chemical chamber is integrated with the faceplate screen to facilitate replacing said microorganism-inhibiting chemical in the chemical chamber.

25. The apparatus of claim 1, wherein the output orifice has a diameter of at least about 1½ inch.

26. The apparatus of claim 1, wherein the input orifice has a diameter of at least about 1½ inch.

27. The apparatus of claim 8 further comprising a safety screen in said input orifice to prevent said safety means from being sucked into said housing, thereby preventing hair and body entrapment if said chemical chamber is absent in a drained tub.

28. The apparatus of claim 1, wherein the housing assembly further comprises an electric shut off mechanism to shut down a suction force of the pump if the faceplate screen is removed or said input orifice is blocked.

29. The apparatus of claim 1, wherein the chemical chamber further comprises a chamber which houses a scale reducer substance to inhibit scale buildup in the closed looped piping system.

30. The apparatus of claim 29, wherein said scale buildup further comprises biofilm.

31. The apparatus of claim 1 further comprising a skimmer to intake a low velocity water flow at the fill line of the tub.

32. The apparatus of claim 1, wherein said chemical chamber releases said microorganism-inhibiting chemical for at least five bath loads before said microorganism-inhibiting chemical in said chemical chamber is replaced.

33. The apparatus of claim 2, wherein said chemical chamber releases said microorganism-inhibiting chemical for at least five bath loads before said microorganism-inhibiting chemical in said chemical chamber is replaced.

34. The apparatus of claim 1, wherein said chemical chamber further comprises means for trapping debris.

35. The apparatus of claim 1 further comprising a screen mechanism to prevent debris from the tub from flowing into the output jets and entering the closed loop piping system.

36. A combination sanitation and suction device comprising:

a housing assembly having a mounting surface for providing a flush mount to an inside of a tub, below a fill line of the tub;

said housing assembly having an input orifice and an output orifice, and a shape to enable drainage;

said input orifice having a vertically oriented porous pop-off faceplate screen;

a chemical chamber mounted on said faceplate screen, thereby providing a suction device to intake all the water in the tub;

said chemical chamber having a chemical that releases and mixes with water having a high velocity water flow, whereby said water is directly induced into a suction line of the whirlpool bathtub leading to the water pump; and wherein said chemical inhibits growth of microorganisms in the whirlpool bathtub during whirlpool bathtub use and/or between whirlpool bathtub usages.

37. The apparatus of claim 36, wherein the chemical chamber mounted on said faceplate screen is removable to facilitate replacement of said microorganism-inhibiting chemical therein.

38. The apparatus of claim 36, wherein said chemical chamber mounted on said faceplate screen is removable to facilitate replacement of said microorganism-inhibiting chemical without having to remove said faceplate screen.

39. The apparatus of claim 36, wherein said chemical chamber mounted on said faceplate screen is integrally formed so said microorganism-inhibiting chemical can be replaced in said chemical chamber without having to remove said faceplate screen.

40. The apparatus of claim 36, wherein said chemical chamber is retrofitably mounted to said faceplate screen.

41. In combination with a whirlpool bath, said whirlpool bath having a tub, the tub having an inside surface, a closed loop piping system, a water pump, output jets and a suction device, the improvement comprising:

a housing assembly having a mounting surface for providing a flush mount to an inside of a tub, below a fill line of the tub;

said housing assembly having an input orifice and an output orifice, and a shape to enable drainage;

said input orifice having a vertically oriented porous pop-off faceplate screen;

a chemical chamber;

said chemical chamber having a chemical that releases and mixes with water having a high velocity water flow, whereby said water is directly induced into the closed loop piping system;

wherein said chemical inhibits growth of microorganisms in the whirlpool bathtub during whirlpool bathtub use and/or between whirlpool bathtub usage; and wherein said microorganism-inhibiting chemical is replaced by means of a fill shaft.

42. The apparatus of claim 41, wherein said chemical chamber is mounted in-line with the closed loop piping system.

43. The apparatus of claim 41, wherein said chemical chamber is mounted in said suction device.

44. In combination with a whirlpool bath, said whirlpool bath having a tub, the tub having an inside surface, a closed loop piping system, a water pump, output jets and a suction device, the improvement comprising:

a housing assembly having a mounting surface for providing a flush mount to the inside surface of the tub, below a fill line of the tub;

said housing assembly having an input orifice and an output orifice, and a shape to enable drainage;

said input orifice having a vertically oriented porous pop off faceplate screen;

a chemical chamber in said housing assembly;

said chemical chamber having a chemical that releases and mixes with water having a high velocity water flow, whereby said water is directly induced into a suction line of the whirlpool bathtub leading to the water pump;

wherein said chemical inhibits growth of microorganisms in the whirlpool bathtub during whirlpool bathtub use and/or between whirlpool bathtub usage; and wherein said combination device has about a 30% or less water pressure restriction rate to an output side of the output jets.

45. A combination chemical dispenser and suction device to inhibit microorganism growth in a whirlpool bathtub during use of the bathtub and/or between bathtub usage, said combination device comprising:

a housing assembly having a mounting surface for providing a flush mount to an inside of a tub, below a fill line of the tub;

said housing assembly having an input orifice and an output orifice, and a shape to enable drainage;

said input orifice having a vertically oriented porous faceplate;

a chemical dispenser mounted inside the housing assembly, thereby providing a suction device to intake all the water in the tub;

wherein said chemical dispenser houses an antimicrobial chemical therein;

wherein said antimicrobial chemical is metered out to produce a concentration of less than about 6 ppm of antimicrobial chemical in said water in a tub during a given bath cycle for a given tub capacity and water flow rate; and wherein said chemical dispenser is in axial alignment with the input orifice.

46. In combination with a whirlpool bathtub, a combination chemical chamber and suction device comprising:

a housing assembly having a mounting surface for providing a flush mount to an inside of a whirlpool bathtub;

said housing assembly having an input orifice and an output orifice, said input orifice having a porous faceplate;

a chemical chamber in said housing assembly, thereby providing a combination suction device to intake all water in the bathtub, and to continuously pass said water through said chemical chamber;

said chemical chamber having a chemical that releases and mixes with water;

wherein said chemical concentration in said bathtub does not exceed about 6 ppm after mixing said chemical with said water during a bath cycle under about one hour in duration; and wherein said chemical inhibits microorganism growth in the whirlpool bathtub during whirlpool bathtub use and/or between whirlpool bathtub usages.

47. In combination with a whirlpool bathtub, a combination chemical chamber and suction device that kills microorganisms in the whirlpool bathtub, said combination chemical chamber and suction device comprising:

a housing assembly having a mounting surface for providing a flush mount to an inside of the whirlpool bathtub, below a fill line of the whirlpool bathtub;

said housing assembly having an input orifice and an output orifice, said input orifice having a vertically oriented porous faceplate;

a chemical chamber in said housing assembly;

said chemical chamber having a chemical that releases and mixes with water having a high velocity water flow, whereby said water is directly induced into a suction line of the whirlpool bathtub leading to a whirlpool bathtub pump, wherein said chemical inhibits microorganism growth in the whirlpool bathtub during whirlpool bathtub use and/or between whirlpool bathtub usage; and wherein said combination chemical chamber and suction device retains less than about 10½ ounces of water after whirlpool bathtub drain down.

48. In combination with a whirlpool bathtub, a combination high velocity water flow chemical chamber and suction device that kills microorganisms, said combination device comprising:

a housing assembly having a mounting surface for providing a flush mount to an inside of the whirlpool bathtub, below a fill line of the whirlpool bathtub;

said housing assembly having an input orifice and an output orifice, said input orifice having a vertically oriented porous faceplate;

a chemical chamber in said housing assembly;

said chemical chamber having a chemical that releases and mixes with water that is directly induced into a suction line of the whirlpool bathtub leading to a whirlpool bathtub pump, wherein said chemical inhibits microorganism growth in the whirlpool bathtub;

wherein said combination chemical chamber and suction device retains less than about 10½ ounces of water after whirlpool bathtub drain down; and said combination chemical chamber and suction device accommodating a high velocity water flow of more than about70 gallons per minute.

49. In combination with a whirlpool bathtub, a combination high velocity water flow chemical chamber and suction device that kills microorganisms, said combination device comprising:

a housing assembly having a mounting surface for providing a flush mount to an inside of the whirlpool bathtub, below a fill line of the whirlpool bathtub;

said housing assembly having an input orifice and an output orifice, said input orifice having a vertically oriented porous faceplate;

a chemical chamber in said housing assembly;

said chemical chamber having a chemical that inhibits microorganism growth in the whirlpool bathtub during whirlpool bathtub use and/or between whirlpool bathtub usages;

said combination chemical chamber and suction device accommodating high velocity water flow;

wherein said high velocity water flow contacts said microorganism-inhibiting chemical that releases and mixes with said high velocity water and is directly induced into a suction line of the whirlpool bathtub leading to a whirlpool bathtub pump; and wherein said combination chemical chamber and suction device retains less than about 10½ ounces of water after whirlpool bathtub drain down.

50. In combination with a whirlpool bathtub, a combination high velocity water flow chemical chamber and suction device that kills microorganisms, said combination device comprising:

a housing assembly having a mounting surface for providing a flush mount to an inside of the whirlpool bathtub, below a fill line of the whirlpool bathtub;

said housing assembly having an input orifice and an output orifice, said input orifice having a vertically oriented porous faceplate that resists hair entrapment;

a removable chemical chamber with an attachment member for insertability into said housing assembly;

said removable chemical chamber having a chemical that inhibits microorganism growth in the whirlpool bathtub during whirlpool bathtub use and/or between whirlpool bathtub usages;

said combination chemical chamber and suction device accommodating high velocity water flow;

wherein said high velocity water flow contacts said microorganism-inhibiting chemical that releases and mixes with said high velocity water and is directly induced into a suction line of the whirlpool bathtub leading to a whirlpool bathtub pump; and wherein said combination chemical chamber and suction device retains less than about 10½ ounces of water after whirlpool bathtub drain down.

51. In combination with a whirlpool bathtub, a combination high velocity water flow chemical chamber and suction device that kills microorganisms, said combination device comprising:

a housing assembly having a mounting surface for providing a flush mount to an inside of the whirlpool bathtub, below a fill line of the whirlpool bathtub;

said housing assembly having an input orifice and an output orifice, said input orifice having a vertically oriented porous faceplate;

an axially aligned adjustable removable chemical chamber with an attachment means for insertability into said housing assembly;

said removable chemical chamber housing a chemical that releases and mixes with water having a high velocity water flow, whereby said water is directly induced into a suction line of the whirlpool bathtub leading to a whirlpool bathtub pump;

wherein said chemical inhibits microorganism growth in the whirlpool bathtub;

wherein said combination chemical chamber and suction device retains less than about 10½ ounces of water after whirlpool bathtub drain down; and a microprocessor to count at least one bath cycle in a cycle counting run, wherein the bath cycle is initiated at a powering up of said pump.

52. In combination with a whirlpool bathtub, a combination high velocity water flow chemical chamber and faceplate device that inhibits microorganism growth in a whirlpool bathtub during whirlpool bathtub use and/or between whirlpool bathtub usage, said combination device comprising:

a housing assembly having a mounting surface for providing a flush mount to an inside of the whirlpool bathtub, below a fill line of the whirlpool bathtub;

said housing assembly having an input orifice and an output orifice, and a shape to enable drainage;

said input orifice having a porous faceplate screen;

a chemical chamber mounted on said faceplate screen, thereby providing a suction device to intake all the water in the tub;

said chemical chamber having a chemical that releases and mixes with water having a high flow rate, whereby said water is directly induced into a suction line of the whirlpool bathtub leading to the water pump, wherein said chemical inhibits growth of microorganisms in the whirlpool bathtub; and wherein said chemical chamber mounted on said faceplate screen is removable to facilitate replacement of said microorganism-inhibiting chemical without having to remove said faceplate screen.

53. In combination with a whirlpool bathtub, a combination high velocity water flow chemical chamber and faceplate device that inhibits microorganism growth in a whirlpool bathtub during whirlpool bathtub use and/or between whirlpool bathtub usage, said combination device comprising:

a housing assembly having a mounting surface for providing a flush mount to an inside of the whirlpool bathtub, below a fill line of the whirlpool bathtub;

said housing assembly having an input orifice and an output orifice, and a shape to enable drainage;

said input orifice having a porous faceplate screen;

a chemical chamber mounted on said faceplate screen, thereby providing a suction device to intake all the water in the tub;

said chemical chamber having a chemical that releases and mixes with water having a high velocity flow rate, whereby said water is directly induced into a suction line of the whirlpool bathtub leading to the water pump;

wherein said chemical inhibits growth of microorganisms in the whirlpool bathtub; and said chemical chamber mounted on said faceplate screen is integrally formed so said microorganism-inhibiting chemical can be replaced in said chemical chamber without having to remove said faceplate screen.

54. In combination with a whirlpool bath, said whirlpool bath having a tub, the tub having an inside surface, a closed loop piping system, a water pump, output jets and a suction device, the improvement comprising:

a housing assembly having a mounting surface for providing a flush mount to an inside of a tub, below a fill line of the tub;

said housing assembly having an input orifice and an output orifice, and a shape to enable drainage;

said input orifice having a vertically oriented porous pop-off faceplate screen;

a chemical chamber mounted inline with the closed loop piping system;

said chemical chamber having a chemical that releases and mixes with water having a high flow rate, whereby said water is directly induced into the closed loop piping system;

wherein said chemical inhibits growth of microorganisms in the whirlpool bathtub during whirlpool bathtub use and/or between whirlpool bathtub usage; and wherein said microorganism-inhibiting chemical is replaced by means of a fill shaft.

55. In combination with a whirlpool bath, said whirlpool bath having a tub, the tub having an inside surface, a closed loop piping system, a water pump, output jets and a suction device, the improvement comprising:

a housing assembly having a mounting surface for providing a flush mount to an inside of a tub, below a fill line of the tub;

said housing assembly having an input orifice and an output orifice, and a shape to enable drainage;

said input orifice having a vertically oriented porous pop-off faceplate screen;

a chemical chamber mounted in said suction device;

said chemical chamber having a chemical that releases and mixes with water having a high velocity flow rate, whereby said water is directly induced into the closed loop piping system;

wherein said chemical inhibits growth of microorganisms in the whirlpool bathtub during whirlpool bathtub use and/or between whirlpool bathtub usage; and wherein said microorganism-inhibiting chemical is replaced by means of a fill shaft.

56. In combination with a whirlpool bath, said whirlpool bath having a tub, the tub having an inside surface, a closed loop piping system, a water pump, output jets and a suction device, the improvement comprising:

a housing assembly having an input orifice and an output orifice;

a chemical chamber mounted in said housing assembly;

said chemical chamber having a chemical that releases and mixes with water that is directly induced into the closed loop piping system, wherein said chemical inhibits growth of microorganisms in the whirlpool bathtub during whirlpool bathtub use and/or between whirlpool bathtub usage;

said chemical chamber having a screen means to prevent said microorganism-inhibiting chemical from being sucked into said output orifice by a high velocity flow of water; and wherein said microorganism-inhibiting chemical is replaced by means of a fill shaft on a per-use basis.

57. In combination with a whirlpool bathtub, a combination high velocity water flow chemical chamber and suction device that kills microorganisms, said combination device comprising:

a housing assembly having a mounting surface for providing a flush mount to an inside surface of the bathtub, below a fill line of the bathtub;

said housing assembly having an input orifice and an output orifice, and a shape to enable drainage;

said input orifice having a vertically oriented porous pop off faceplate screen;

a chemical chamber in said housing assembly, thereby providing a high velocity water flow suction device to intake high velocity water below said fill line of the bathtub;

a skimmer to intake a low velocity water flow at said fill line of the bathtub;

wherein said low velocity water flow combines with said high velocity water flow, said combined flow passing said chemical chamber having a chemical that releases and mixes with said combined water that is directly induced into a suction line of the whirlpool bathtub leading to a water pump; and wherein said chemical inhibits growth of microorganisms in the whirlpool bathtub during whirlpool bathtub use and/or between whirlpool bathtub usages.

58. The apparatus of claim 56, wherein said chemical chamber further comprises means for trapping debris.

59. In combination with a whirlpool bath, said whirlpool bath having a tub, the tub having an inside surface, a closed loop piping system, a water pump, output jets and a suction device having a faceplate, a method for retrofitting the faceplate, the method comprising the steps of:

providing the faceplate;

cutting an opening in said faceplate;

attaching a chemical chamber having an aperture to said faceplate by inserting said chemical chamber into the opening cut into said faceplate and securing said chemical chamber to said faceplate by an attachment means;

inserting a microorganism-inhibiting chemical in said chemical chamber; and placing a cover over said chemical chamber, thereby forming a combination faceplate and antimicrobial dispenser that dispenses said microorganism-inhibiting chemical into the closed looped piping system of the whirlpool bathtub when a high velocity water contacts said microorganism-inhibiting chemical.

60. In combination with a whirlpool bath, said whirlpool bath having a tub, the tub having an inside surface, a closed loop piping system, a water pump, output jets and a suction device, said combination device comprising:

a housing assembly means having a mounting surface, said housing assembly means functioning to provide a flush mount to the inside surface of the tub, below a fill line of the tub;

said housing assembly means having an inlet means functioning to intake high velocity water below said fill line of the tub, and an outlet means functioning to discharge water passing through said combination device into the closed loop piping system, and a shape to enable drainage;

said inlet means having a porous faceplate means functioning to cover said combination device; and a chemical chamber means in said housing assembly means, said chemical chamber means functioning to house and release a chemical means;

said chemical means functioning to mix with water that is directly induced into a suction line of the whirlpool bathtub leading to the water pump and functioning to inhibit growth of microorganisms in the whirlpool bathtub during whirlpool bathtub use and/or between whirlpool bathtub usages;

said chemical chamber means releases said chemical means for a plurality of bath loads before said chemical means in said chemical chamber means is replaced; and said combination device having high velocity water flow of at least about 70 gallons per minute.

61. The apparatus of claim 60, wherein said plurality of bath loads is preferably at least five.

62. In combination with a whirlpool bath, said whirlpool bath having a tub, the tub having an inside surface, a closed loop piping system, a water pump, output jets and a suction device, said combination device comprising:

a housing assembly means having a mounting surface, said housing assembly means functioning to provide a flush mount to the inside surface of the tub, below a fill line of the tub;

said housing assembly means having an inlet means functioning to intake high velocity water below said fill line of the tub, and an outlet means functioning to discharge water passing through said combination device into the closed loop piping system, and a shape to enable drainage;

said inlet means having a porous faceplate means functioning to cover said combination device; and a removable chemical chamber means in said housing assembly means, said removable chemical chamber means functioning to house and release a chemical means;

said chemical means functioning to mix with water that is directly induced into a suction line of the whirlpool bathtub leading to the water pump and functioning to inhibit growth of microorganisms in the whirlpool bathtub during whirlpool bathtub use and/or between whirlpool bathtub usages;

said chemical chamber means releases said chemical means for a plurality of bath loads before said chemical means in said chemical chamber means is replaced; and said combination device having high velocity water flow of about at least 70 gallons per minute.

63. The apparatus of claim 62, wherein said plurality of bath loads is preferably at least five.

64. A microorganism-inhibiting whirlpool bath comprising:

tub means functioning to hold water, said tub means having an inside surface;

closed loop piping means functioning to pipe water into and out of said tub means;

pump means functioning to pump water through said closed loop piping means;

output jet means functioning to discharge water from said closed loop piping means into said tub means;

a combination suction device mounted below a fill line of the tub means, said combination device having a housing assembly means with a mounting surface, said housing assembly means functioning to provide a flush mount to said inside surface of the tub means;

said housing assembly means having an inlet means functioning to intake high velocity water below said fill line of the tub means, and an outlet means functioning to discharge water passing through said combination suction device into said closed loop piping means, and a shape to enable drainage, said inlet means having a porous faceplate means functioning to cover said combination suction device;

a chemical chamber means functioning to house and release a chemical means, said chemical means functioning to mix with water that is directly induced into a suction line of the whirlpool bath leading to the pump means and functioning to inhibit growth of microorganisms in the whirlpool bath during whirlpool bath use and/or between whirlpool bath usages;

wherein a concentration of said chemical means in said tub means does not exceed about 6 ppm after mixing said chemical means with said water during a bath cycle under about one hour in duration; and wherein said whirlpool bath retains less than 2 ounces of water per output jet means after whirlpool bath drain down.

65. In combination with a whirlpool bath, said whirlpool bath having a tub component, the tub component having an inside surface component, a closed loop piping system component, a water pump component, output jet components and a suction device component, the improvement comprising:

a housing assembly having a mounting surface for providing a flush mount to the inside surface component of the tub component, below a fill line of the tub component;

said housing assembly having an input orifice and an output orifice, and a shape to enable drainage;

said input orifice having a vertically oriented porous pop off faceplate screen;

a chemical chamber in said housing assembly;

said chemical chamber having a chemical that releases and mixes with water having a high velocity water flow, whereby said water is directly induced into a suction line of the whirlpool bathtub leading to the water pump component;

wherein said chemical inhibits growth of microorganisms in the whirlpool bathtub during whirlpool bathtub use; and wherein said whirlpool bath has antimicrobial additives impregnated in at least one component of the whirlpool bath.

66. The apparatus of claim 65, wherein said antimicrobial additives-impregnated component is selected from the group consisting of the tub component, the inside surface component, the closed loop piping system component, the water pump component, the output jet components, and the suction device component.

67. In combination with a whirlpool bath, said whirlpool bath having a tub, the tub having an inside surface, a closed loop piping system, a water pump, output jets and a suction device, a combination inline chemical chamber and suction device that inhibits growth of microorganisms in the tub, said combination chemical chamber and suction device comprising:

a housing assembly having a mounting surface for providing a flush mount to the inside surface of the tub, below a fill line of the tub;

said housing assembly having an input orifice and an output orifice, and a shape to enable drainage;

said input and output orifices each having a diameter of at least about 1 inch;

said input orifice having a vertically oriented porous pop off faceplate screen;

a chemical chamber in said housing assembly;

said chemical chamber having a chemical that releases and mixes with water having a high velocity water flow, whereby said water is directly induced into a suction line of the whirlpool tub leading to the water pump; and wherein a concentration of said chemical does not exceed about 6 ppm after mixing said chemical with said water during a bath cycle of less than about one hour in duration; and wherein said combination device retains less than 10½ ounces of water after whirlpool bathtub drain down.

68. In combination with a whirlpool bath, said whirlpool bath having a tub, the tub having an inside surface, a closed loop piping system, a water pump, output jets and a suction device, a combination device comprising:

a housing assembly means having a mounting surface, said housing assembly means functioning to provide a flush mount to the inside surface of the tub, below a fill line of the tub;

said housing assembly means having an inlet means functioning to intake high velocity water below said fill line of the tub, and an outlet means functioning to discharge water passing through said combination device into the closed loop piping system, and a shape to enable drainage;

said inlet means having a porous faceplate means functioning to cover said combination device; and a porous member means having a chemical means thereon, said porous member means functioning to cover said porous faceplate means;

said chemical means functioning to mix with water that is directly induced into a suction line of the whirlpool bathtub leading to the water pump, thereby passing through said porous faceplate means, and functioning to inhibit growth of microorganisms in the whirlpool bathtub during whirlpool bathtub use and/or between whirlpool bathtub usages; and wherein a concentration of said chemical does not exceed about 6 ppm after mixing said chemical means with said water during a bath cycle of less than about one hour in duration.

69. The apparatus of claim 68, wherein the porous member means is removable.

* * * * *